US006649026B2

(12) United States Patent
Lamb

(10) Patent No.: US 6,649,026 B2
(45) Date of Patent: Nov. 18, 2003

(54) PAPER MAKING MACHINE FABRIC

(75) Inventor: Hans-Jürgen Lamb, Mannheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 09/982,032

(22) Filed: Oct. 19, 2001

(65) Prior Publication Data

US 2002/0056536 A1 May 16, 2002

Related U.S. Application Data

(63) Continuation of application No. PCT/EP00/03450, filed on Apr. 17, 2000.

(30) Foreign Application Priority Data

Apr. 20, 1999 (DE) ..... 199 17 869

(51) Int. Cl.[7] ..... D03D 3/04; D21F 1/10

(52) U.S. Cl. ..... 162/348; 162/116; 162/902; 162/903; 139/383 A; 139/425 A; 442/203

(58) Field of Search ..... 162/109, 116, 162/117, 199, 306, 348, 358.2, 900, 902, 903, 904; 139/383 A, 383 AA, 425 A; 156/470; 245/2; 28/142; 442/181, 203–207

(56) References Cited

U.S. PATENT DOCUMENTS

| | | | | | |
|---|---|---|---|---|---|
| 4,239,065 | A | * | 12/1980 | Trokhan | 139/383 A |
| 4,281,688 | A | | 8/1981 | Kelly et al. | 139/383 A |
| 4,759,975 | A | * | 7/1988 | Sutherland et al. | 139/383 A |
| RE33,195 | E | * | 4/1990 | McDonald et al. | 139/383 A |
| 5,089,324 | A | * | 2/1992 | Jackson | 139/383 A |

FOREIGN PATENT DOCUMENTS

| | | |
|---|---|---|
| DE | 3008344 | 9/1980 |
| EP | 677612 | 10/1995 |
| EP | 724038 | 7/1996 |
| GB | 2069017 | 8/1981 |
| WO | 96/04418 | 2/1996 |
| WO | 97/32081 | 9/1997 |
| WO | 97/38160 | 10/1997 |

* cited by examiner

*Primary Examiner*—Steven P. Griffin
*Assistant Examiner*—Eric Hug
(74) *Attorney, Agent, or Firm*—Burns Doane Swecker & Mathis LLP

(57) ABSTRACT

The invention relates to a paper machine clothing in the form of a fabric with a web pattern which recurs regularly over the surface and has indentations (20) that are formed by the thread overlays (21), the latter having been surface ground. The thread overlays cover three consecutive warp or weft threads crosswise thereto. A paper machine clothing of this type can be used especially in "through air drying" techniques to produce an especially voluminous tissue paper.

7 Claims, 50 Drawing Sheets

Figure 1:
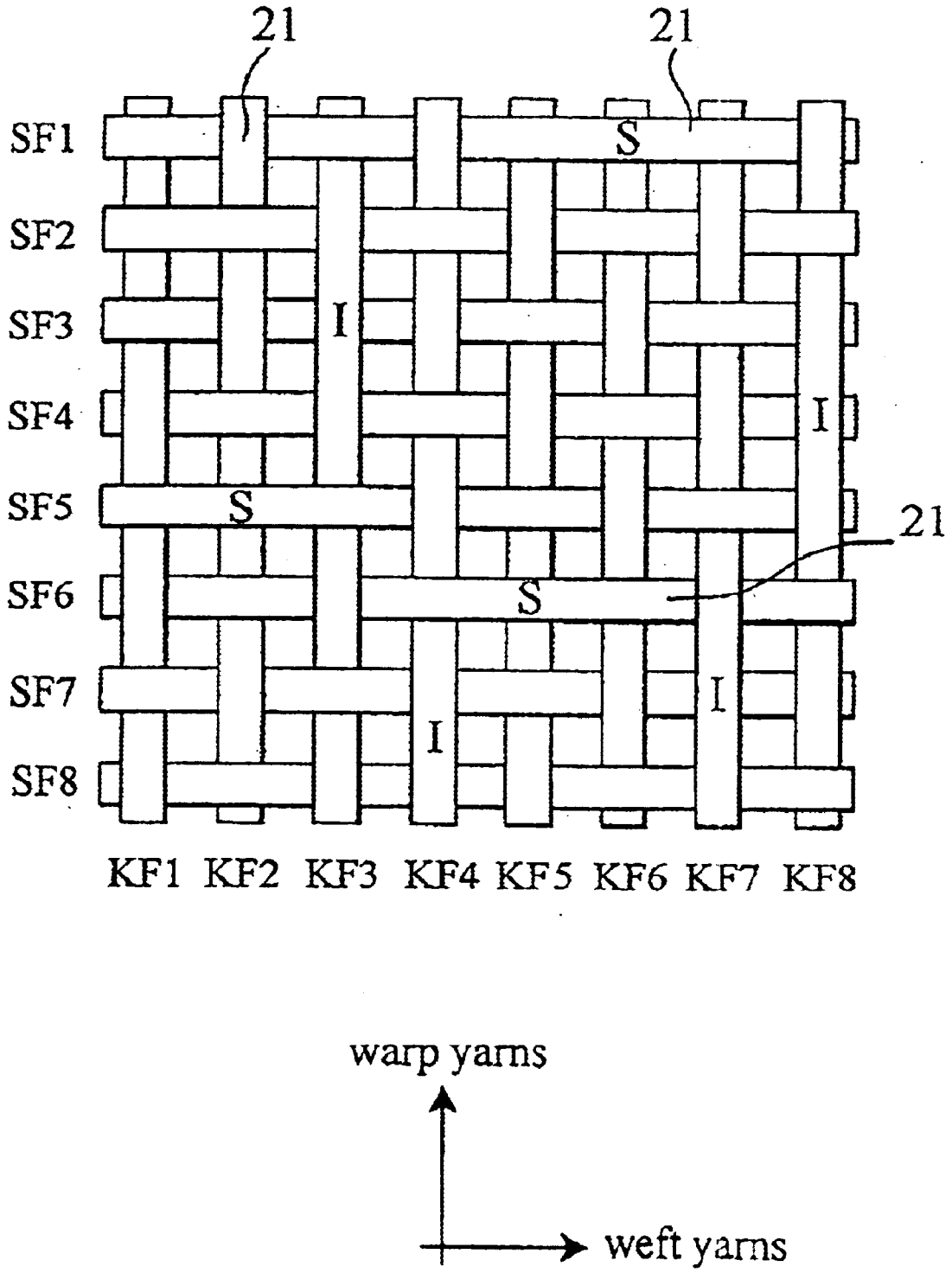

A-A:

B-B:

C-C:

D-D:

Yankee -side air-side

PAPER MAKING MACHINE FABRIC

This application is a continuation of International Application No. PCT/EP00/03450 filed on Apr. 17, 2000, which International Application was published by the International Bureau in German on Oct. 26, 2000.

TECHNICAL FIELD

The technical field, to which the invention relates, concerns the production of tissue paper on a corresponding paper making machine, in which in particular a through air drying (TAD) zone is present. A special impressing tissue is used in this TAD zone.

PRIOR ART

The sheet formation of the paper and the three-dimensional structuring of a moist non-woven fabric which has already been formed but can still be deformed due to a high residual water content is normally carried out on supporting fabrics which originate from textile weaving processes.

The three-dimensional structure of a moist paper sheet by the formation of zones of lesser density, which are framed by compressed zones, is carried out in modem tissue producing machines within the framework of pre-drying of the sheet in a pre-drying part before the Yankee cylinder. The pre-drying of the paper sheet is carried out on the supporting fabric by convection, in that hot air is pressed through the paper sheet which is located on the supporting fabric.

One speaks of "through air drying" or TAD.

The three-dimensional structuring is conventionally carried out in three steps, which usually succeed each other while being locally separated. The first step is formed by a deflection of the fibers in the Z-direction into the structuring recesses of the supporting fabric which are provided by the TAD impressing fabric which are systematically distributed over the area of the fabric which is contacted by paper. The deflection of the fibers in the Z-direction is caused by air and water flows, supported by a vacuum in one or, in certain circumstances, a plurality of suction boxes which is/are arranged on the side of the supporting fabric opposite the side contacted by the paper.

The deflection of the fibers in the Z-direction into the interior of the recesses creates in the paper sheet zones of reduced density, which are also described as pillows. These zones of reduced density which are arranged in a pattern are dried in a second step on and/in the interior of the supporting fabric by the air which passes through one or a plurality of TAD cylinders and thereby it is fixed in the present fiber distribution. We speak of a "freezing" of the state of fiber distribution.

In a third step, partial compression is then carried out of the pre-dried non-woven fiber fleece by pressing the supporting fabric with the pre-dried sheet laid on it, by means of a press roller against the surface of the Yankee cylinder. The compression of the paper sheet is carried out on the raised points of the supporting fabric which can be formed both in certain zones of the surface of the supporting fabric by warp wires as well as by weft wires. Thereby the fibers which are located in recesses of the fabric remain protected against compression. TAD imprinting fabrics, as a supporting fabric, constitute a special form of the fabric which has its typical structure-forming properties due to the type of weaving, the yarn selection with respect to material, diameter, cross-sectional form and later treatment, for example the thermo-fixing and grinding of the surface.

Paper making machine fabrics are known for example from WO 96/04418, DE OS 30 08 344, EP0 724 038 A1.

DESCRIPTION OF THE INVENTION

The technical problem (object) of the invention is to create a paper making machine fabric which is suitable and designed with respect to a tissue paper which is produced thereby of an improved three-dimensional surface structure in the form of a sequence of recesses and elevations for the achievement of a tissue paper with improved appearance, improved softness and increased volume in connection with an improved water absorption and an improved feel.

This problem is solved, in particular, by the features of patent claim 1.

This solution is based on the finding that in the fabric of the paper machine fabric in the weft and warp yarns of the fabric at selected points warp yarns are superimposed on three successive intersections of weft yarns and weft yarns are superimposed on three successive intersections of warp yarns, so that on the top of the paper making machine fabric, i.e. on the side of the fabric which contacts the paper, longer sections of the warp or weft yarns are exposed and by comparison with a normal standard weave had a larger degree of freedom of movement upwards, i.e. perpendicularly to the plane of the fabric. This greater degree of freedom of movement results during the matching of such yarn sections in the formation of relatively deep recesses, which provide the paper making machine fabric with an increased total height and therefore with higher three-dimensionality. This is increased, when in the zone of the at least three overlays the outer intersection points in direct succession are designed as based intersection points, at which the yarn is raised with the greater degree of freedom, when in the weaving process, the fabric is compressed after the introduction of the weft yarn and, in particular, a relatively dense fabric is produced in which the weft and warp yarns preferably no longer extend in a straight line in the transverse and longitudinal directions. This effect can also appear and, in certain circumstances, more strongly in connection with the dense fabric, if a thermo-shrinkage is caused in a relatively loose fabric. The forces which arise in this context lead to a strong raising of the yarn with a greater degree of freedom. Therefore due to the solution in accordance with the invention a paper making machine fabric is created, in which outstandingly deep recesses are present with the result that, in particular, in the TAD zone by using this paper making machine fabric a paper and, in particular, a tissue paper can be produced which has outstandingly great three-dimensionality with respect to increasing volume, which permits the paper to seem to be especially fluffy, and, in addition, shows outstanding capacity for water absorption together with excellent softness. In addition, the result is an improved similarity to a woven structure and therefore a character which is more similar to cloth.

When there is mention of a number of types of weft yarns, this means that such a number of weft yarns is present which take a different direction.

Special further embodiments with respect to the tissue paper result from subclaims 7 to 28. Accordingly the paper has two different types of non-compressed zones of different form or size. The non-compressed zones are surrounded by compressed zones, so-called picket zones. The different types of non-compressed zones can have a different number of creping folds. Each type of non-compressed zone always has preferably the same number of creping folds. It can occur that individual non-compressed zones of a certain type have a number of creping folds which do not deviate from the ideal value. But smaller non-compressed zones can also be present without creping folds and the larger non-compressed zones can be present with two creping folds.

Due to this product there is a substantially improved feel in that the mechanical properties of the tissue paper are substantially altered and/or improved. The textile type character is also substantially strengthened. There is also an improvement with respect to liquid absorption and adsorption by relatively large pockets to store liquid and large surface pores to accept particles. The tissue paper has a clearly greater thickness.

In one embodiment, a paper making machine fabric comprises a woven fabric having a weave pattern which is regularly repeated over the surface, weft yarns, warp yarns, and recesses or pockets which open upwardly to a paper supporting side of the fabrics. In zones spaced over a surface of the fabric, one of the warp yarns overlays at least three of the weft yarns in direct sequence, said one warp yarn having adjacent warp yarn disposed on each side of said one warp yarn, a first of said at least three weft yarns extends under said one warp yarn and under the adjacent warp yarns on both sides of said one warp yarn, a second and third of said three weft yarns overlays the adjacent warp yarns at at least three points. Further, one of the weft yarns overlays at least three of the warp yarns in direct sequence, said one weft yarn having an adjacent weft yarn disposed on each side of said weft yarn, a first of said at least three warp yarns extends under said one weft yarn and under the adjacent weft yarns on both sides of said one weft yarn, and a second and third of said at least three warp yarns overlays said adjacent weft yarns at at least three points. Overlays are on the paper supporting side of the fabric.

Further embodiments follow from the sub-claims. A further increase in the depth of the recesses can be achieved by the features of claim 2. A series of examples of embodiments emerges from the other sub-claims.

A SHORT DESCRIPTION OF THE DRAWINGS

Figure 2:
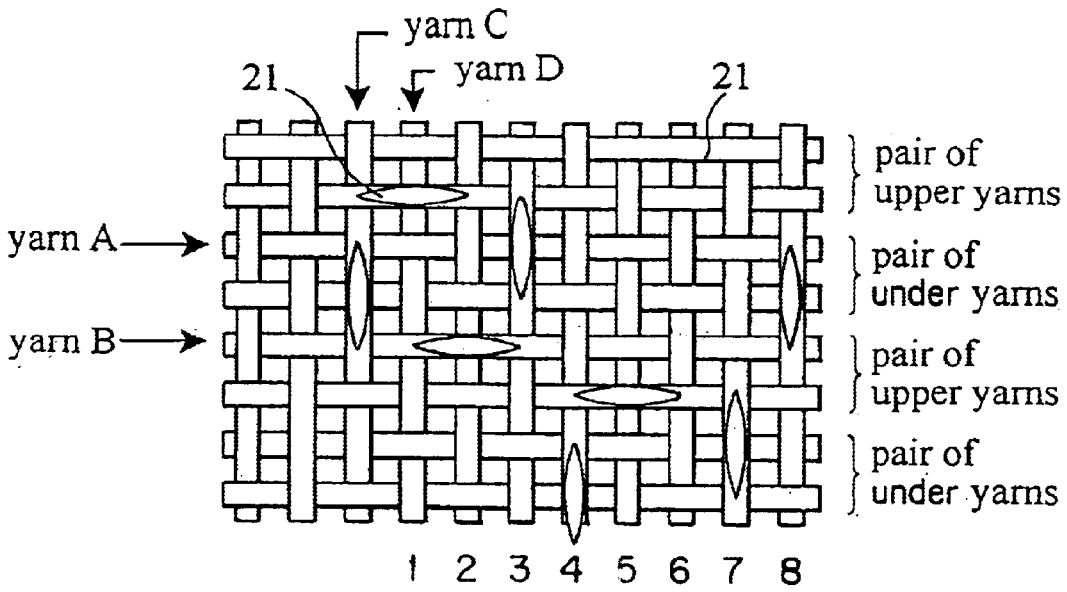
Figure 2A:
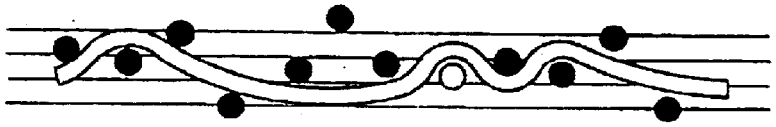
Figure 2B:
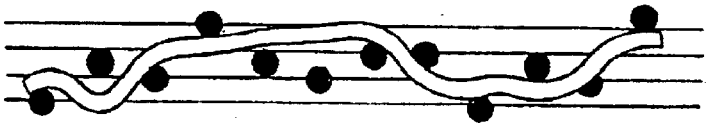
Figure 2C:
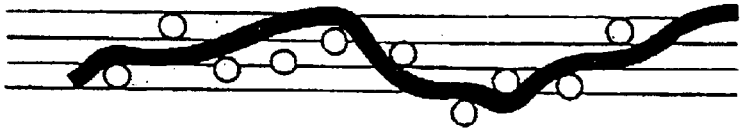
Figure 2D:
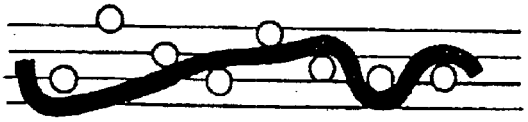
Figure 3:
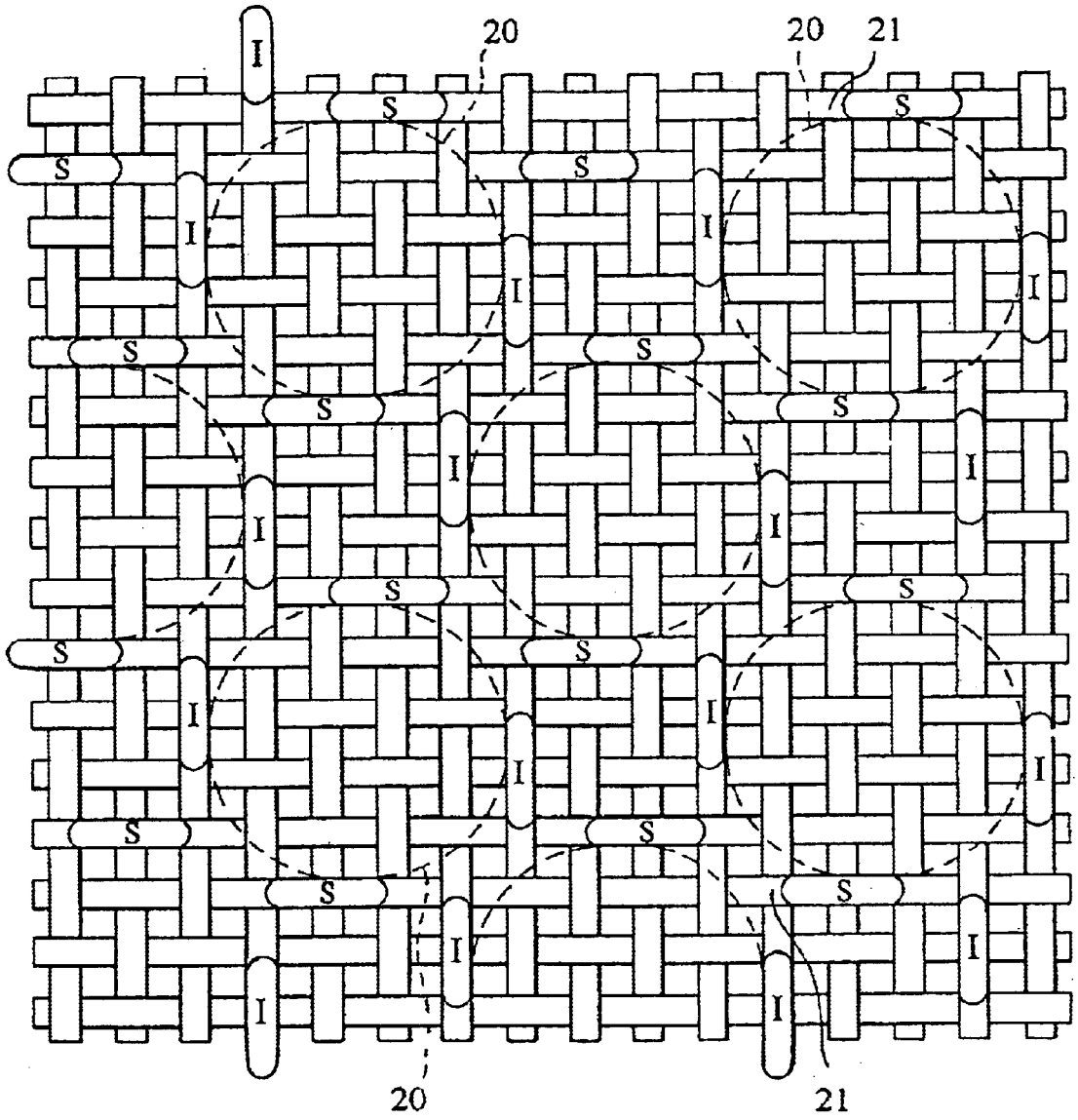
Figure 4:
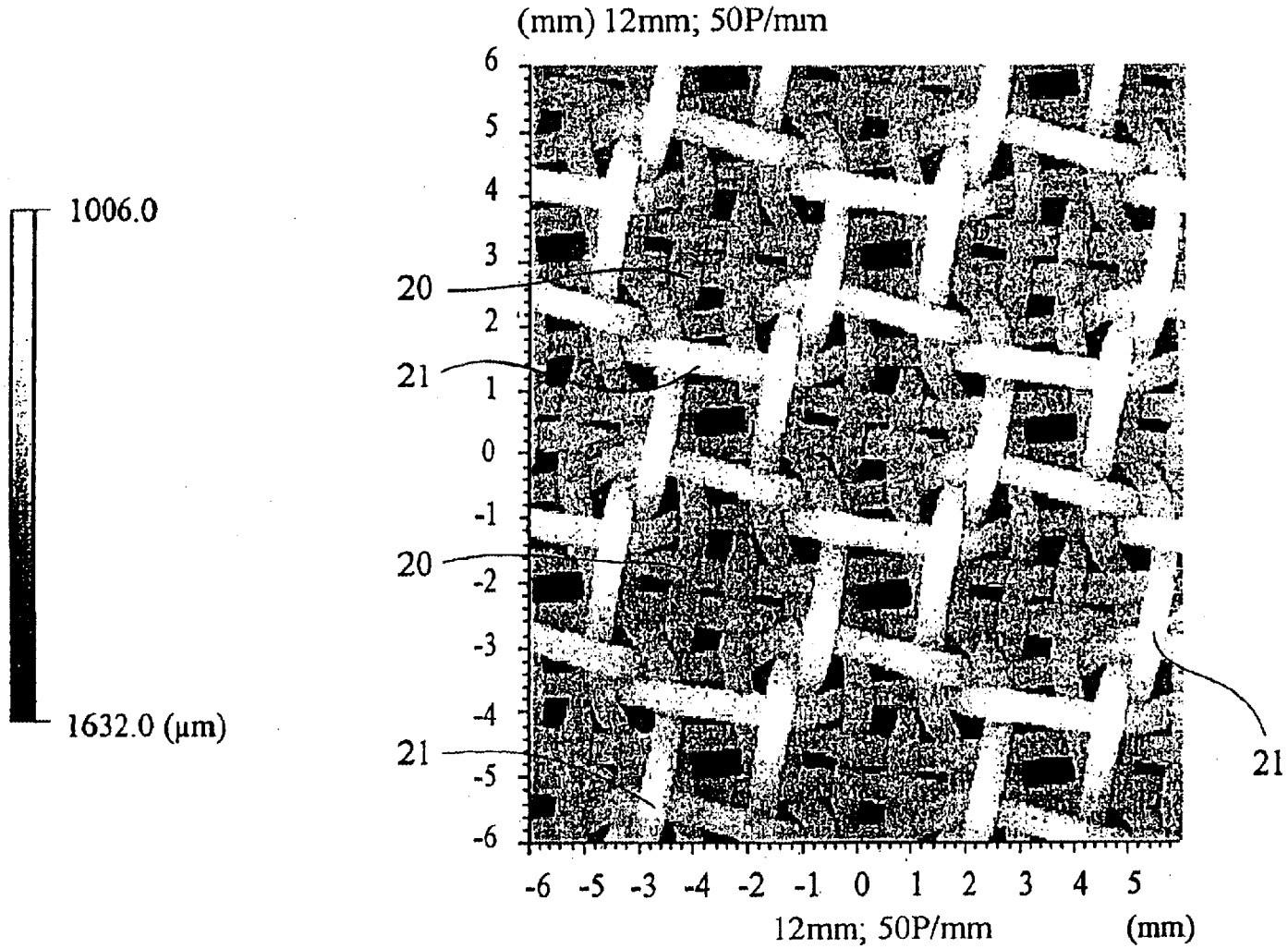
Figure 5:
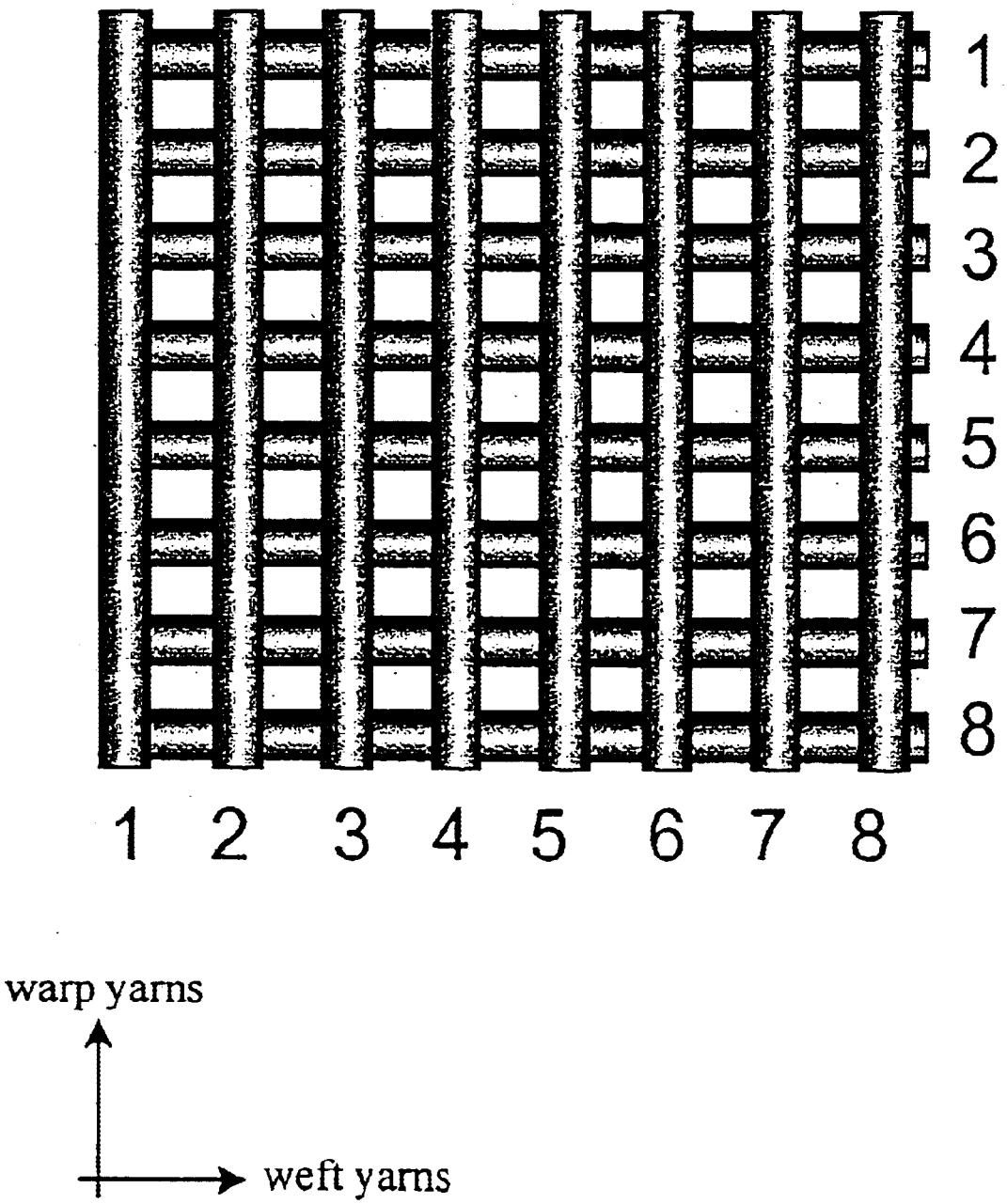
Figure 6:
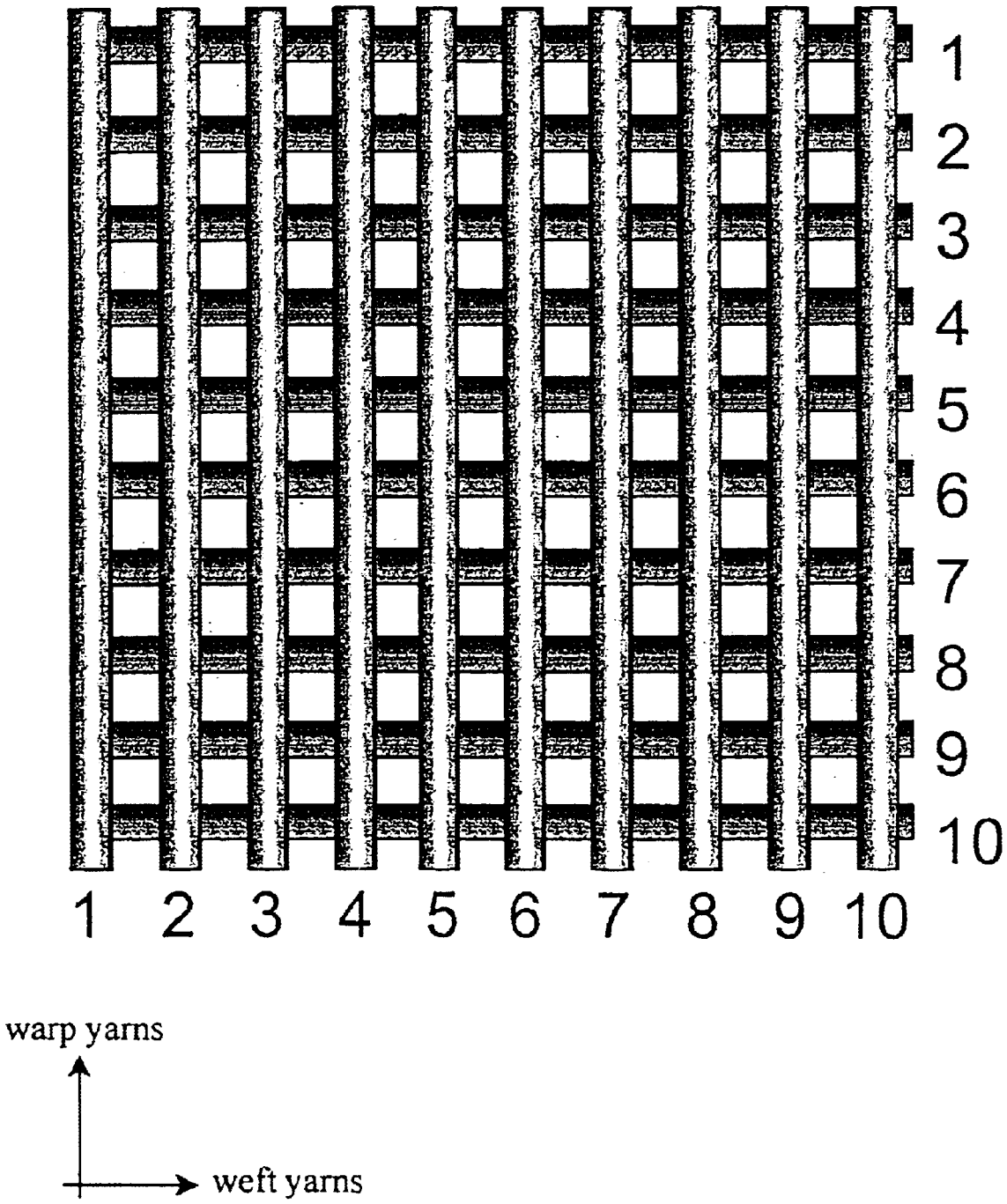
Figure 7:
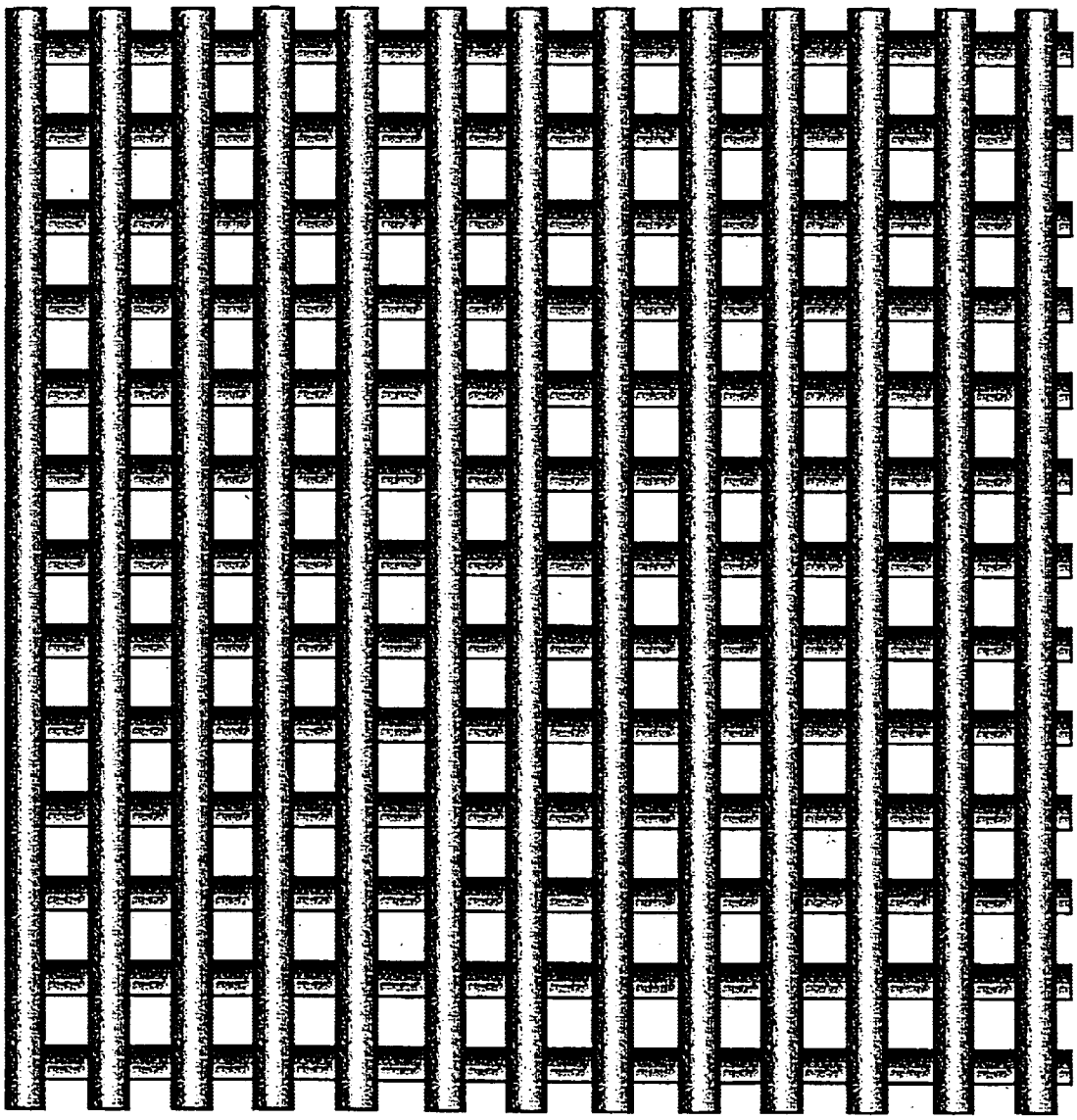

Examples of embodiments of the invention are shown in the drawings. They show:

FIG. 1 a schematic plan view of the top, i.e. the paper contact side of an example of an embodiment of the paper making machine fabric in accordance with the invention;

FIG. 2 a similar schematic plan view as in FIG. 1;

FIG. 2*a* a schematic sectional view in the direction of line A in FIG. 2;

FIG. 2*b* a schematic sectional view in the direction of line B in FIG. 2;

FIG. 2*c* a schematic sectional view in the direction of line C in FIG. 2;

FIG. 2*d* a schematic sectional view in the direction of line D in FIG. 2;

FIG. 3 a schematic plan view of the t op of the paper making machine fabric of FIG. 1, but over a larger sectional area;

FIG. 4 a plan view of the paper making machine fabric of FIG. 1 but of the real paper making machine fabric, however on an enlarged scale;

FIGS. 5 to 48 a schematic plan view of paper making machine fabrics, as further embodiments of the invention, of which FIGS. 5, 6 and 7 show the respective basic pattern.

Figure 49:
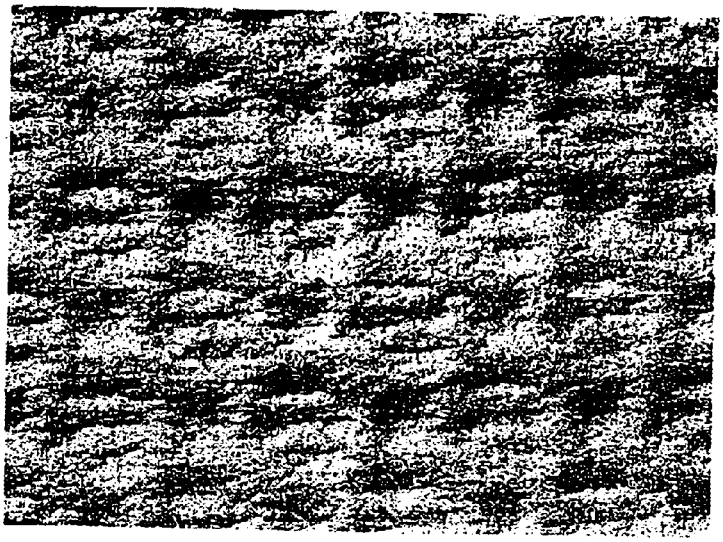
Figure 50:
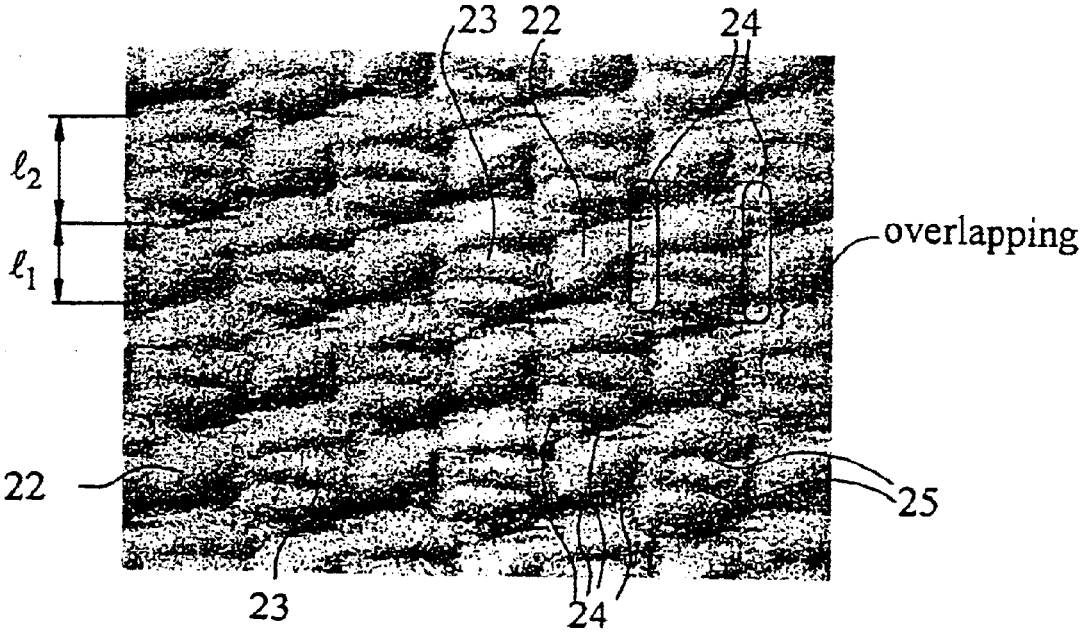

FIG. 49 a view of an inventive paper product from the side of the Yankee cylinder;

FIG. 50 a view of the same product from the opposite side; and

Figure 51:
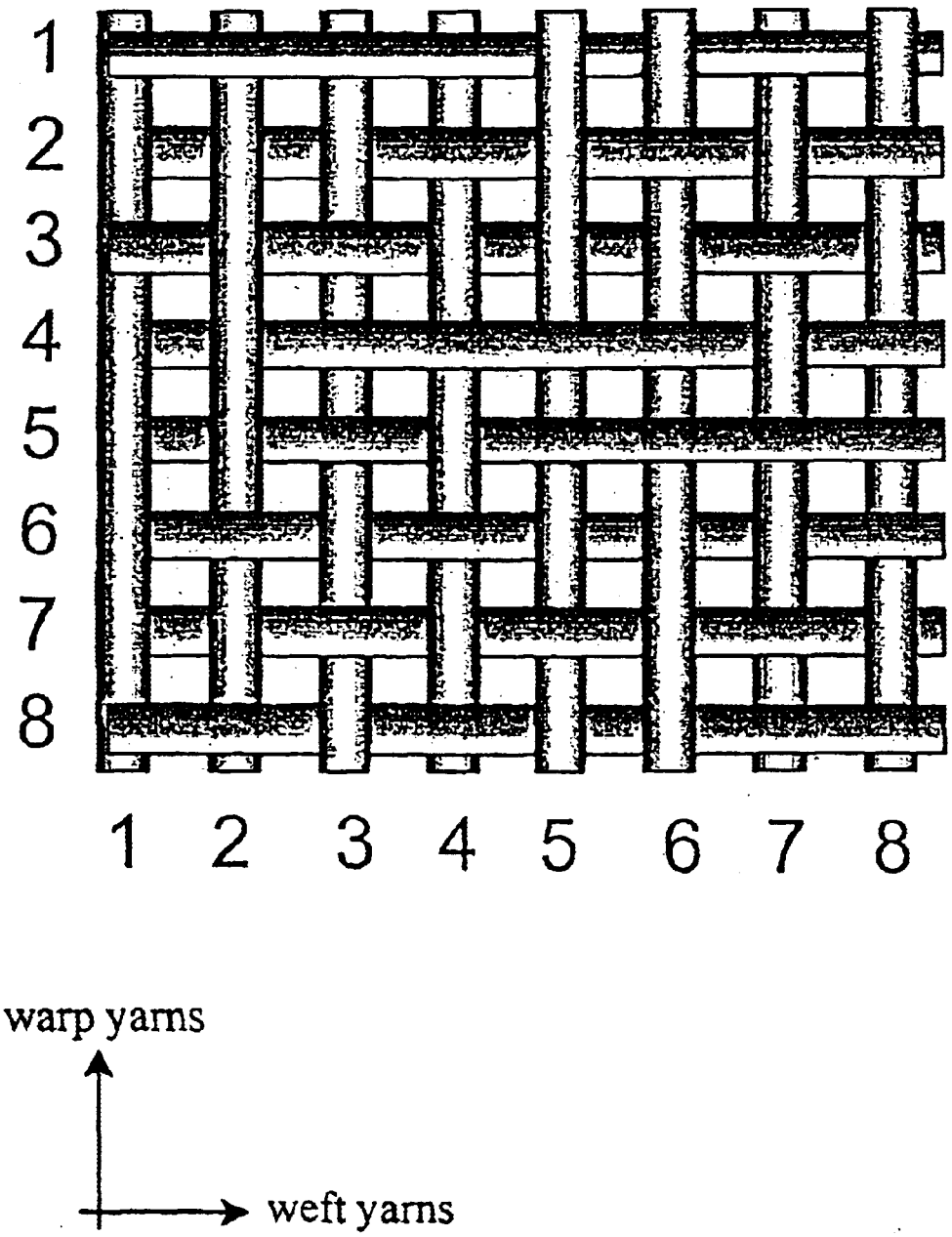

FIG. 51 a schematic plan view of a further embodiment of paper making machine fabrics All the Figures are enlargements by comparison with the embodiment in practice.

DESCRIPTION OF THE EXAMPLES OF EMBODIMENTS OF THE INVENTION

FIG. 1 shows schematically a paper making machine fabric, seen from the top, i.e. on the contact side of the paper sheet. It shows an area of eight weft yarns SF1 to SF8 and eight warp yarns KF1 to KF8 for the production of a complete pattern which repeats itself. Against the linen weave which is the simplest weave structure, in which the warp yarns are alternately above (cross over) and/or below (cross under) the weft yarn, and/or the weft yarns are alternately above or below the warp yarn, a cross under is replaced by a cross over in the weave pattern of FIG. 1 both in the case of the warp yarns as well as of the weft yarns at each eighth intersection. These intersection points are marked for the weft yarns by a "S" and for the warp yarns by a "I". The corresponding weft yarns at the points marked "S" will below be described as an upper yarn weft and at the points marked "I" as under yarn weft, because there it is located below at least three warp yarns. Correspondingly at the points marked "I" the corresponding warp yarn will be described as the upper yarn chain and at the points marked "S" as the under yarn chain.

The upper yarns in the case of both warp and weft yarns form the actual support area of the fabric (the side contacting the paper). In the case of warp and weft yarns, the under yarns form the lower level of the fabric. As is shown in FIGS. 2, 3, 5 and 6 the upper yarns can also be ground in part in planar form to form the support plane, as is already known in connection with other paper making machine fabrics.

In the example of an embodiment in accordance with FIG. 1, eight weft yarns and eight warp yarns are required to produce a complete repetition of the pattern.

Weft yarn 1 is above warp yarns 1; 3; 5 to 7, and below warp yarns 2; 4; 8.

Weft yarn 2 is above warp yarns 8; 1 to 2; 4; 6, and below warp yarns 3; 5; 7.

Weft yarn 3 is above warp yarns 1; 5; 7, and below warp yarns 2 to 4; 6; 8.

Weft yarn 4 is above warp yarns 2; 4; 6 and below warp yarns 3; 5; 7 to 8; 1.

Weft yarn 5 is above warp yarns 1 to 3; 5; 7, and below warp yarns 4; 6; 8.

Weft yarn 6 is above warp yarns 2; 4 to 6; 8, and below warp yarns 1; 3; 7.

Weft yarn 7 is above warp yarns 1; 3; 5, and below warp yarns 2; 4; 6 to 8.

Weft yarn 8 is above warp yarns 2; 6; 8 and below warp yarns 1; 3 to 5; 7.

When in FIG. 1 the weft yarns 5 and 6 are observed, the two intersection points which are marked there as "S" are offset by three warp yarns.

As can be seen from FIG. 2, a pair of adjacent under yarns in the weft and/or warp direction is associated with a pair of upper yarns in the weft or warp direction. The cross-section of the fabric can also be more clearly inferred with respect to the third dimension from FIGS. 2*a* and 2*d*. Due to the constellation described above, from the enlarged surface section in FIG. 3 relatively deep recesses (or small pockets) 20 result which provide the papers which are produced by this screen, in particular in the TAD zone, with a larger third dimension. Still more clearly recognizable are the bulges from FIG. 4 in the actual paper making machine fabric. In addition the ground upper yarns which have the reference numeral 21 are also discernible.

Further example of embodiments are shown in FIGS. 5 to 48. The type designation and the woven pattern description follow from the drawings.

Figure 8:
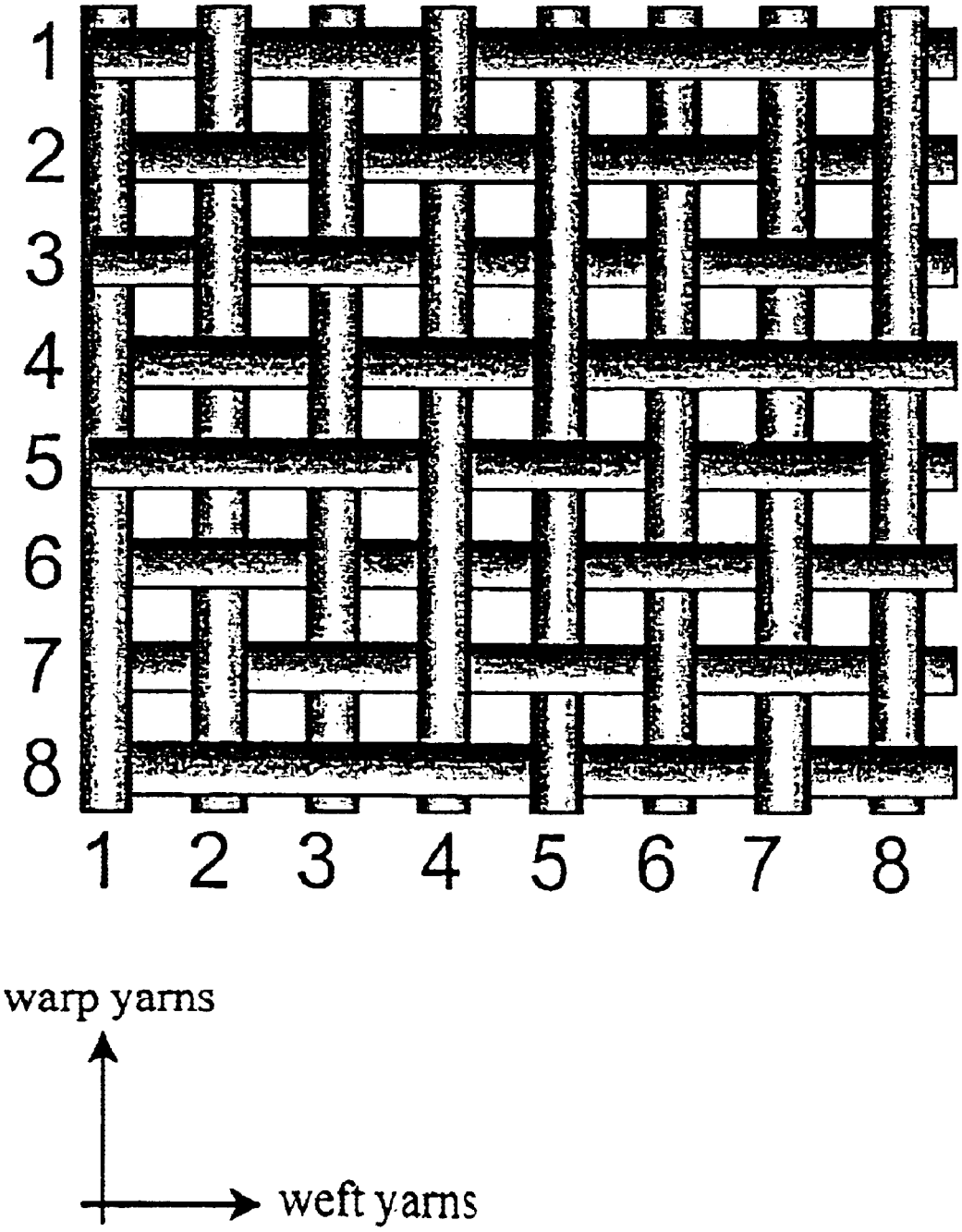

The example of an embodiment in accordance with FIG. 8 requires for a pattern which is complete and repeatable eight weft yarns and eight warp yarns. Two types of weft yarns are present. The weft yarns 1, 4, 5 and 8 form a first type and the weft yarns 2, 3, 6 and 7 form the second type.

Weft yarn 1 is above warp yarns 1; 3; 5 to 7, and below warp yarns 2; 4; 8.

Weft yarn 2 is above warp yarns 2; 4; 6, and below warp yarns 1; 3; 5; 7 to 8.

Weft yarn 3 is above warp yarns 1; 3; 7, and below warp yarns 2; 4 to 6; 8.

Weft yarn 4 is above warp yarns 2; 4; 6 to 8 and below warp yarns 1; 3; 5.

Weft yarn 5 is above warp yarns 1 to 3; 5; 7, and below warp yarns 4; 6; 8.

Weft yarn 6 is above warp yarns 2; 6; 8, and below warp yarns 1; 3 to 5; 7.

Weft yarn 7 is above warp yarns 3; 5; 7, and below warp yarns 1 to 2; 4; 6; 8.

Weft yarn 8 is above warp yarns 2 to 4; 6; 8 and below warp yarns 1; 5; 7.

Figure 9:
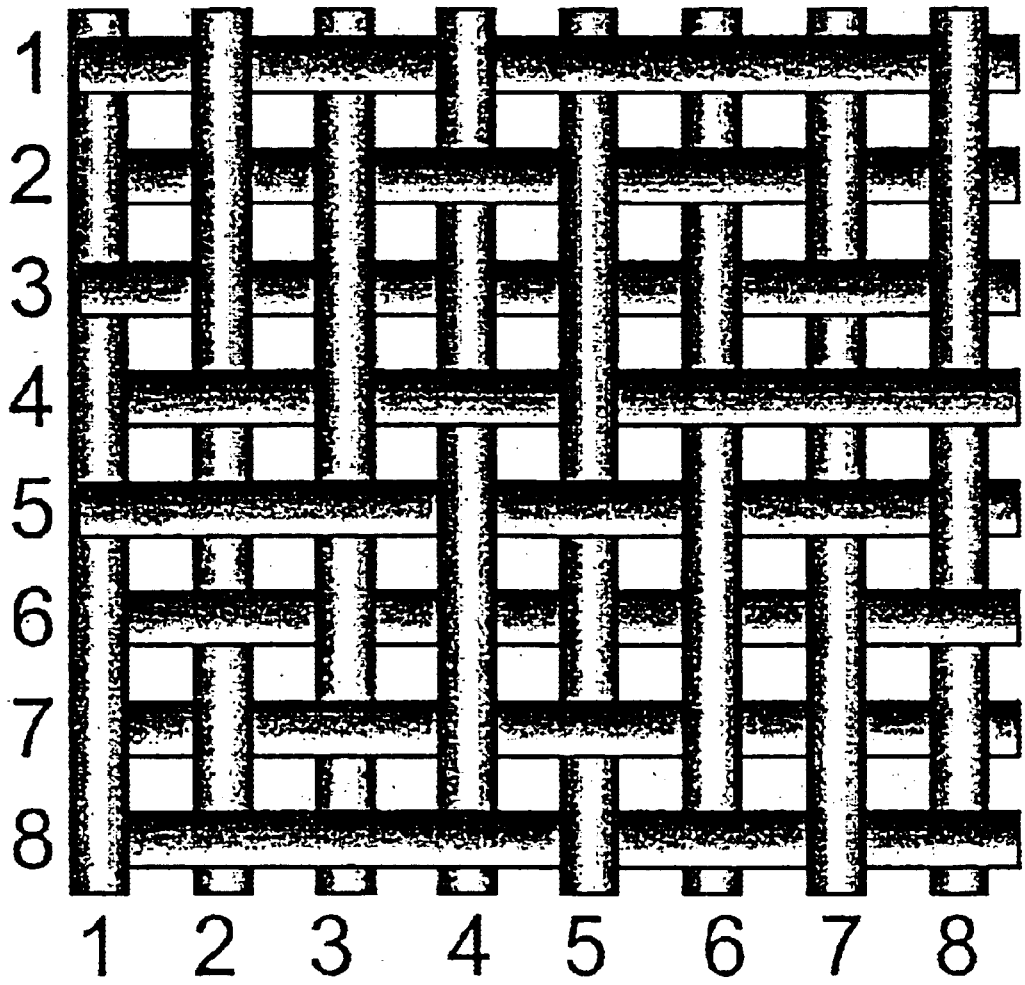
Figure 9:
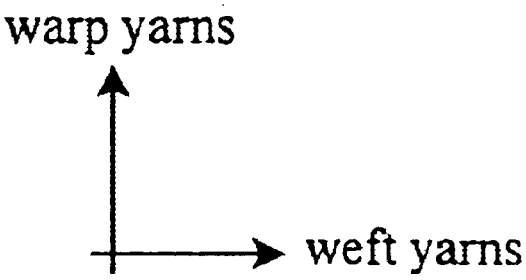

The example of an embodiment in accordance with FIG. 9 requires for a complete pattern which can be repeated eight weft yarns and eight warp yarns. Two types of weft yarns are present. The weft yarns 1, 4, 5 and 8 form a first type and the weft yarns 2, 3, 6 and 7 form the second type.

Weft yarn 1 is above warp yarns 1; 3; 5 to 7, and below warp yarns 2; 4; 8.

Weft yarn 2 is above warp yarns 4; 6, and below warp yarns 1 to 3; 5; 7 to 8.

Weft yarn 3 is above warp yarns 1; 7, and below warp yarns 2 to 6; 8.

Weft yarn 4 is above warp yarns 2; 4; 6 to 8 and below warp yarns 1; 3; 5.

Weft yarn 5 is above warp yarns 1 to 3; 5; 7, and below warp yarns 4; 6; 8.

Weft yarn 6 is above warp yarns 2; 8, and below warp yarns 1; 3 to 7.

Weft yarn 7 is above warp yarns 3; 5, and below warp yarns 1 to 2; 4; 6 to 8.

Weft yarn 8 is above warp yarns 2 to 4; 6; 8 and below warp yarns 1; 5; 7.

Figure 10:
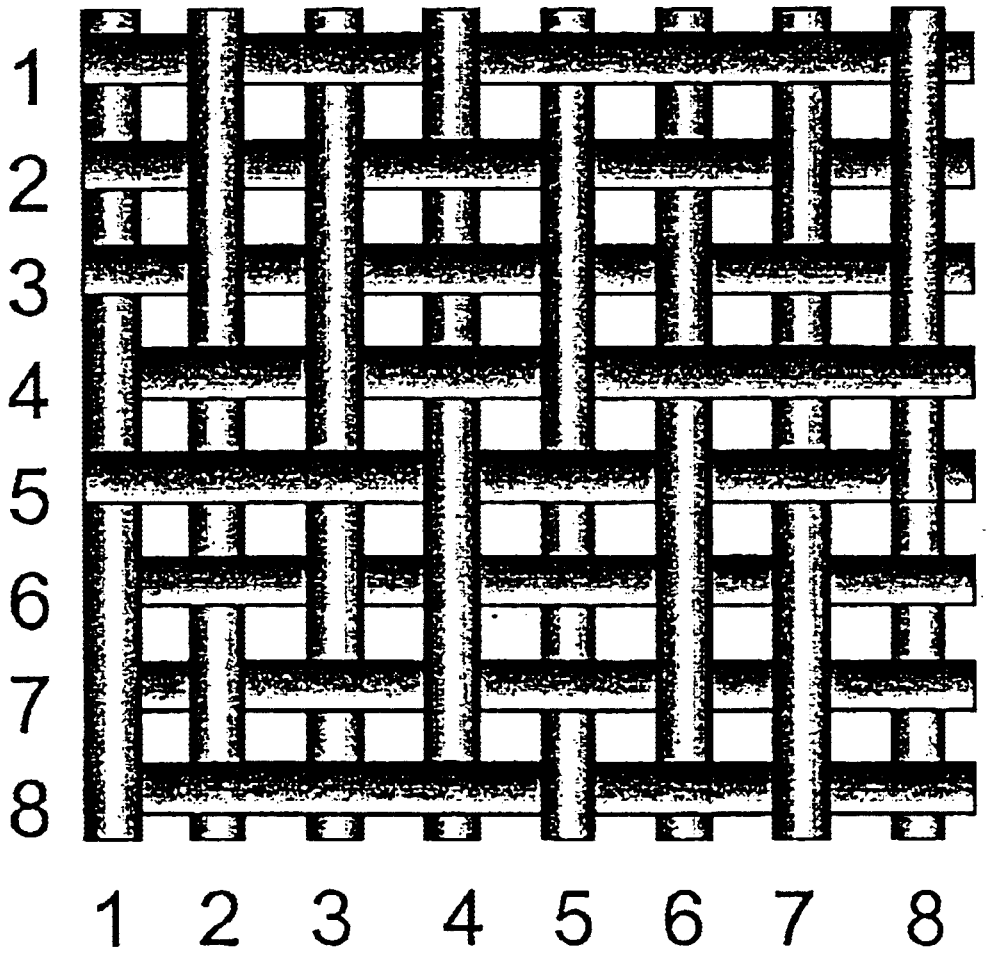
Figure 10:
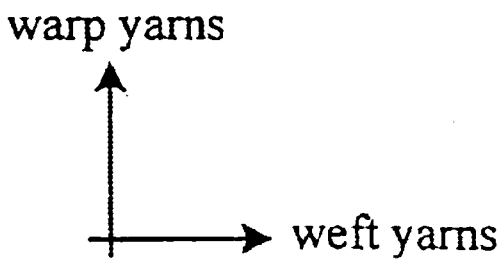

The example of an embodiment in accordance with FIG. 10 requires for a complete pattern which can be repeated eight weft yarns and eight warp yarns. Two types of weft yarns are present. The weft yarns 1, 4, 5 and 8 form a first type and the weft yarns 2, 3, 6 and 7 form the second type.

Weft yarn 1 is above warp yarns 1; 3; 5 to 7, and below warp yarns 2; 4; 8.

Weft yarn 2 is above warp yarns 1; 4; 6, and below warp yarns 2 to 3; 5; 7 to 8.

Weft yarn 3 is above warp yarns 1; 4; 7, and below warp yarns 2 to 3; 5 to 6; 8.

Weft yarn 4 is above warp yarns 2; 4; 6 to 8 and below warp yarns 1; 3; 5.

Weft yarn 5 is above warp yarns 1 to 3; 5; 7, and below warp yarns 4; 6; 8.

Weft yarn 6 is above warp yarns 2; 5; 8, and below warp yarns 1; 3 to 4; 6 to 7.

Weft yarn 7 is above warp yarns 3; 5; 8, and below warp yarns 1 to 2; 4; 6 to 7.

Weft yarn 8 is above warp yarns 2 to 4; 6; 8 and below warp yarns 1; 5; 7.

Figure 11:
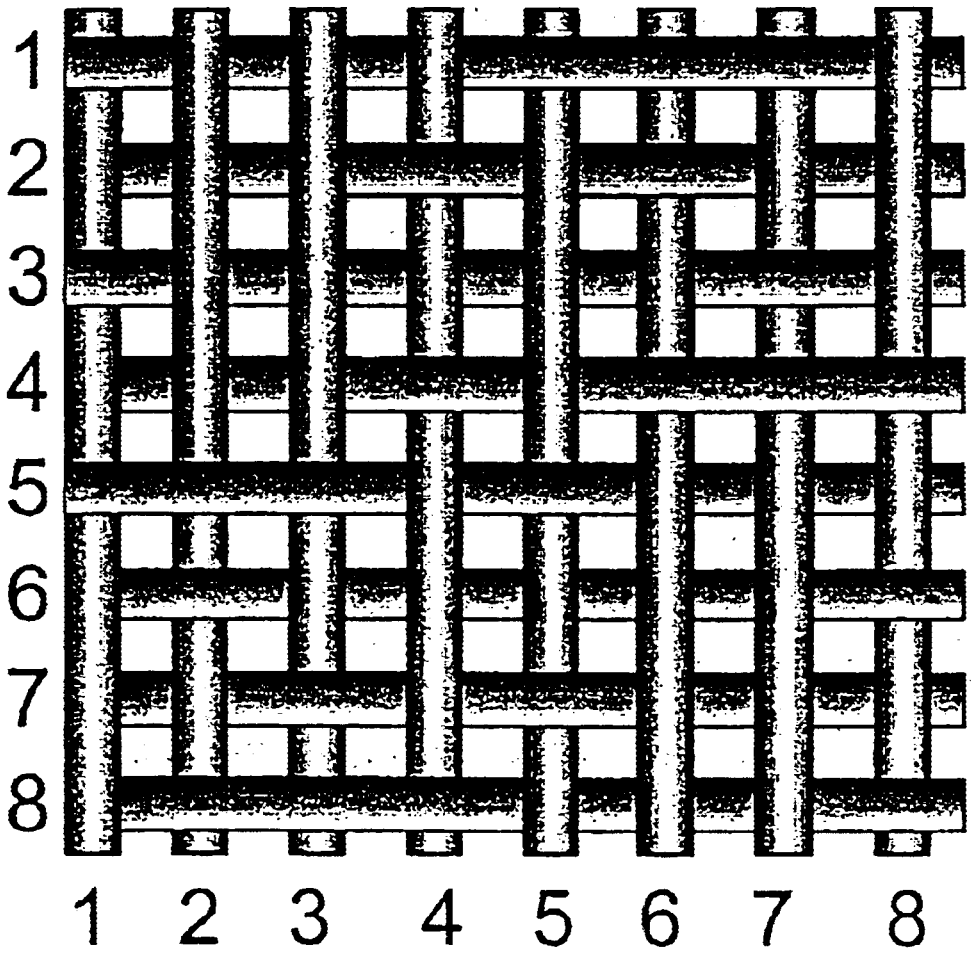
Figure 11:
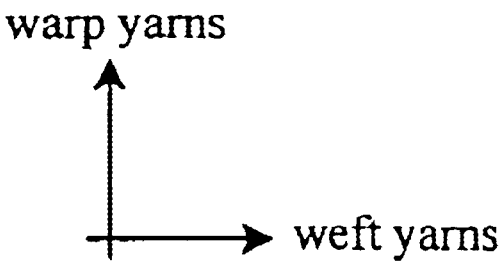

The example of an embodiment in accordance with FIG. 11 requires for a complete pattern which can be repeated eight weft yarns and eight warp yarns. There are three types of weft yarns present. The weft yarns 1 and 5 form a first type, weft yarns 2, 3, 6 and 7 form a second type and the weft yarns 4 and 8 form a third type.

Weft yarn 1 is above warp yarns 1; 5 to 7, and below warp yarns 2 to 4; 8.

Weft yarn 2 is above warp yarns 4; 6, and below warp yarns 1 to 3; 5; 7 to 8.

Weft yarn 3 is above warp yarns 1; 7, and below warp yarns 2 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 8, and below warp yarns 1; 3 to 7.

Weft yarn 7 is above warp yarns 3; 5, and below warp yarns 1 to 2; 4; 6 to 8.

Weft yarn 8 is above warp yarns 2 to 4; 8, and below warp yarns 1; 5 to 7.

Figure 12:
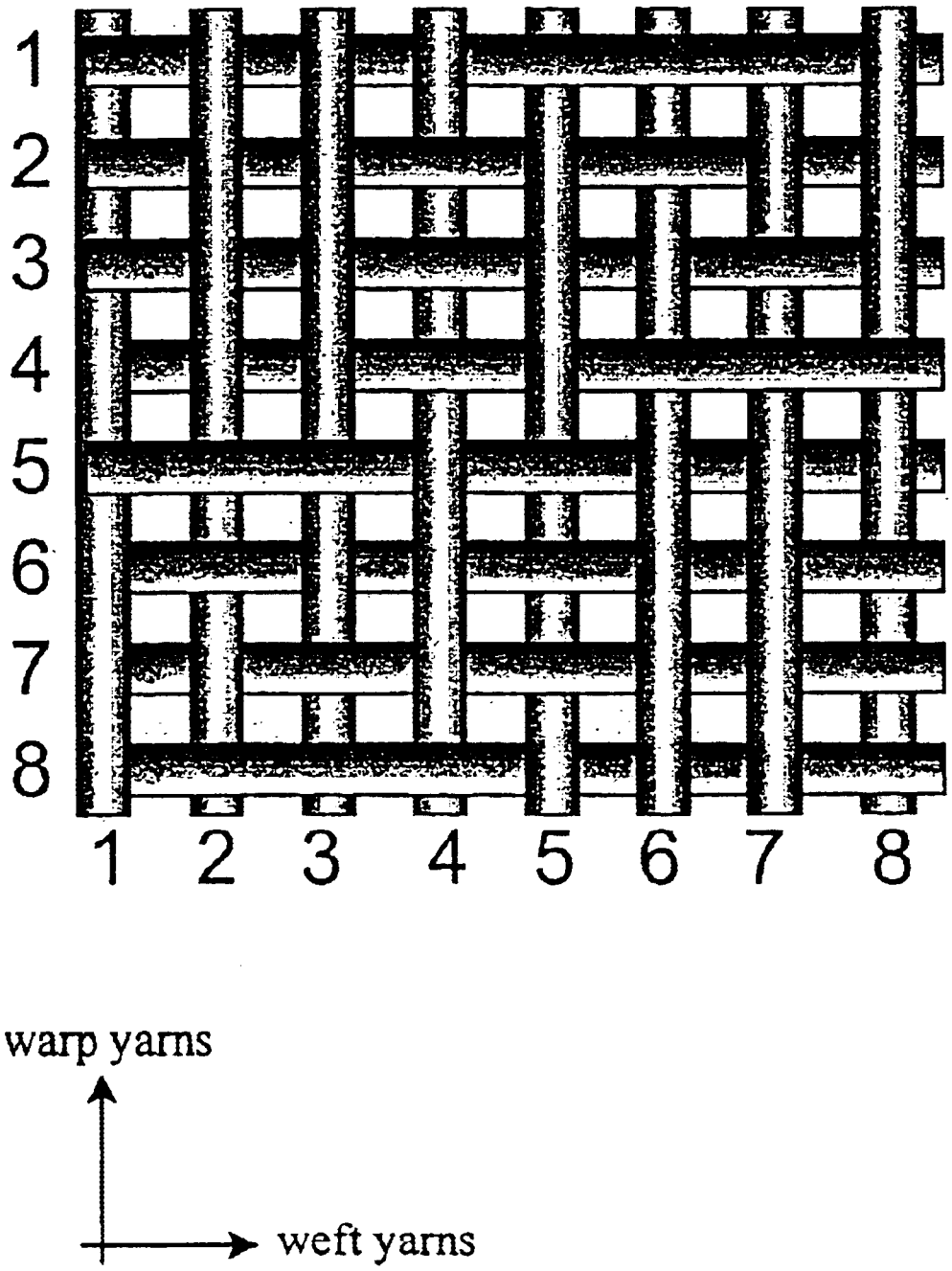

The example of an embodiment in accordance with FIG. 12 requires for a complete pattern which can be repeated eight weft yarns and eight warp yarns. There are three types of weft yarns present. The weft yarns 1 and 5 form a first type, weft yarns 2, 3, 6 and 7 form a second type and the weft yarns 4 and 8 form the third type.

Weft yarn 1 is above warp yarns 1; 5 to 7, and below warp yarns 2 to 4; 8.

Weft yarn 2 is above warp yarns 1; 4; 6, and below warp yarns 2 to 3; 5; 7 to 8.

Weft yarn 3 is above warp yarns 1; 4; 7, and below warp yarns 2 to 3; 5 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 5; 8, and below warp yarns 1; 3 to 4; 6 to 7.

Weft yarn 7 is above warp yarns 3; 5; 8, and below warp yarns 1 to 2; 4; 6 to 7.

Weft yarn 8 is above warp yarns 2 to 4; 8, and below warp yarns 1; 5 to 7.

Figure 13:
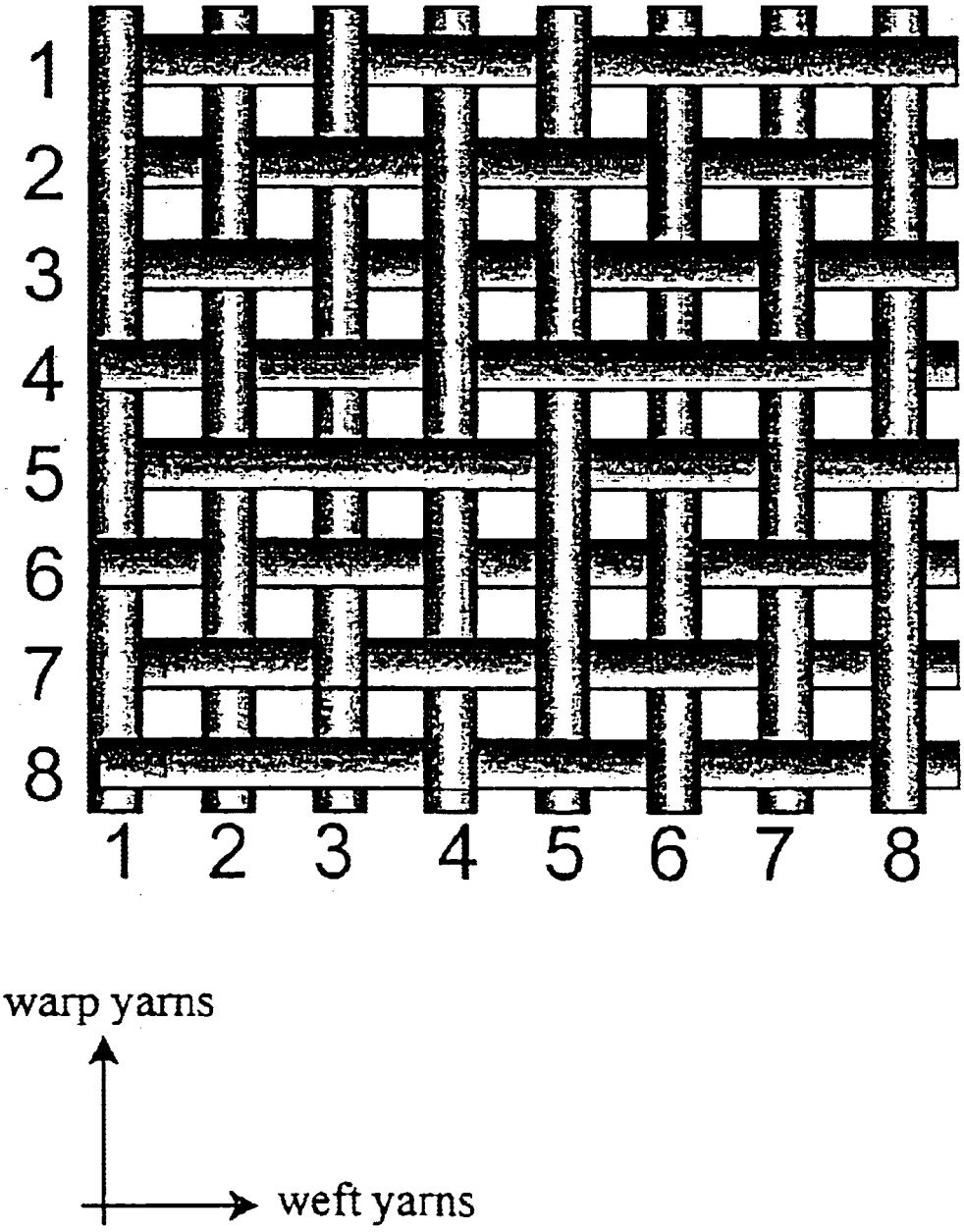

The example of an embodiment in accordance with FIG. 13 requires for a complete pattern which can be repeated eight weft yarns and eight warp yarns. Two types of weft yarns are present. The weft yarns 1, 4, 5 and 8 form a first type and the weft yarns 2, 3, 6 and 7 form a second type.

Weft yarn 1 is above warp yarns 2; 4; 6 to 8, and below warp yarns 1; 3; 5.

Weft yarn 2 is above warp yarns 3; 5; 7, and below warp yarns 1 to 2; 4; 6; 8.

Weft yarn 3 is above warp yarns 2; 6; 8, and below warp yarns 1; 3 to 5; 7.

Weft yarn 4 is above warp yarns 1; 3; 5 to 7, and below warp yarns 2; 4; 8.

Weft yarn 5 is above warp yarns 2 to 4; 6; 8, and below warp yarns 1; 5; 7.

Weft yarn 6 is above warp yarns 1; 3; 7, and below warp yarns 2; 4 to 6; 8.

Weft yarn 7 is above warp yarns 2; 4; 6, and below warp yarns 1; 3; 5; 7 to 8.

Weft yarn 8 is above warp yarns 1 to 3; 5; 7, and below warp yarns 4; 6; 8.

Figure 14:
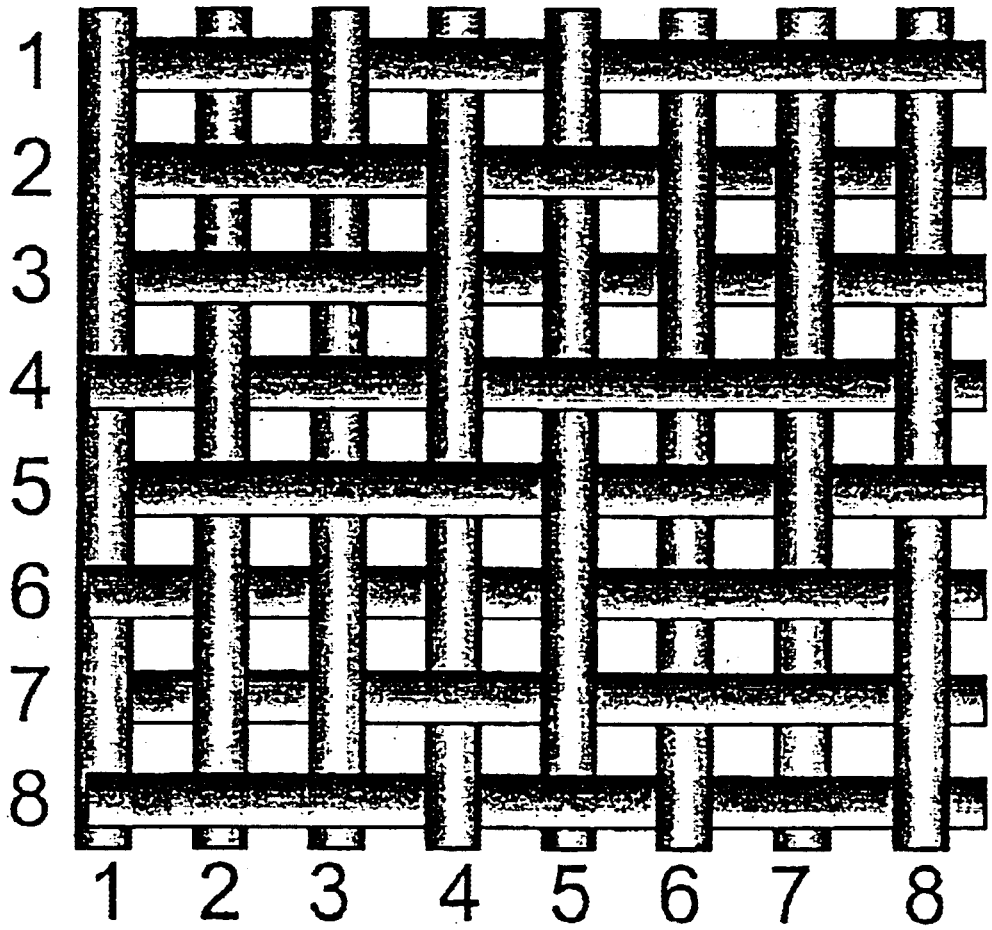
Figure 14:
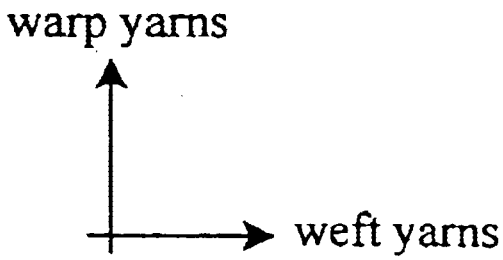

The example of an embodiment in accordance with FIG. 14 requires for a complete pattern which can be repeated eight weft yarns and eight warp yarns. There are three types of weft yarns present. The weft yarns 1, 4, 5 and 8 form a first type, weft yarns 2 and 6 form a second type and the weft yarns 3 and 7 form a third type.

Weft yarn 1 is above warp yarns 2; 4; 6 to 8, and below warp yarns 1; 3; 5.

Weft yarn 2 is above warp yarns 2 to 3; 5, and below warp yarns 1; 4; 6 to 8.

Weft yarn 3 is above warp yarns 2 to 3; 8, and below warp yarns 1; 4 to 7.

Weft yarn 4 is above warp yarns 1; 3; 5 to 7, and below warp yarns 2; 4; 8.

Weft yarn 5 is above warp yarns 2 to 4; 6; 8, and below warp yarns 1; 5; 7.

Weft yarn 6 is above warp yarns 1; 6 to 7, and below warp yarns 2 to 5; 8.

Weft yarn 7 is above warp yarns 4; 6 to 7, and below warp yarns 1 to 3; 5; 8.

Weft yarn 8 is above warp yarns 1 to 3; 5; 7, and below warp yarns 4; 6; 8.

Figure 15:
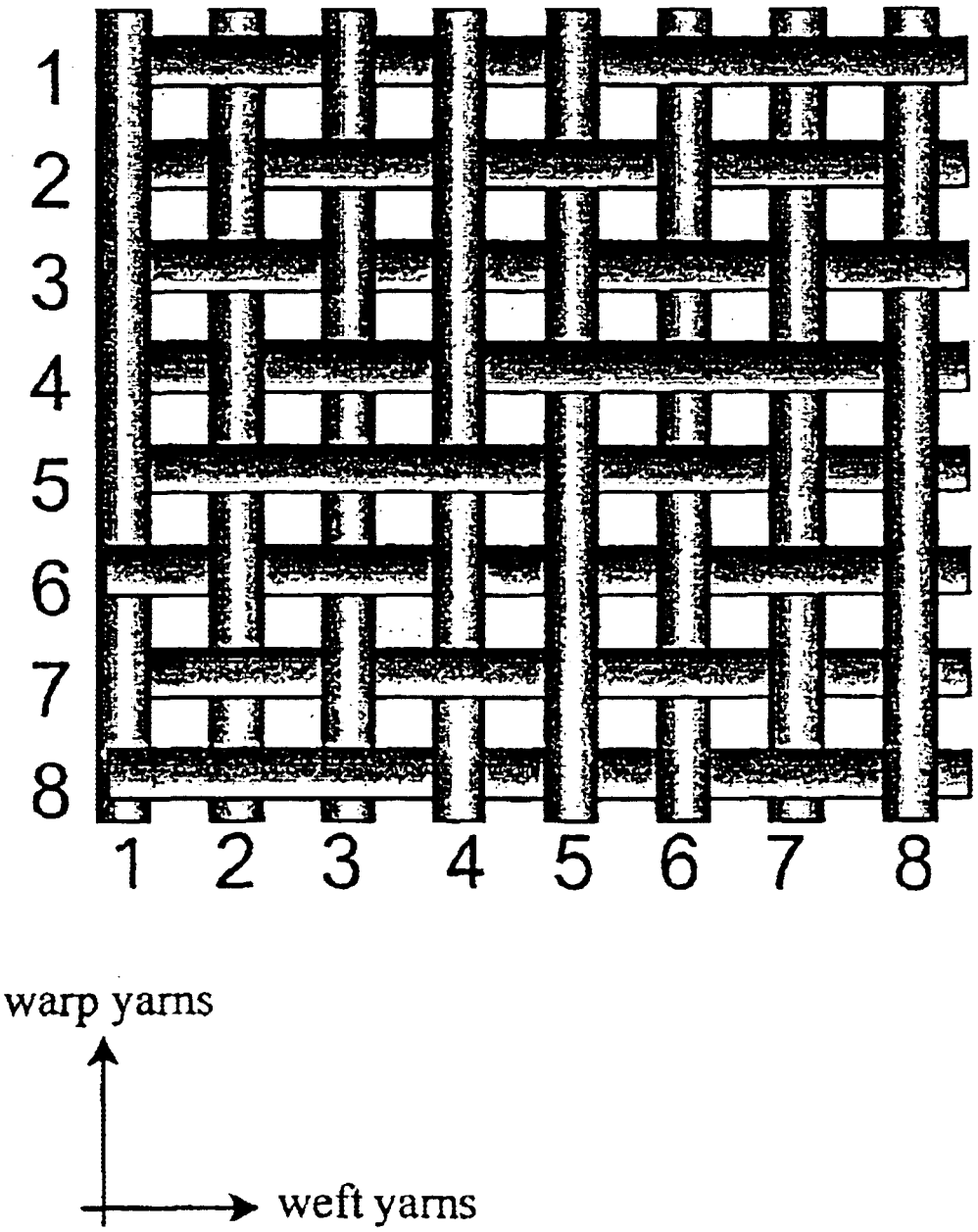

The example of an embodiment in accordance with FIG. 15 requires for a complete pattern which can be repeated eight weft yarns and eight warp yarns. There are three types of weft yarns present. The weft yarns 1 and 5 form a first type, weft yarns 2, 3, 6 and 7 form a second type and the weft yarns 4 and 8 form the third type.

Weft yarn 1 is above warp yarns 2; 6 to 8, and below warp yarns 1; 3 to 5.

Weft yarn 2 is above warp yarns 3; 5; 7, and below warp yarns 1 to 2; 4; 6; 8.

Weft yarn 3 is above warp yarns 2; 6; 8, and below warp yarns 1; 3 to 5; 7.

Weft yarn 4 is above warp yarns 3; 5 to 7, and below warp yarns 1 to 2; 4; 8.

Weft yarn 5 is above warp yarns 2 to 4; 6, and below warp yarns 1; 5; 7 to 8.

Weft yarn 6 is above warp yarns 1; 3; 7, and below warp yarns 2; 4 to 6; 8.

Weft yarn 7 is above warp yarns 2; 4; 6, and below warp yarns 1; 3; 5; 7 to 8.

Weft yarn 8 is above warp yarns 1 to 3; 7, and below warp yarns 4 to 6; 8.

Figure 16:
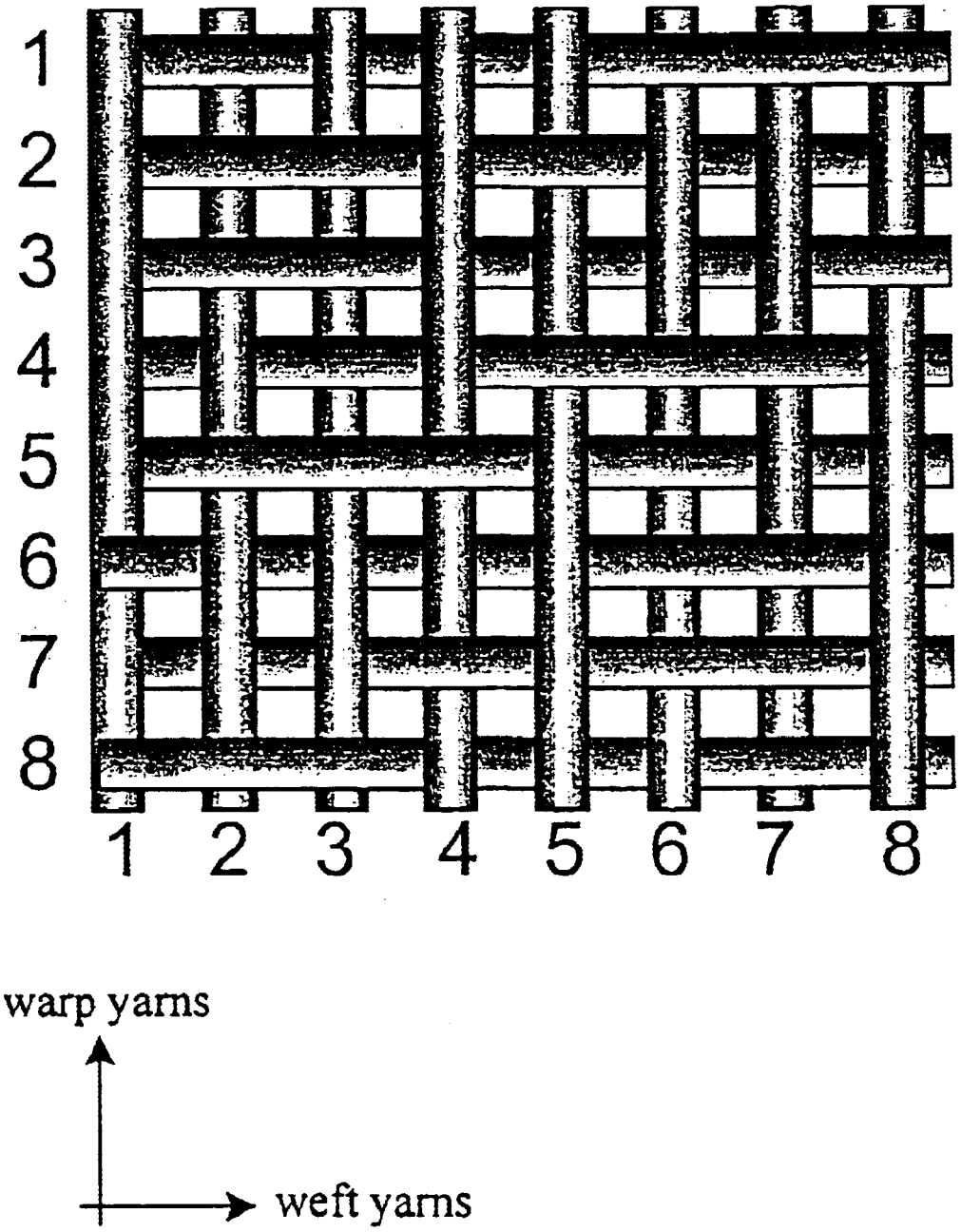

The example of an embodiment in accordance with FIG. 16 requires for a complete pattern which can be repeated eight weft yarns and eight warp yarns. Four types of weft yarns are present. The weft yarns 1 and 5 form a first type, weft yarns 2 and 6 form a second type, the weft yarns 3 and 7 form a third type and weft yarns 4 and 8 form a fourth type.

Weft yarn 1 is above warp yarns 2; 6 to 8, and below warp yarns 1; 3 to 5.

Weft yarn 2 is above warp yarns 2 to 3; 5, and below warp yarns 1; 4; 6 to 8.

Weft yarn 3 is above warp yarns 2; 3; 8, and below warp yarns 1; 4 to 7.

Weft yarn 4 is above warp yarns 3; 5 to 7, and below warp yarns 1 to 2; 4; 8.

Weft yarn 5 is above warp yarns 2 to 4; 6, and below warp yarns 1; 5; 7 to 8.

Weft yarn 6 is above warp yarns 1; 6 to 7, and below warp yarns 2 to 5; 8.

Weft yarn 7 is above warp yarns 4; 6 to 7, and below warp yarns 1 to 3; 5; 8.

Weft yarn 8 is above warp yarns 1 to 3; 7, and below warp yarns 4 to 6; 8.

Figure 17:
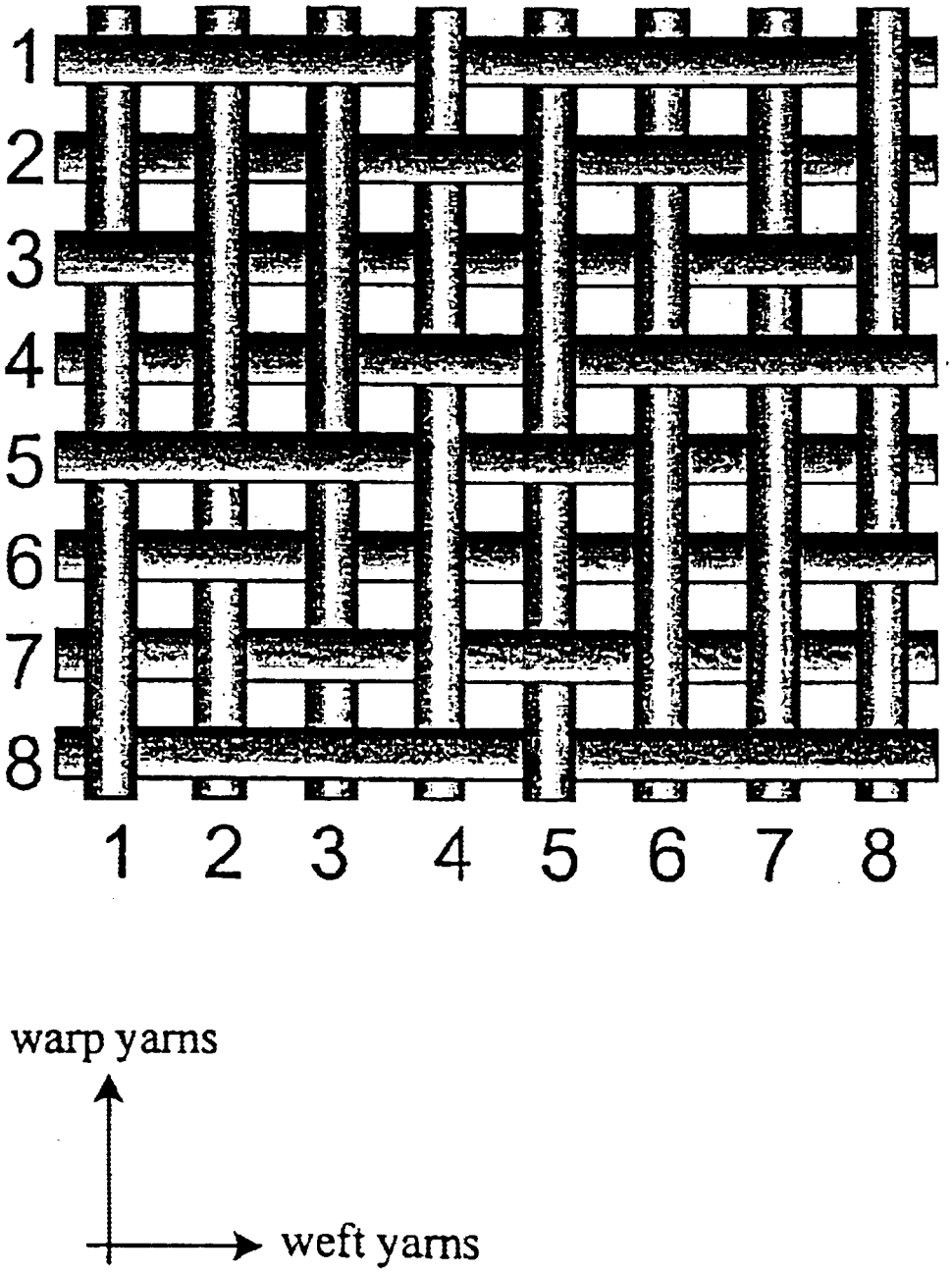

The example of an embodiment in accordance with FIG. 17 requires for a complete pattern which can be repeated eight weft yarns and eight warp yarns. There are three types of weft yarns present. The weft yarns 1 and 5 form a first type, weft yarns 4 and 8 form a second type and the weft yarns 2, 3, 6 and 7 form the third type.

Weft yarn 1 is above warp yarns 1 to 3; 5 to 7, and below warp yarns 4; 8.

Weft yarn 2 is above warp yarns 4; 6, and below warp yarns 1 to 3; 5; 7 to 8.

Weft yarn 3 is above warp yarns 1; 7, and below warp yarns 2 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 8, and below warp yarns 1; 3 to 7.

Weft yarn 7 is above warp yarns 3; 5, and below warp yarns 1 to 2; 4; 6 to 8.

Weft yarn 8 is above warp yarns 2 to 4; 6 to 8, and below warp yarns 1; 5.

Figure 18:
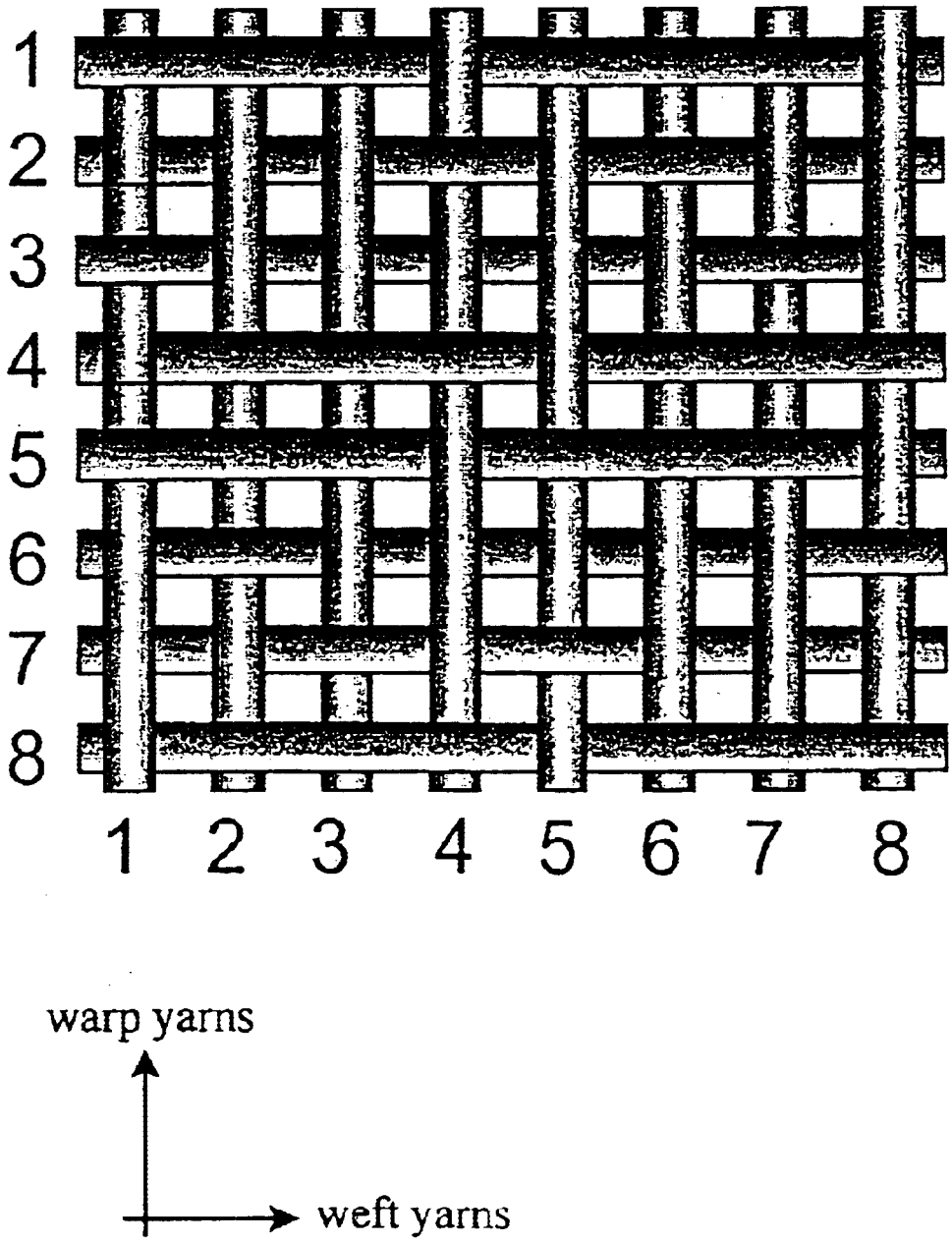

The example of an embodiment in accordance with FIG. 18 requires for a complete pattern which can be repeated eight weft yarns and eight warp yarns. Two types of weft yarns are present. The weft yarns 1, 4, 5 and 8 form a first type and the weft yarns 2, 3, 6 and 7 form the second type.

Weft yarn 1 is above warp yarns 1 to 3; 5 to 7, and below warp yarns 4; 8.

Weft yarn 2 is above warp yarns 4; 6, and below warp yarns 1 to 3; 5; 7 to 8.

Weft yarn 3 is above warp yarns 1; 7, and below warp yarns 2 to 6; 8.

Weft yarn 4 is above warp yarns 2 to 4; 6 to 8, and below warp yarns 1; 5.

Weft yarn 5 is above warp yarns 1 to 3; 5 to 7, and below warp yarns 4; 8.

Weft yarn 6 is above warp yarns 2; 8, and below warp yarns 1; 3 to 7.

Weft yarn 7 is above warp yarns 3; 5, and below warp yarns 1 to 2; 4; 6 to 8.

Weft yarn 8 is above warp yarns 2 to 4; 6 to 8, and below warp yarns 1; 5.

Figure 19:
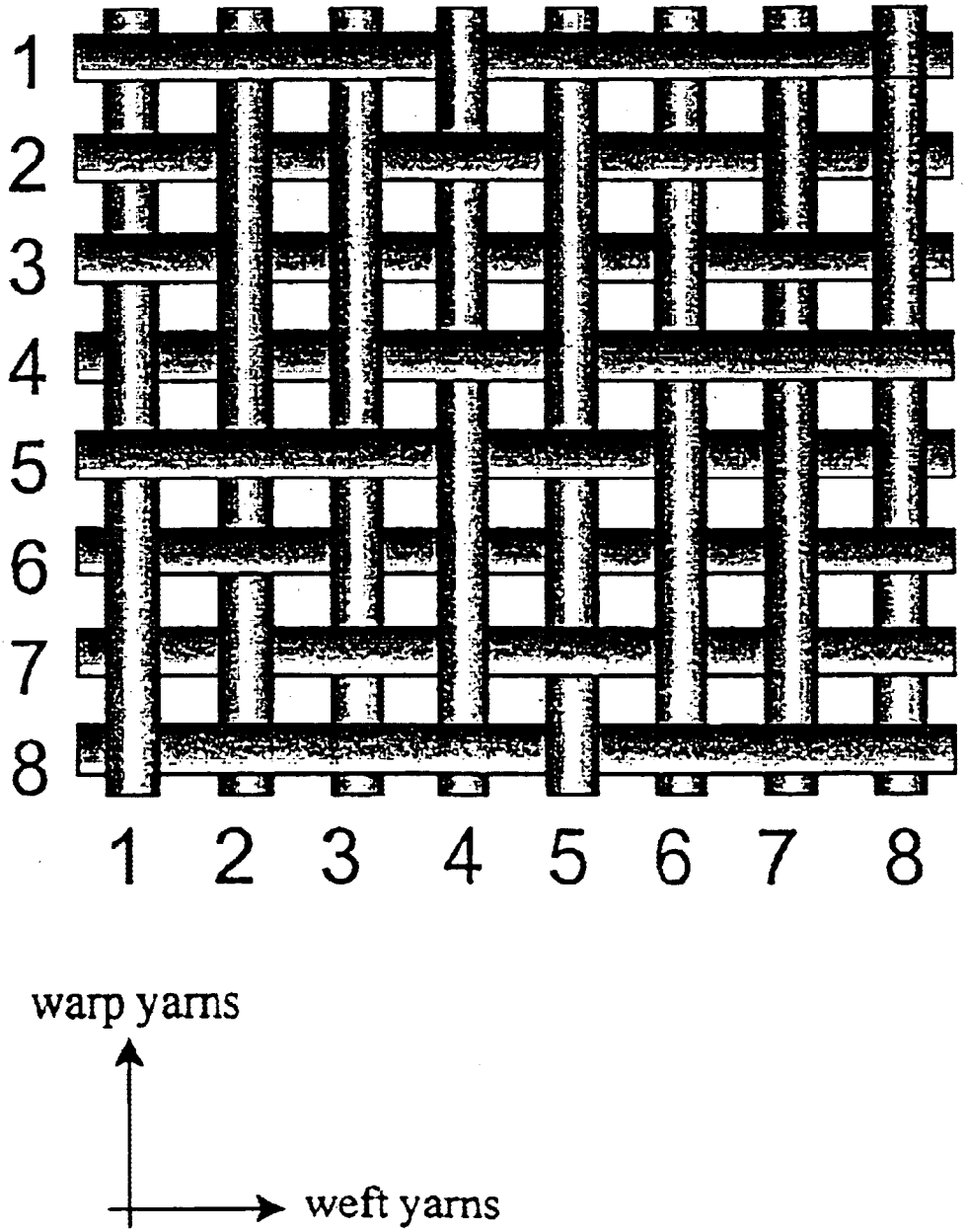

The example of an embodiment in accordance with FIG. 19 requires for a complete pattern which can be repeated eight weft yarns and eight warp yarns. Four types of weft yarns are present. The weft yarns 1 and 5 form a first type, the weft yarns 4 and 8 form a second type, the weft yarns 2 and 7 form a third type and the weft yarns 3 and 6 form the fourth type.

Weft yarn 1 is above warp yarns 1 to 3; 5 to 7, and below warp yarns 4; 8.

Weft yarn 2 is above warp yarns 1; 4; 6, and below warp yarns 2 to 3; 5; 7 to 8.

Weft yarn 3 is above warp yarns 1; 7, and below warp yarns 2 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 8, and below warp yarns 1; 3 to 7.

Weft yarn 7 is above warp yarns 3; 5; 8, and below warp yarns 1 to 2; 4; 6 to 7.

Weft yarn 8 is above warp yarns 2 to 4; 6 to 8, and below warp yarns 1; 5.

Figure 20:
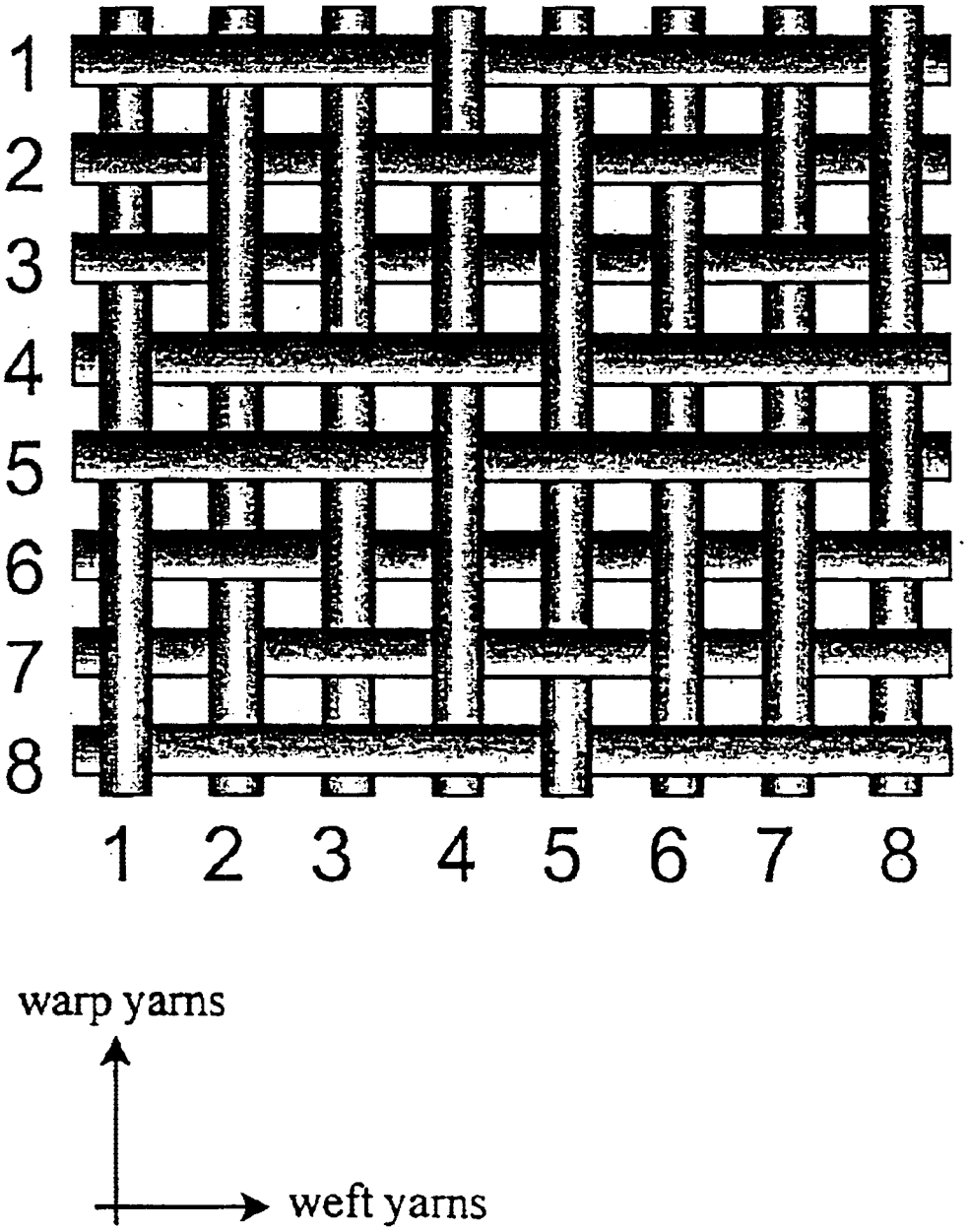

The example of an embodiment in accordance with FIG. 20 requires for a complete pattern which can be repeated eight weft yarns and eight warp yarns. Four types of weft yarns are present. The weft yarns 1 and 5 form a first type, weft yarns 4 and 8 form a second type, the weft yarns 2 and 7 form a third type and weft yarns 3 and 6 form a fourth type.

Weft yarn 1 is above warp yarns 1 to 3; 5 to 7, and below warp yarns 4; 8.

Weft yarn 2 is above warp yarns 1; 4; 6, and below warp yarns 2 to 3; 5; 7 to 8.

Weft yarn 3 is above warp yarns 1; 7, and below warp yarns 2 to 6; 8.

Weft yarn 4 is above warp yarns 2 to 4; 6 to 8, and below warp yarns 1; 5.

Weft yarn 5 is above warp yarns 1 to 3; 5 to 7, and below warp yarns 4; 8.

Weft yarn 6 is above warp yarns 2; 8, and below warp yarns 1; 3 to 7.

Weft yarn 7 is above warp yarns 3; 5; 8, and below warp yarns 1 to 2; 4; 6 to 7.

Weft yarn 8 is above warp yarns 2 to 4; 6 to 8, and below warp yarns 1; 5.

Figure 21:
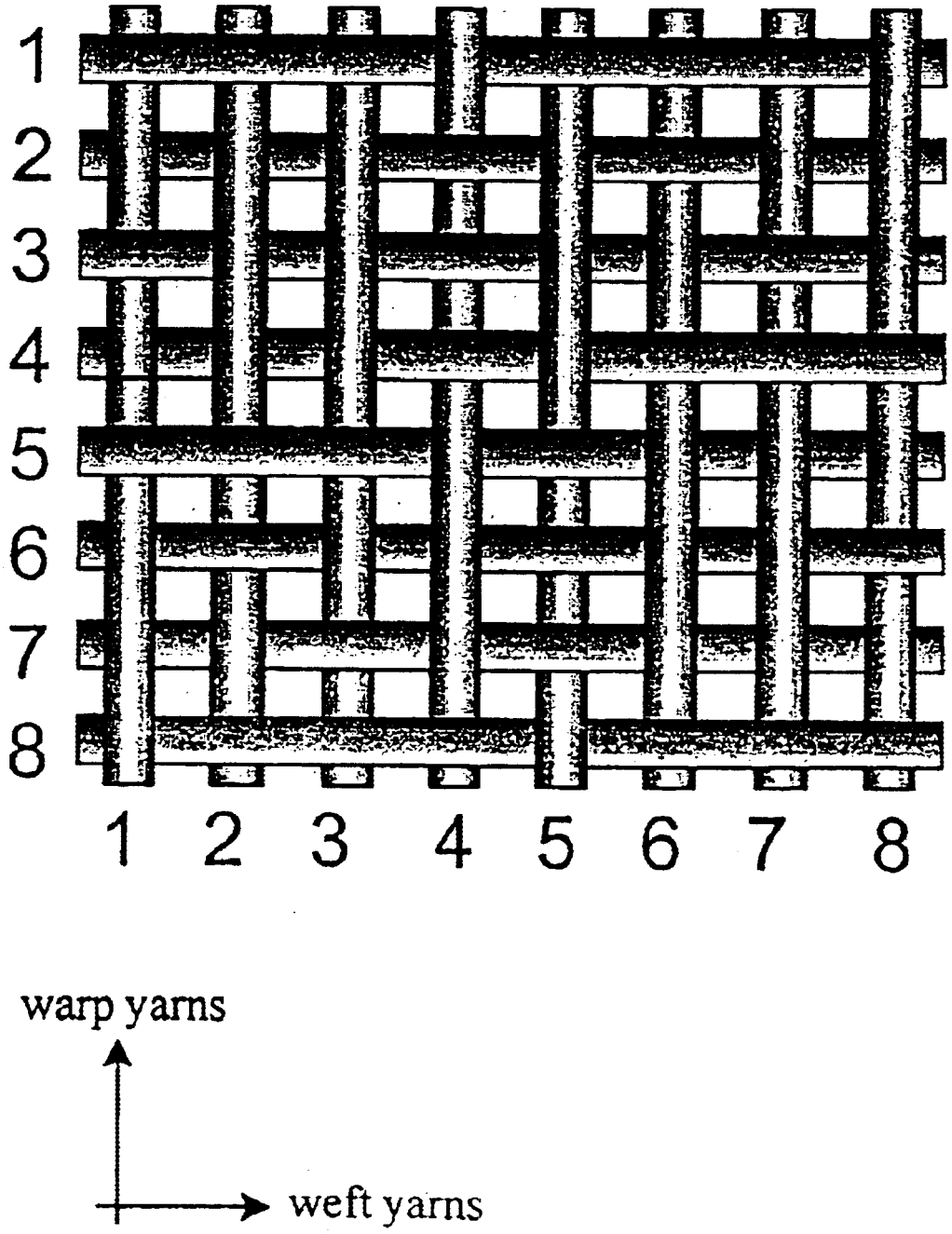

The example of an embodiment in accordance with FIG. 21 requires for a complete pattern which can be repeated eight weft yarns and eight warp yarns. Four types of weft yarns are present. The weft yarns 1 and 8 form a first type, weft yarns 4 and 5 form a second type, the weft yarns 2 and 7 form a third type and weft yarns 3 and 6 form a fourth type.

Weft yarn 1 is above warp yarns 1 to 3; 5 to 7, and below warp yarns 4; 8.

Weft yarn 2 is above warp yarns 4; 6, and below warp yarns 1 to 3; 5; 7 to 8.

Weft yarn 3 is above warp yarns 1; 4; 7, and below warp yarns 2 to 3; 5 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 5; 8, and below warp yarns 1; 3 to 4; 6 to 7.

Weft yarn 7 is above warp yarns 3; 5, and below warp yarns 1 to 2; 4; 6 to 8.

Weft yarn 8 is above warp yarns 2 to 4; 6 to 8, and below warp yarns 1; 5.

Figure 22:
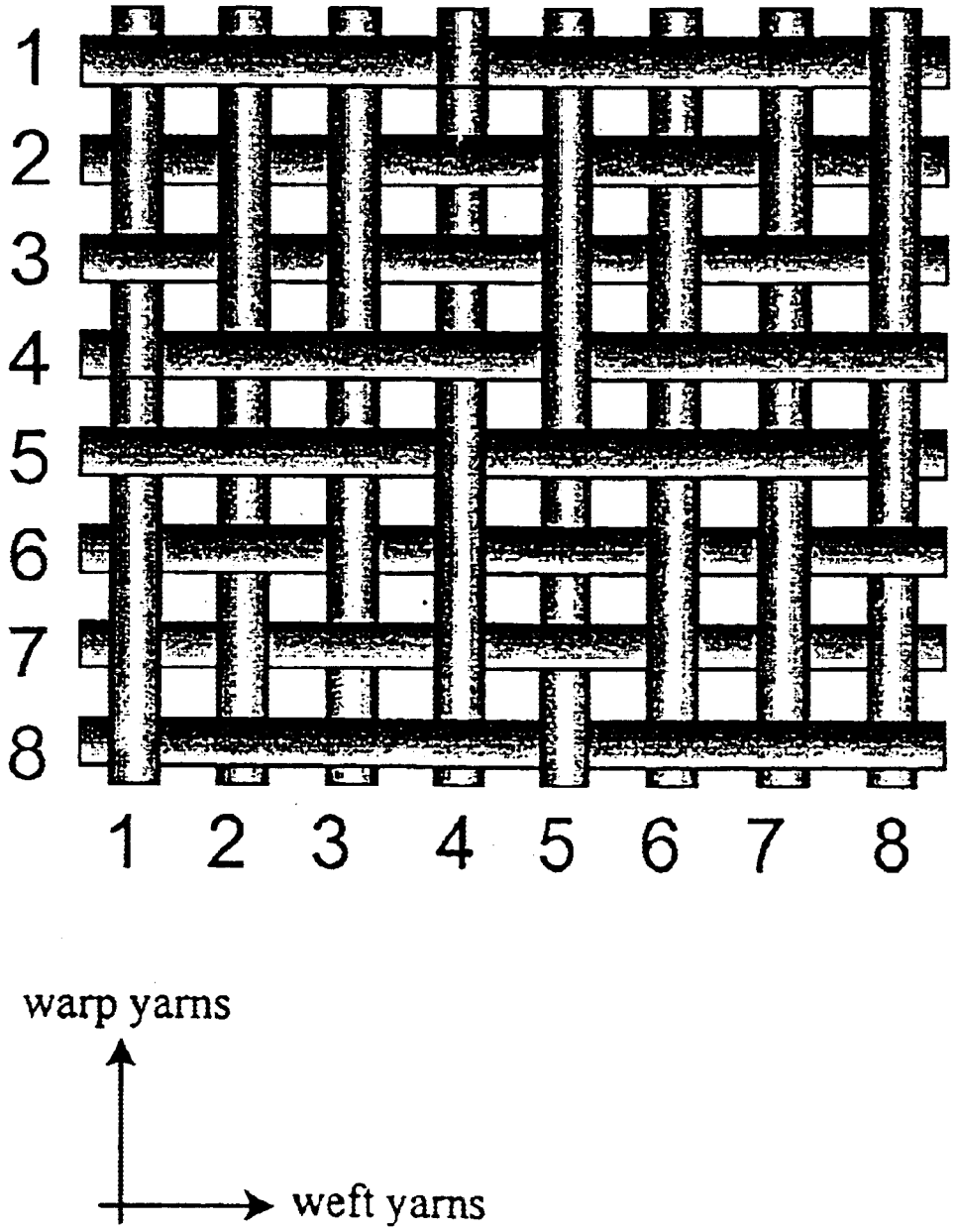

The example of an embodiment in accordance with FIG. 22 requires for a complete pattern which can be repeated eight weft yarns and eight warp yarns. Three types of weft yarns are present. The weft yarns 1, 4, 5 and 8 form a first type, weft yarns 2 and 7 form a second type and the weft yarns 3 and 6 form a third type.

Weft yarn 1 is above warp yarns 1 to 3; 5 to 7, and below warp yarns 4; 8.

Weft yarn 2 is above warp yarns 4; 6, and below warp yarns 1 to 3; 5; 7 to 8.

Weft yarn 3 is above warp yarns 1; 4; 7, and below warp yarns 2 to 3; 5 to 6; 8.

Weft yarn 4 is above warp yarns 2 to 4; 6 to 8, and below warp yarns 1; 5.

Weft yarn 5 is above warp yarns 1 to 3; 5 to 7, and below warp yarns 4; 8.

Weft yarn 6 is above warp yarns 2; 5; 8, and below warp yarns 1; 3 to 4; 6 to 7.

Weft yarn 7 is above warp yarns 3; 5, and below warp yarns 1 to 2; 4; 6 to 8.

Weft yarn 8 is above warp yarns 2 to 4; 6 to 8, and below warp yarns 1; 5.

Figure 23:
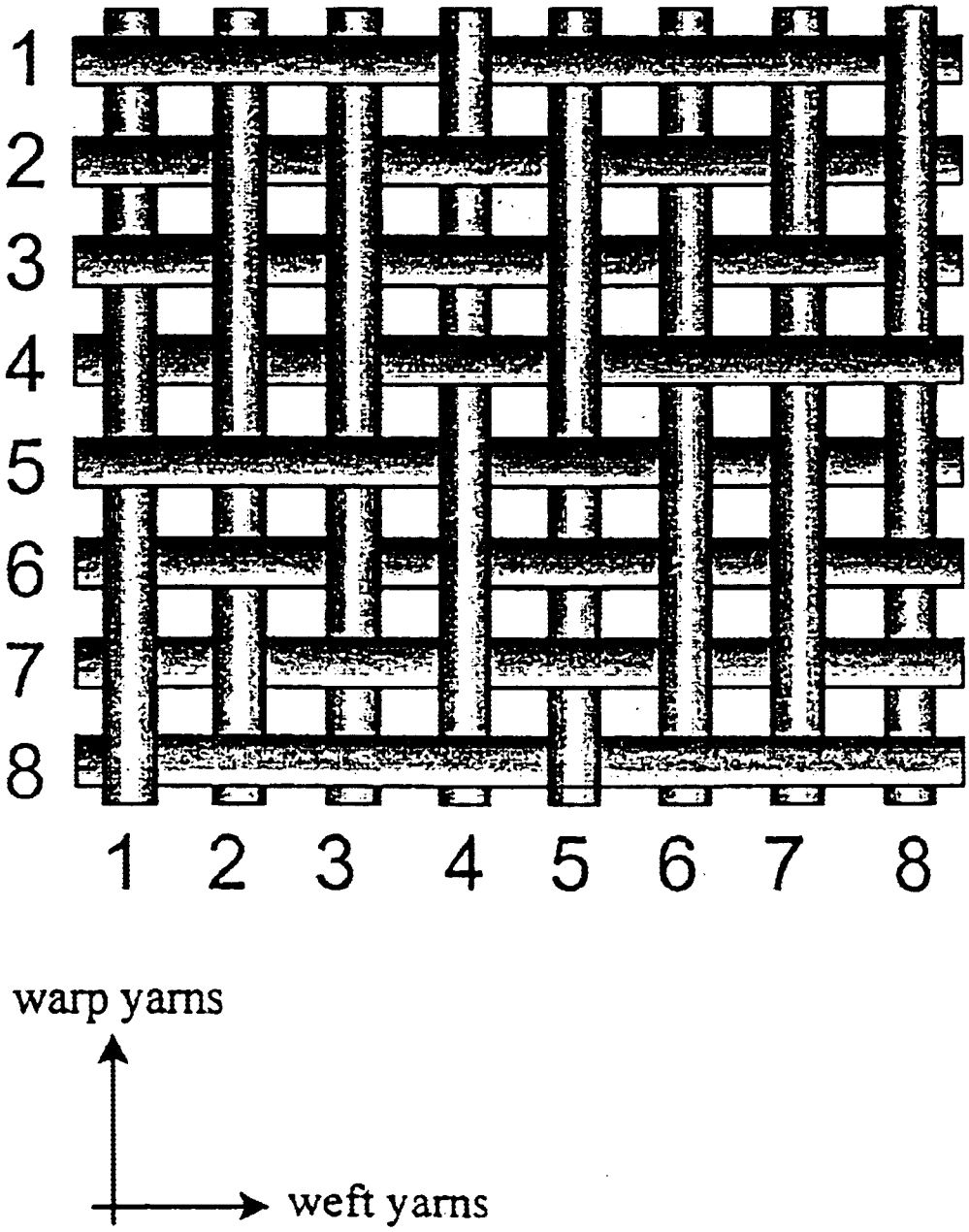

The example of an embodiment in accordance with FIG. 23 requires for a complete pattern which can be repeated eight weft yarns and eight warp yarns. Three types of weft yarns are present. The weft yarns 1 and 8 form a first type, weft yarns 4 and 5 form a second type and the weft yarns 2, 3, 6 and 7 form the third type.

Weft yarn 1 is above warp yarns 1 to 3; 5 to 7, and below warp yarns 4; 8.

Weft yarn 2 is above warp yarns 1; 4; 6, and below warp yarns 2 to 3; 5; 7 to 8.

Weft yarn 3 is above warp yarns 1; 4; 7, and below warp yarns 2 to 3; 5 to 6; 8.

Weft yarn 4 is above warp yarns 4; 6 to 8, and below warp yarns 1 to 3; 5.

Weft yarn 5 is above warp yarns 1 to 3; 5, and below warp yarns 4; 6 to 8.

Weft yarn 6 is above warp yarns 2; 5; 8, and below warp yarns 1; 3 to 4; 6 to 7.

Weft yarn 7 is above warp yarns 3; 5; 8, and below warp yarns 1 to 2; 4; 6 to 7.

Weft yarn 8 is above warp yarns 2 to 4; 6 to 8, and below warp yarns 1; 5.

Figure 24:
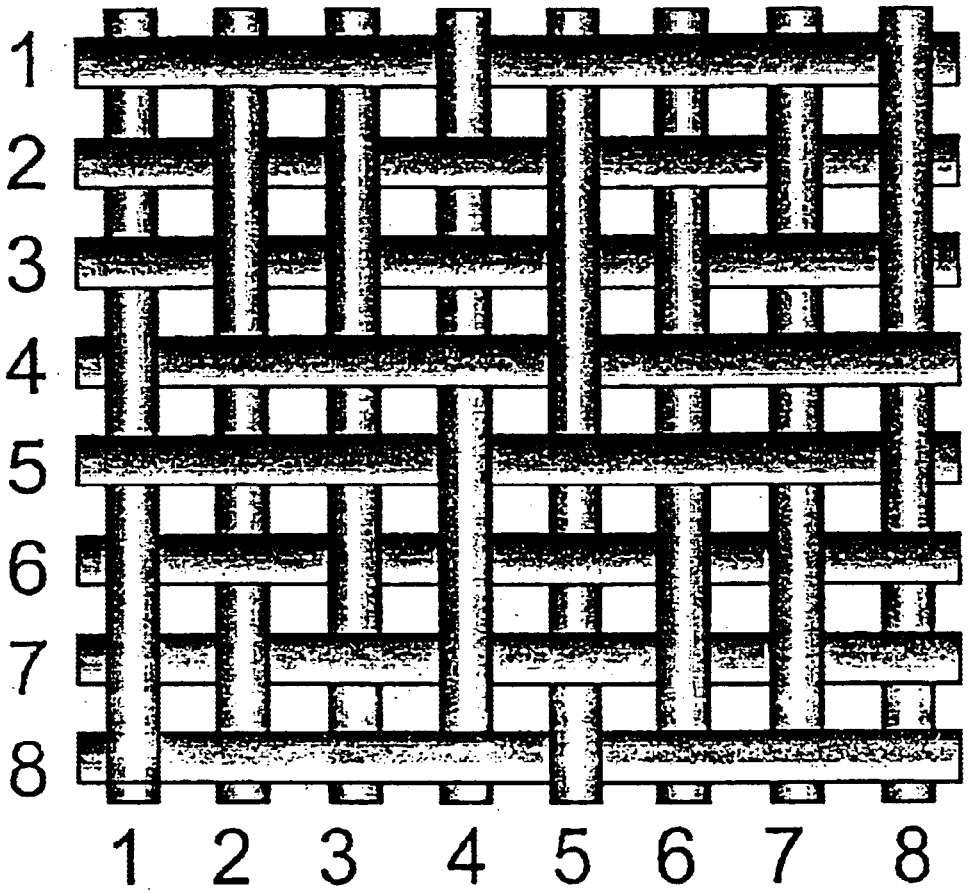
Figure 24:
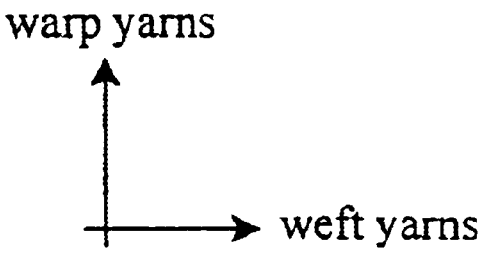

The example of an embodiment in accordance with FIG. 24 requires for a complete pattern which can be repeated eight weft yarns and eight warp yarns. Two types of weft yarns are present. The weft yarns 1, 4, 5 and 8 form a first type and the weft yarns 2, 3, 6 and 7 form a second type.

Weft yarn 1 is above warp yarns 1 to 3; 5 to 7, and below warp yarns 4; 8.

Weft yarn 2 is above warp yarns 1; 4; 6, and below warp yarns 2 to 3; 5; 7 to 8.

Weft yarn 3 is above warp yarns 1; 4; 7, and below warp yarns 2 to 3; 5 to 6; 8.

Weft yarn 4 is above warp yarns 2 to 4; 6 to 8, and below warp yarns 1; 5.

Weft yarn 5 is above warp yarns 1 to 3; 5 to 7, and below warp yarns 4; 8.

Weft yarn 6 is above warp yarns 2; 5; 8, and below warp yarns 1; 3 to 4; 6 to 7.

Weft yarn 7 is above warp yarns 3; 5; 8, and below warp yarns 1 to 2; 4; 6 to 7.

Weft yarn 8 is above warp yarns 2 to 4; 6 to 8, and below warp yarns 1; 5.

Figure 25:
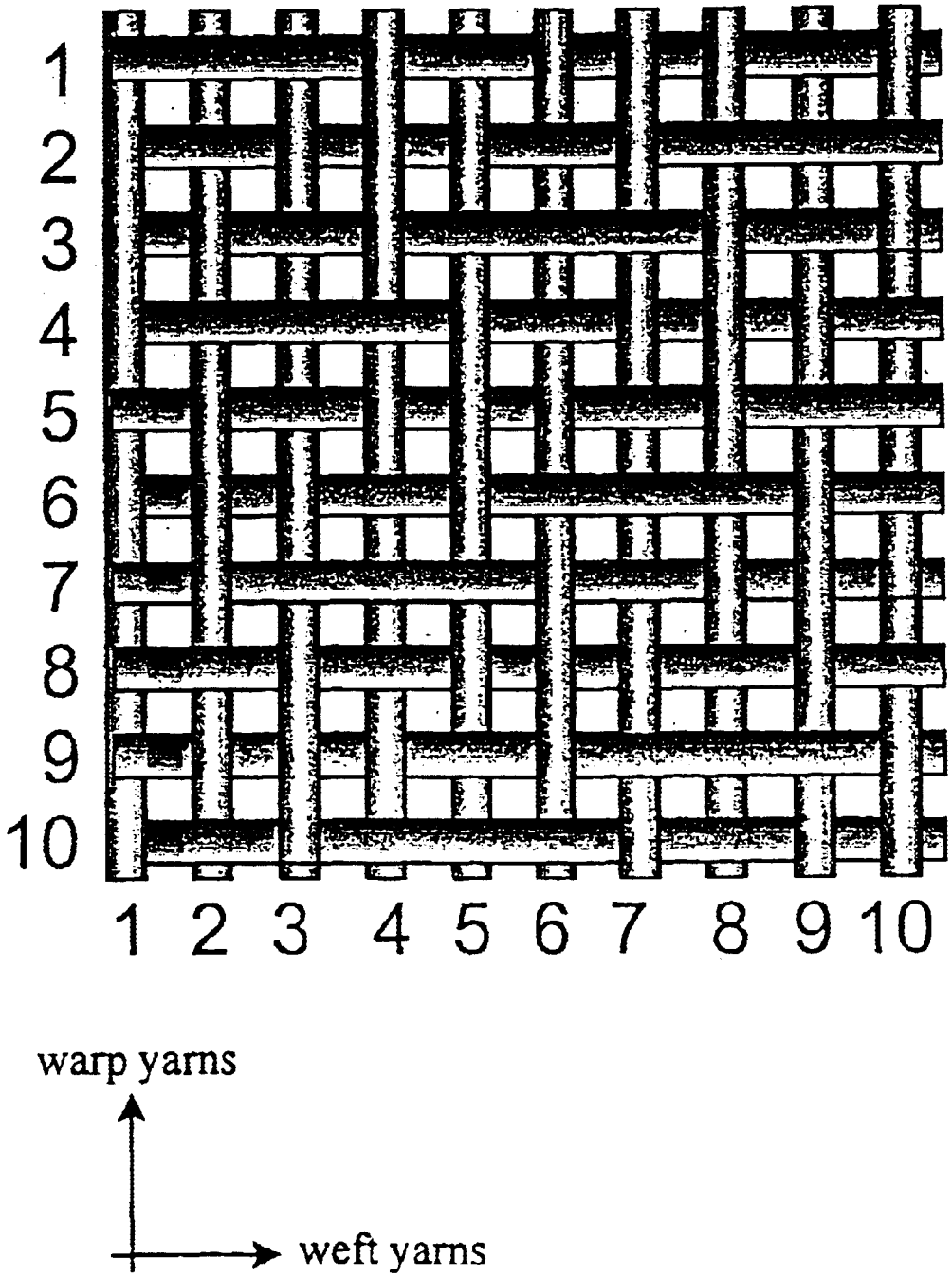

The example of an embodiment in accordance with FIG. 25 requires for a complete pattern which can be repeated ten weft yarns and ten warp yarns. One type of weft yarns is present.

Weft yarn 1 is above warp yarns 1 to 3; 5; 9, and below warp yarns 4; 6 to 8; 10.

Weft yarn 2 is above warp yarns 2; 6; 8 to 10, and below warp yarns 1; 3 to 5; 7.

Weft yarn 3 is above warp yarns 3; 5 to 7; 9, and below warp yarns 1 to 2; 4; 8; 10.

Weft yarn 4 is above warp yarns 2 to 4; 6; 10, and below warp yarns 1; 5; 7 to 9.

Weft yarn 5 is above warp yarns 1; 3; 7; 9 to 10, and below warp yarns 2; 4 to 6; 8.

Weft yarn 6 is above warp yarns 4; 6 to 8; 10, and below warp yarns 1 to 3; 5; 9.

Weft yarn 7 is above warp yarns 1; 3 to 5; 7, and below warp yarns 2; 6; 8 to 10.

Weft yarn 8 is above warp yarns 1 to 2; 4; 8; 10, and below warp yarns 3; 5 to 7; 9.

Weft yarn 9 is above warp yarns 1; 5; 7 to 9, and below warp yarns 2 to 4; 6; 10.

Weft yarn 10 is above warp yarns 2; 4 to 6; 8, and below warp yarns 1; 3; 7; 9 to 10.

Figure 26:
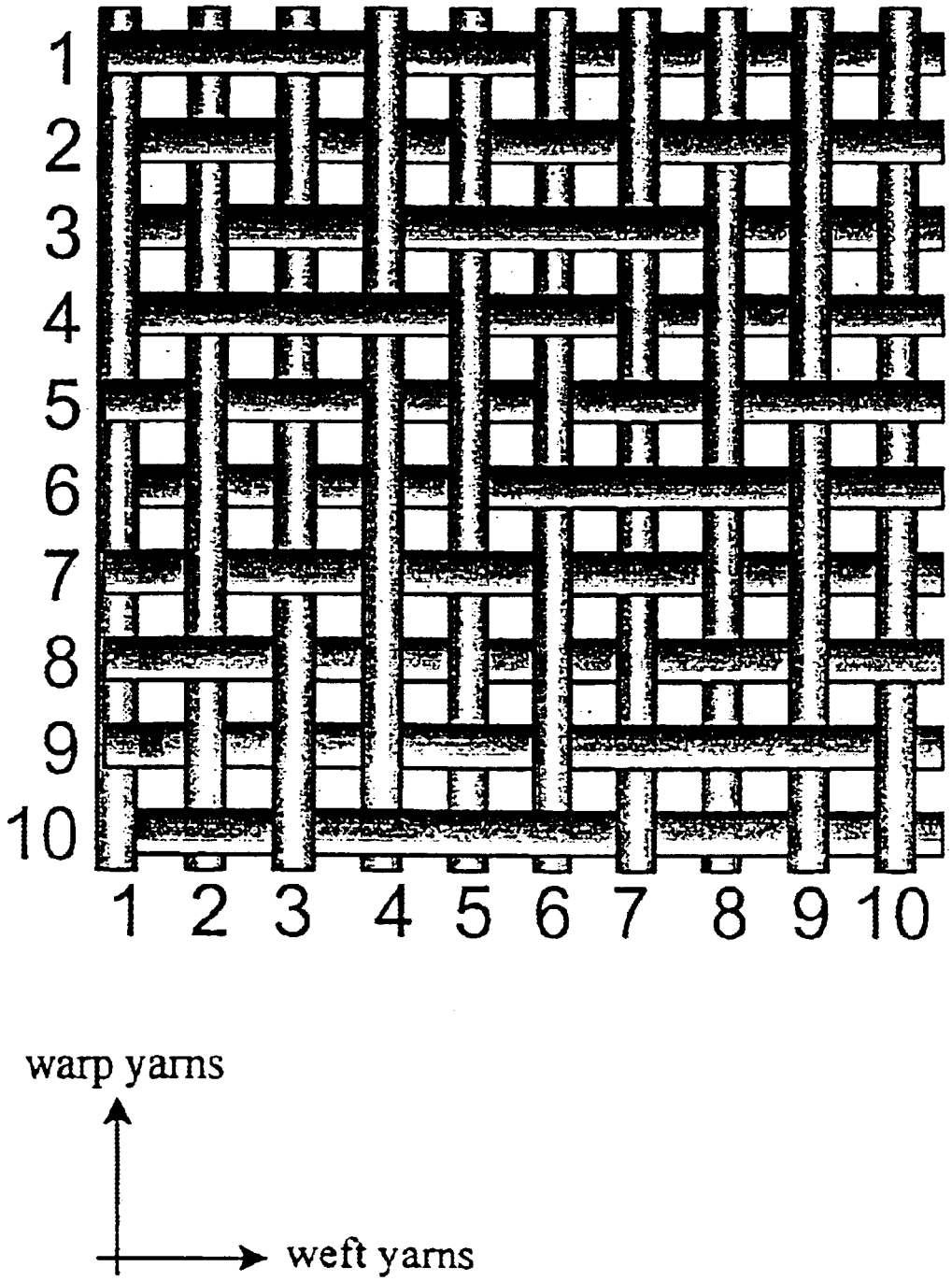

The example of an embodiment in accordance with FIG. 26 requires for a complete pattern which can be repeated ten weft yarns and ten warp yarns. Four types of weft yarns are present. The weft yarns 1 and 6 form the first type, weft yarns 2 and 7 form a second type, the weft yarns 3 and 8 form a third type and weft yarns 4, 5, 9 and 10 form the fourth type.

Weft yarn 1 is above warp yarns 1 to 3; 5, and below warp yarns 4; 6 to 10.

Weft yarn 2 is above warp yarns 2; 6; 8; 10, and below warp yarns 1; 3 to 5; 7; 9.

Weft yarn 3 is above warp yarns 3; 5 to 7, and below warp yarns 1 to 2; 4; 8 to 10.

Weft yarn 4 is above warp yarns 2 to 4; 6; 10, and below warp yarns 1; 5; 7 to 9.

Weft yarn 5 is above warp yarns 1; 3; 7; 9 to 10, and below warp yarns 2; 4 to 6; 8.

Weft yarn 6 is above warp yarns 6 to 8; 10, and below warp yarns 1 to 5; 9.

Weft yarn 7 is above warp yarns 1; 3; 5; 7, and below warp yarns 2; 4; 6; 8 to 10.

Weft yarn 8 is above warp yarns 1 to 2; 8; 10, and below warp yarns 3 to 7; 9.

Weft yarn 9 is above warp yarns 1; 5; 7 to 9, and below warp yarns 2 to 4; 6; 10.

Weft yarn 10 is above warp yarns 2; 4 to 6; 8, and below warp yarns 1; 3; 7; 9 to 10.

Figure 27:
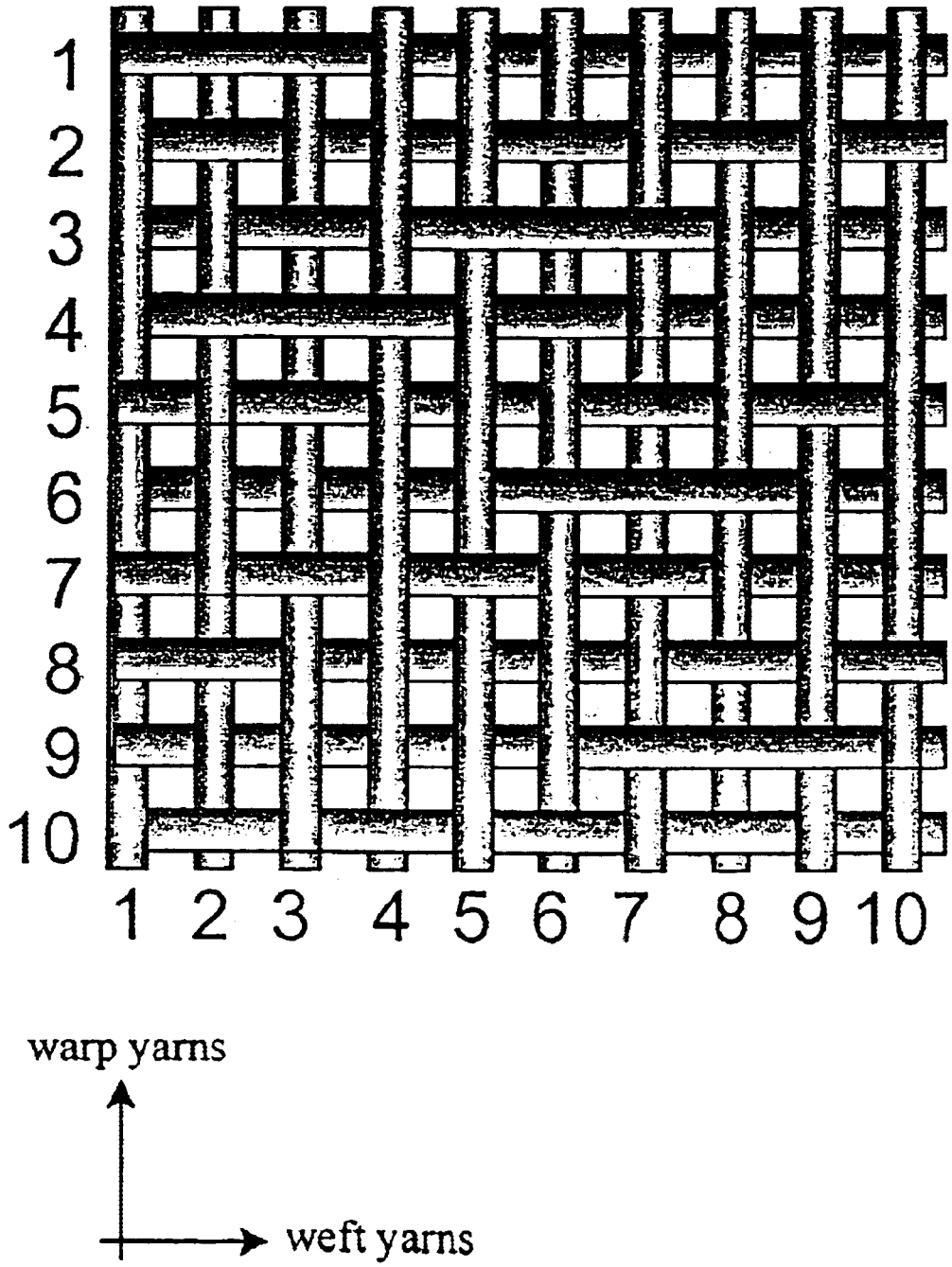

The example of an embodiment in accordance with FIG. 27 requires for a complete pattern which can be repeated ten weft yarns and ten warp yarns. Four types of weft yarns are present. The weft yarns 1 and 6 form the first type, weft yarns 2, 5, 7 and 10 form a second type, the weft yarns 3 and 8 form a third type and weft yarns 4 and 9 form the fourth type.

Weft yarn 1 is above warp yarns 1 to 3, and below warp yarns 4 to 10.

Weft yarn 2 is above warp yarns 2; 6; 8; 10, and below warp yarns 1; 3 to 5; 7; 9.

Weft yarn 3 is above warp yarns 3; 5 to 7, and below warp yarns 1 to 2; 4; 8 to 10.

Weft yarn 4 is above warp yarns 2 to 4; 6, and below warp yarns 1; 5; 7 to 10.

Weft yarn 5 is above warp yarns 1; 3; 7; 9, and below warp yarns 2; 4 to 6; 8; 10.

Weft yarn 6 is above warp yarns 6 to 8, and below warp yarns 1 to 5; 9 to 10.

Weft yarn 7 is above warp yarns 1; 3; 5; 7, and below warp yarns 2; 4; 6; 8 to 10.

Weft yarn 8 is above warp yarns 1 to 2; 8; 10, and below warp yarns 3 to 7; 9.

Weft yarn 9 is above warp yarns 1; 7 to 9, and below warp yarns 2 to 6; 10.

Weft yarn 10 is above warp yarns 2; 4; 6; 8, and below warp yarns 1; 3; 5; 7; 9 to 10.

Figure 28:
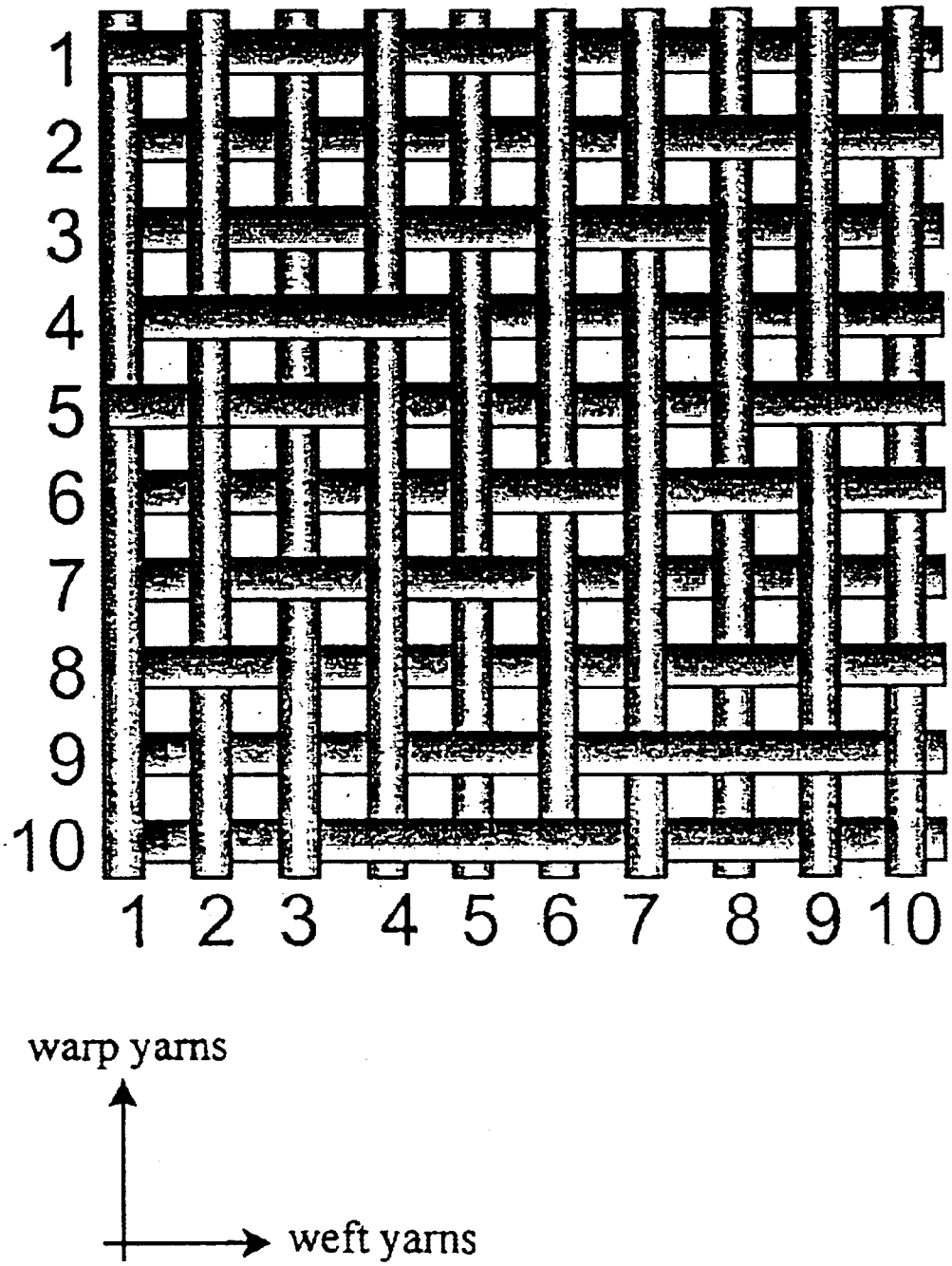

The example of an embodiment in accordance with FIG. 28 requires for a complete pattern which can be repeated ten weft yarns and ten warp yarns. Four types of weft yarns are present. The weft yarns 1, 3, 6 and 8 form the first type, weft yarns 2 and 7 form a second type, the weft yarns 4 and 9 form a third type and weft yarns 5 and 10 form the fourth type.

Weft yarn 1 is above warp yarns 1; 3; 5, and below warp yarns 2; 4; 6 to 10.

Weft yarn 2 is above warp yarns 8; 10, and below warp yarns 1 to 7; 9.

Weft yarn 3 is above warp yarns 3; 5; 7, and below warp yarns 1 to 2; 4; 6; 8 to 10.

Weft yarn 4 is above warp yarns 2 to 4; 10, and below warp yarns 1; 5 to 9.

Weft yarn 5 is above warp yarns 1; 3; 9 to 10, and below warp yarns 2; 4 to 8.

Weft yarn 6 is above warp yarns 6; 8; 10, and below warp yarns 1 to 5; 7; 9.

Weft yarn 7 is above warp yarns 3; 5, and below warp yarns 1 to 2; 4; 6 to 10.

Weft yarn 8 is above warp yarns 2; 8; 10, and below warp yarns 1; 3 to 7; 9.

Weft yarn 9 is above warp yarns 5; 7 to 9, and below warp yarns 1 to 4; 6; 10.

Weft yarn 10 is above warp yarns 4 to 6; 8, and below warp yarns 1 to 3; 7; 9 to 10.

Figure 29:
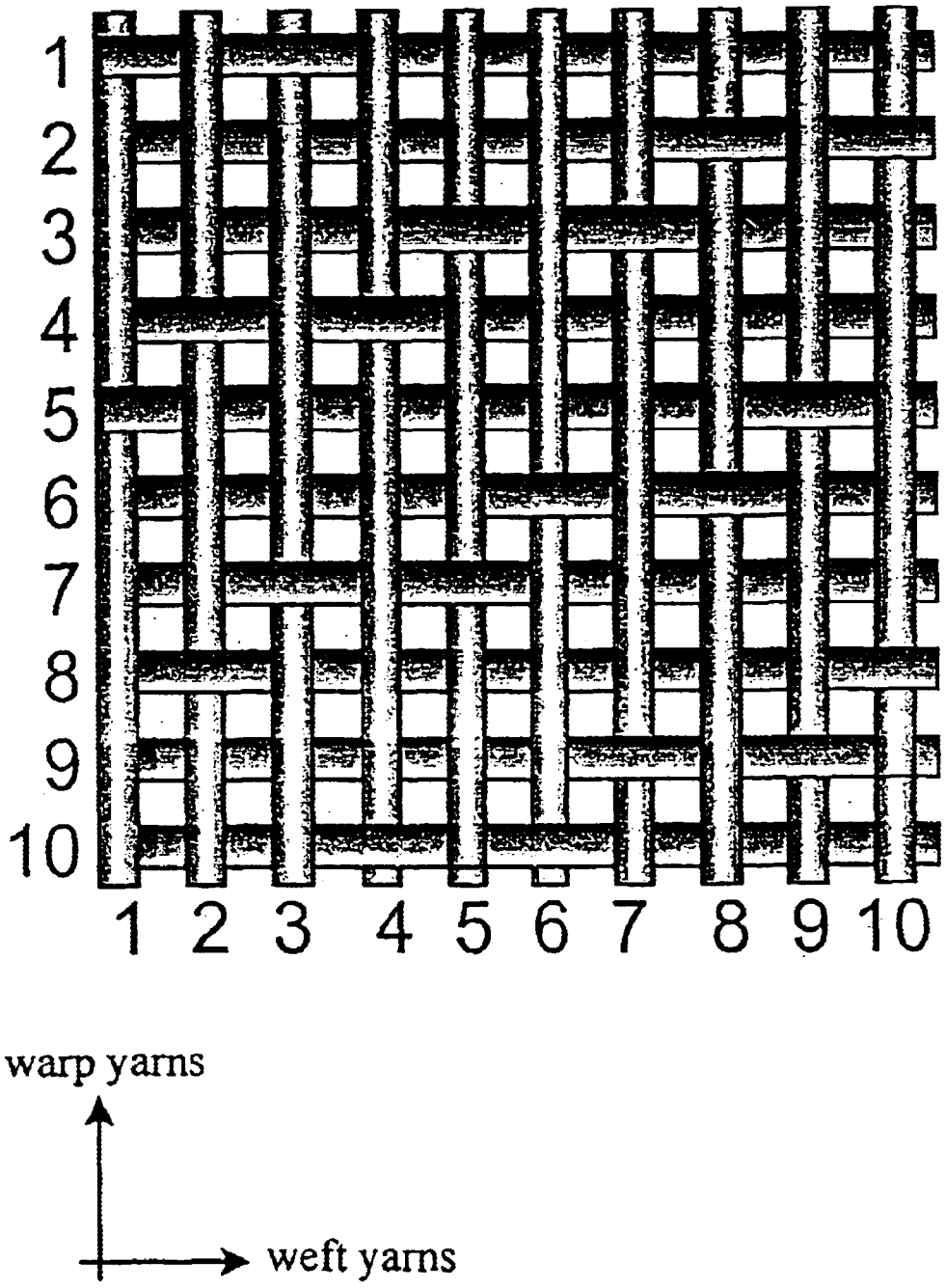

The example of an embodiment in accordance with FIG. 29 requires for a complete pattern which can be repeated ten weft yarns and ten warp yarns. One type of weft yarns is present.

Weft yarn 1 is above warp yarns 1; 3, and below warp yarns 2; 4 to 10.

Weft yarn 2 is above warp yarns 8; 10, and below warp yarns 1 to 7; 9.

Weft yarn 3 is above warp yarns 5 to 7, and below warp yarns 1 to 4; 6; 8 to 10.

Weft yarn 4 is above warp yarns 2; 4, and below warp yarns 1; 3; 5 to 10.

Weft yarn 5 is above warp yarns 1; 9, and below warp yarns 2 to 8; 10.

Weft yarn 6 is above warp yarns 6; 8, and below warp yarns 1 to 5; 7; 9 to 10.

Weft yarn 7 is above warp yarns 3; 5, and below warp yarns 1 to 2; 4; 6 to 10.

Weft yarn 8 is above warp yarns 2; 10, and below warp yarns 1; 3 to 9.

Weft yarn 9 is above warp yarns 7; 9, and below warp yarns 1 to 6; 8; 10.

Weft yarn 10 is above warp yarns 4; 6, and below warp yarns 1 to 3; 5; 7 to 10.

Figure 30:
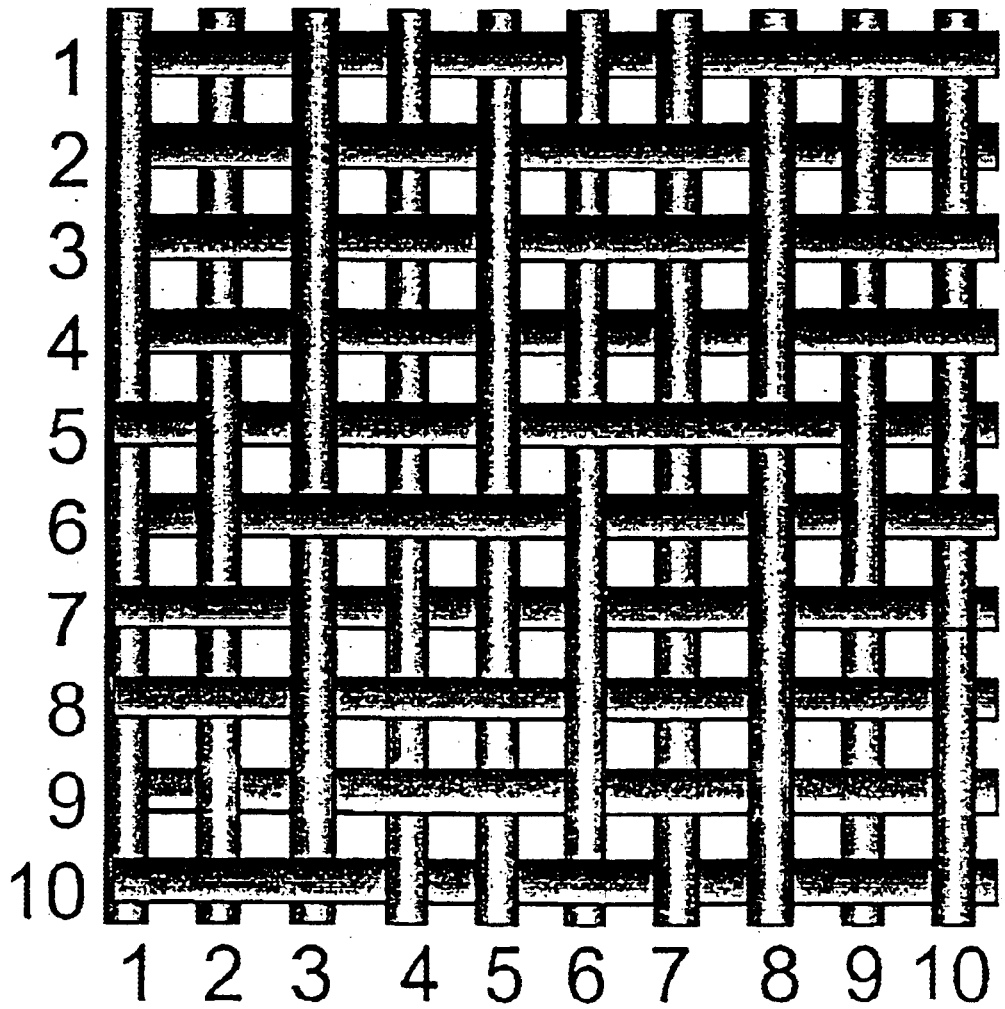
Figure 30:
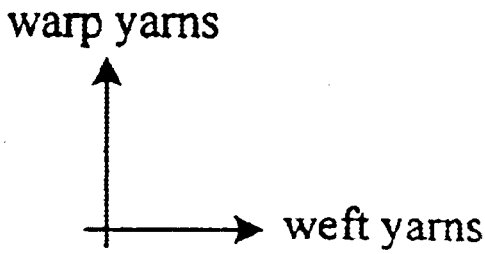

The example of an embodiment in accordance with FIG. 30 requires for a complete pattern which can be repeated ten weft yarns and ten warp yarns. Five types of weft yarns are present. The weft yarns 1 and 6 form the first type, weft yarns 2 and 7 form a second type, the weft yarns 3 and 8 form a third type, the weft yarns 4 and 9 form a fourth type and weft yarns 5 and 10 form the fifth type.

Weft yarn 1 is above warp yarns 2; 5; 8 to 10, and below warp yarns 1; 3 to 4; 6 to 7.

Weft yarn 2 is above warp yarns 2; 4; 6 to 7, and below warp yarns 1; 3; 5; 8 to 10.

Weft yarn 3 is above warp yarns 2; 4; 6 to 7; 9 to 10, and below warp yarns 1; 3; 5; 8.

Weft yarn 4 is above warp yarns 2; 4; 9 to 10, and below warp yarns 1; 3; 5 to 8.

Weft yarn 5 is above warp yarns 1; 4; 6 to 8, and below warp yarns 2 to 3; 5; 9 to 10.

Weft yarn 6 is above warp yarns 3 to 5; 7; 10, and below warp yarns 1 to 2; 6; 8 to 9.

Weft yarn 7 is above warp yarns 1 to 2; 7; 9, and below warp yarns 3 to 6; 8; 10.

Weft yarn 8 is above warp yarns 1 to 2; 4 to 5; 7; 9, and below warp yarns 3; 6; 8; 10.

Weft yarn 9 is above warp yarns 4 to 5; 7; 9, and below warp yarns 1 to 3; 6; 8; 10.

Weft yarn 10 is above warp yarns 1 to 3; 6; 9, and below warp yarns 4 to 5; 7 to 8; 10.

Figure 31:
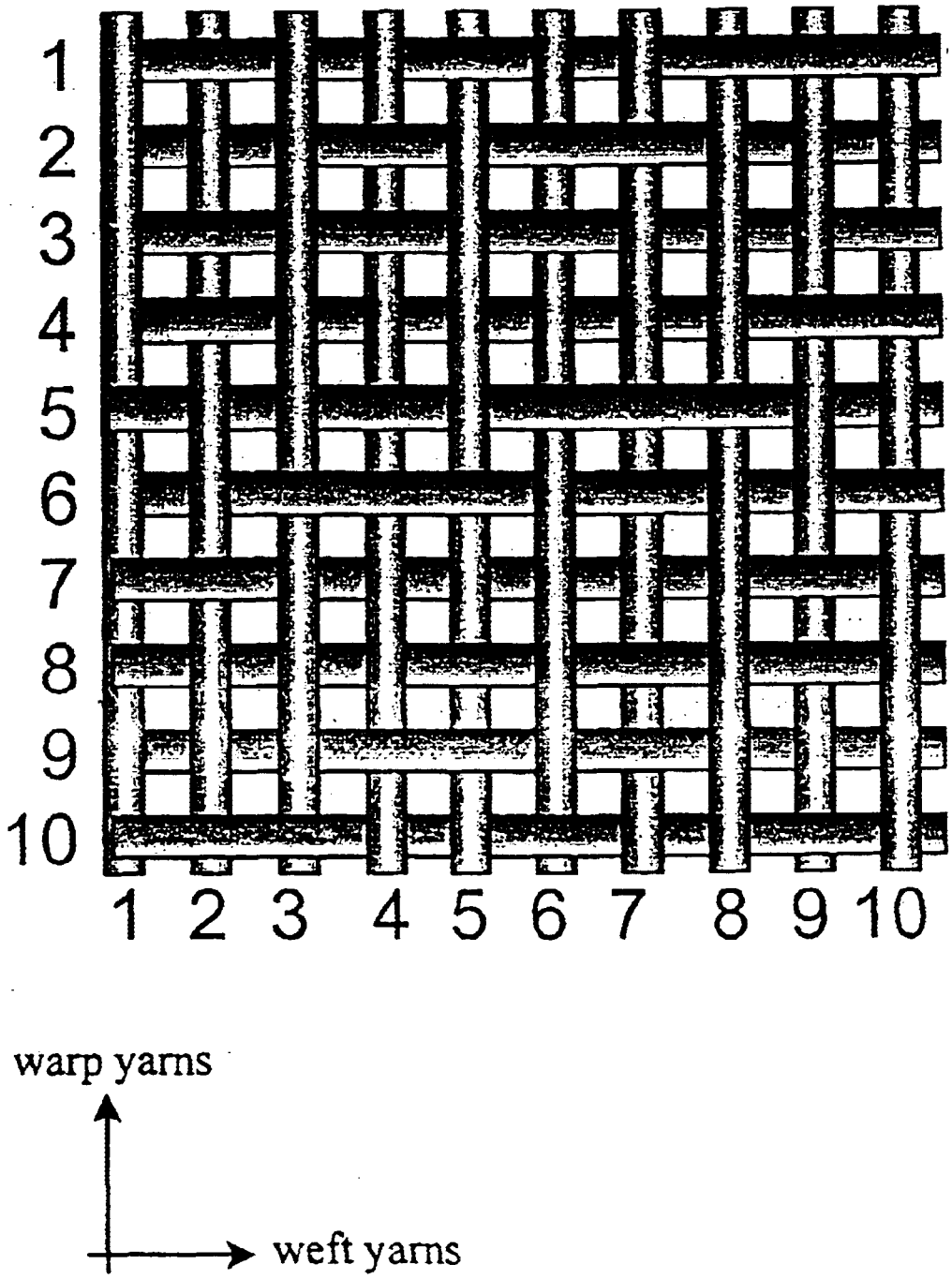

The example of an embodiment in accordance with FIG. 31 requires for a complete pattern which can be repeated ten weft yarns and ten warp yarns. Five types of weft yarns are present. The weft yarns 1 and 6 form the first type, weft yarns 2 and 7 form a second type, the weft yarns 3 and 8 form a third type, the weft yarns 4 and 9 form a fourth type and weft yarns 5 and 10 form the fifth type.

Weft yarn 1 is above warp yarns 2; 5; 8 to 10, and below warp yarns 1; 3 to 4; 6 to 7.

Weft yarn 2 is above warp yarns 4; 6 to 7, and below warp yarns 1 to 3; 5; 8 to 10.

Weft yarn 3 is above warp yarns 2; 4; 6; 10, and below warp yarns 1; 3; 5; 7 to 9.

Weft yarn 4 is above warp yarns 2; 9 to 10, and below warp yarns 1; 3 to 8.

Weft yarn 5 is above warp yarns 1; 4; 6 to 8, and below warp yarns 2 to 3; 5; 9 to 10.

Weft yarn 6 is above warp yarns 3 to 5; 7; 10, and below warp yarns 1 to 2; 6; 8 to 9.

Weft yarn 7 is above warp yarns 1 to 2; 9, and below warp yarns 3 to 8; 10.

Weft yarn 8 is above warp yarns 1; 5; 7; 9, and below warp yarns 2 to 4; 6; 8; 10.

Weft yarn 9 is above warp yarns 4 to 5; 7, and below warp yarns 1 to 3; 6; 8 to 10.

Weft yarn 10 is above warp yarns 1 to 3; 6; 9, and below warp yarns 4 to 5; 7 to 8; 10.

Figure 32:
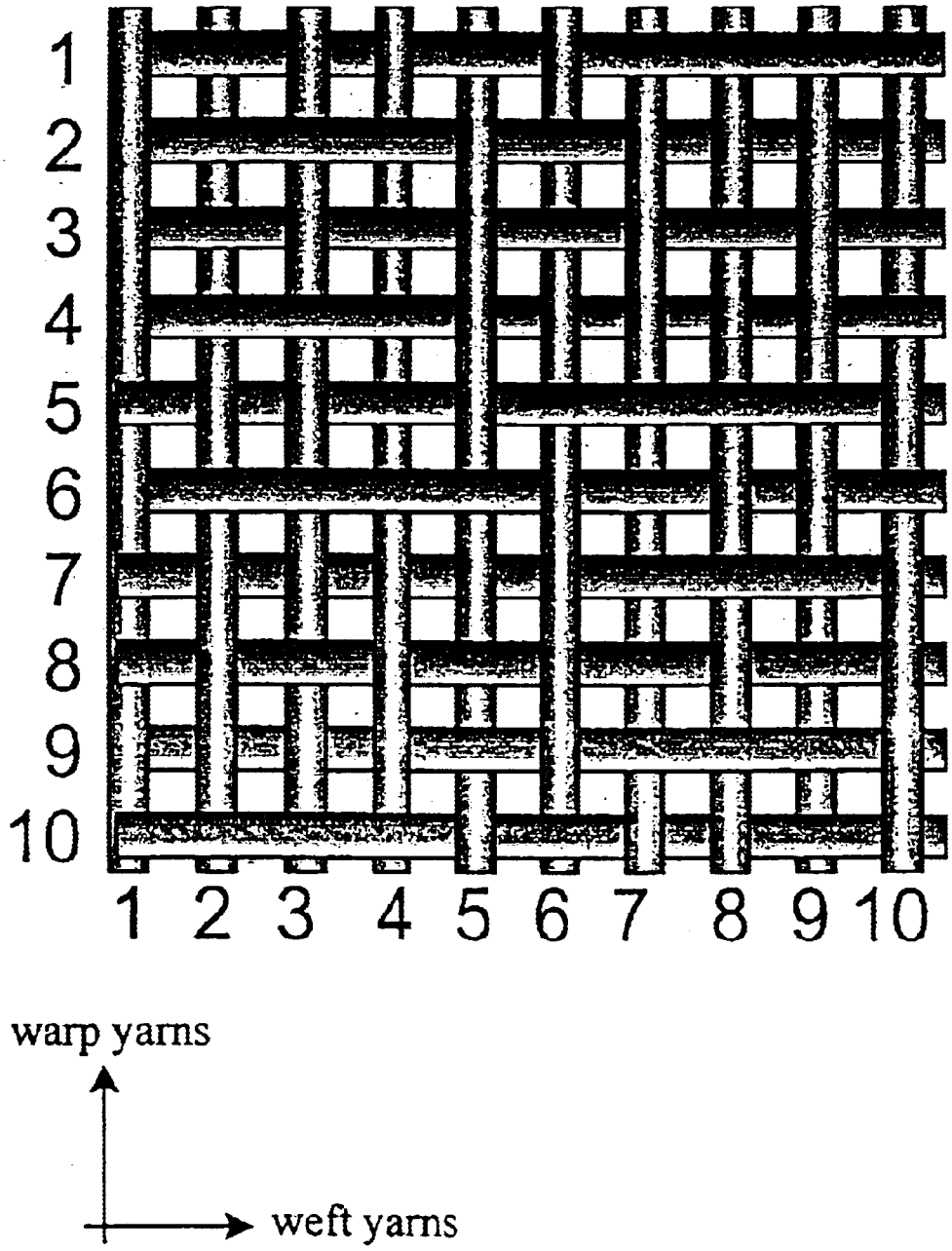

The example of an embodiment in accordance with FIG. 32 requires for a complete pattern which can be repeated ten weft yarns and ten warp yarns. Four types of weft yarns are present. The weft yarns 1, 5, 6, and 10 form the first type, weft yarns 2 and 7 form a second type, the weft yarns 3 and 8 form a third type and weft yarns 4 and 9 form the fourth type.

Weft yarn 1 is above warp yarns 2; 5; 7 to 10, and below warp yarns 1; 3 to 4; 6.

Weft yarn 2 is above warp yarns 2 to 4; 6, and below warp yarns 1; 5; 7 to 10.

Weft yarn 3 is above warp yarns 2; 4; 6; 8; 10, and below warp yarns 1; 3; 5; 7; 9.

Weft yarn 4 is above warp yarns 2 to 4; 10, and below warp yarns 1; 5 to 9.

Weft yarn 5 is above warp yarns 1; 4; 6 to 9, and below warp yarns 2 to 3; 5; 10.

Weft yarn 6 is above warp yarns 2 to 5; 7; 10, and below warp yarns 1; 6; 8 to 9.

Weft yarn 7 is above warp yarns 1 to 9, and below warp yarns 2 to 6; 10.

Weft yarn 8 is above warp yarns 1; 3; 5; 7; 9, and below warp yarns 2; 4; 6; 8; 10.

Weft yarn 9 is above warp yarns 5; 7 to 9, and below warp yarns 1 to 4; 6; 10.

Weft yarn 10 is above warp yarns 1 to 4; 6; 9, and below warp yarns 5; 7 to 8; 10.

Figure 33:
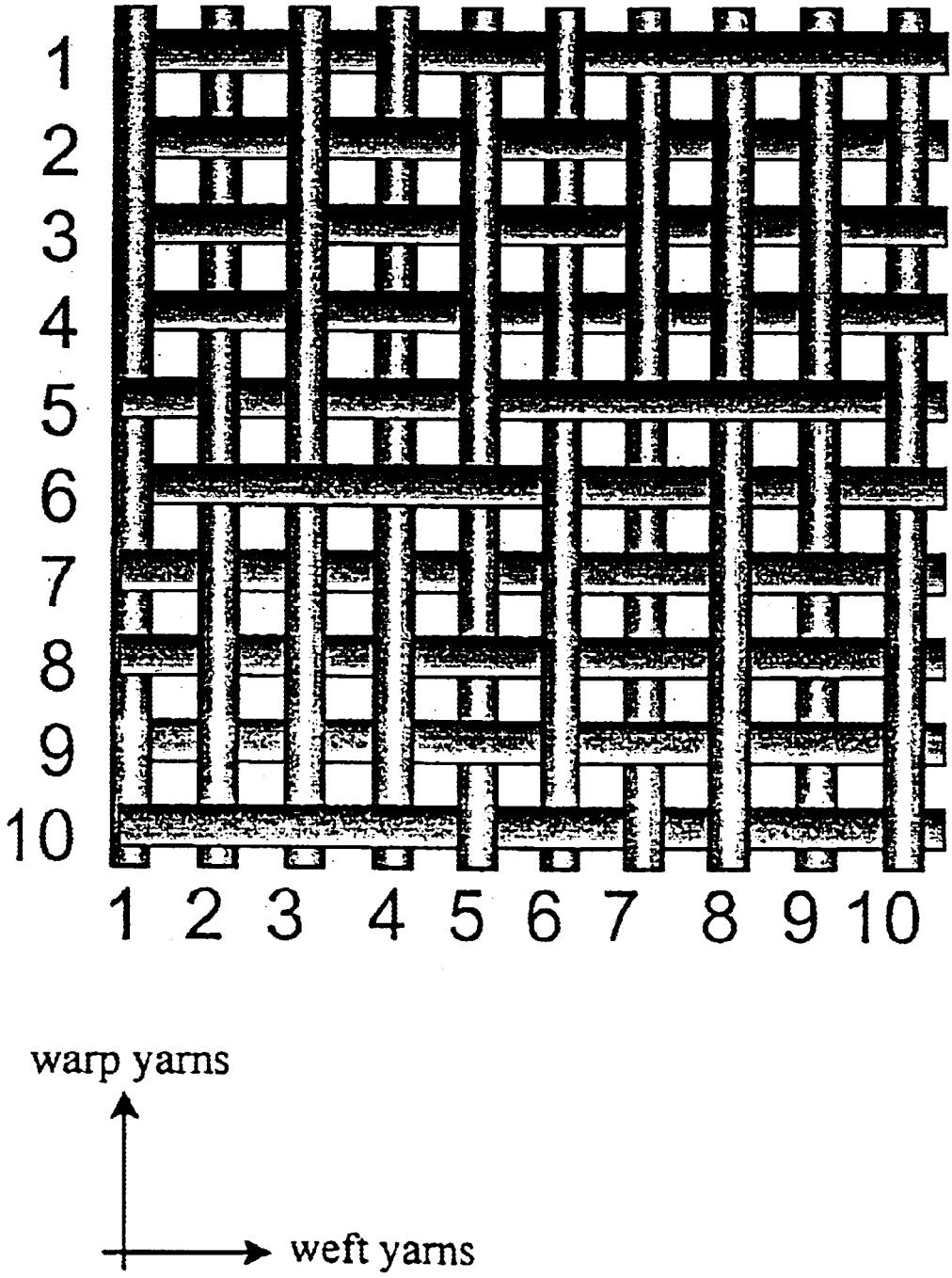

The example of an embodiment in accordance with FIG. 33 requires for a complete pattern which can be repeated ten weft yarns and ten warp yarns. Three types of weft yarns are present. The weft yarns 1, 5 and 6 form the first type, weft yarns 2, 4, 7 and 9 form a second type and the weft yarns 3 and 8 form the third type.

Weft yarn 1 is above warp yarns 2; 5; 7 to 10, and below warp yarns 1; 3 to 4; 6.

Weft yarn 2 is above warp yarns 2; 4; 6, and below warp yarns 1; 3; 5; 7 to 10.

Weft yarn 3 is above warp yarns 2; 4; 6; 10, and below warp yarns 1; 3; 5; 7 to 9.

Weft yarn 4 is above warp yarns 2; 4; 10, and below warp yarns 1; 3; 5 to 9.

Weft yarn 5 is above warp yarns 1; 4; 6 to 9, and below warp yarns 2 to 3; 5; 10.

Weft yarn 6 is above warp yarns 2 to 5; 7; 10, and below warp yarns 1; 6; 8 to 9.

Weft yarn 7 is above warp yarns 1; 7; 9, and below warp yarns 2 to 6; 8; 10.

Weft yarn 8 is above warp yarns 1; 5; 7; 9, and below warp yarns 2 to 4; 6; 8; 10.

Weft yarn 9 is above warp yarns 5; 7; 9, and below warp yarns 1 to 4; 6; 8; 10.

Weft yarn 10 is above warp yarns 1 to 4; 6; 9, and below warp yarns 5; 7 to 8; 10.

Figure 34:
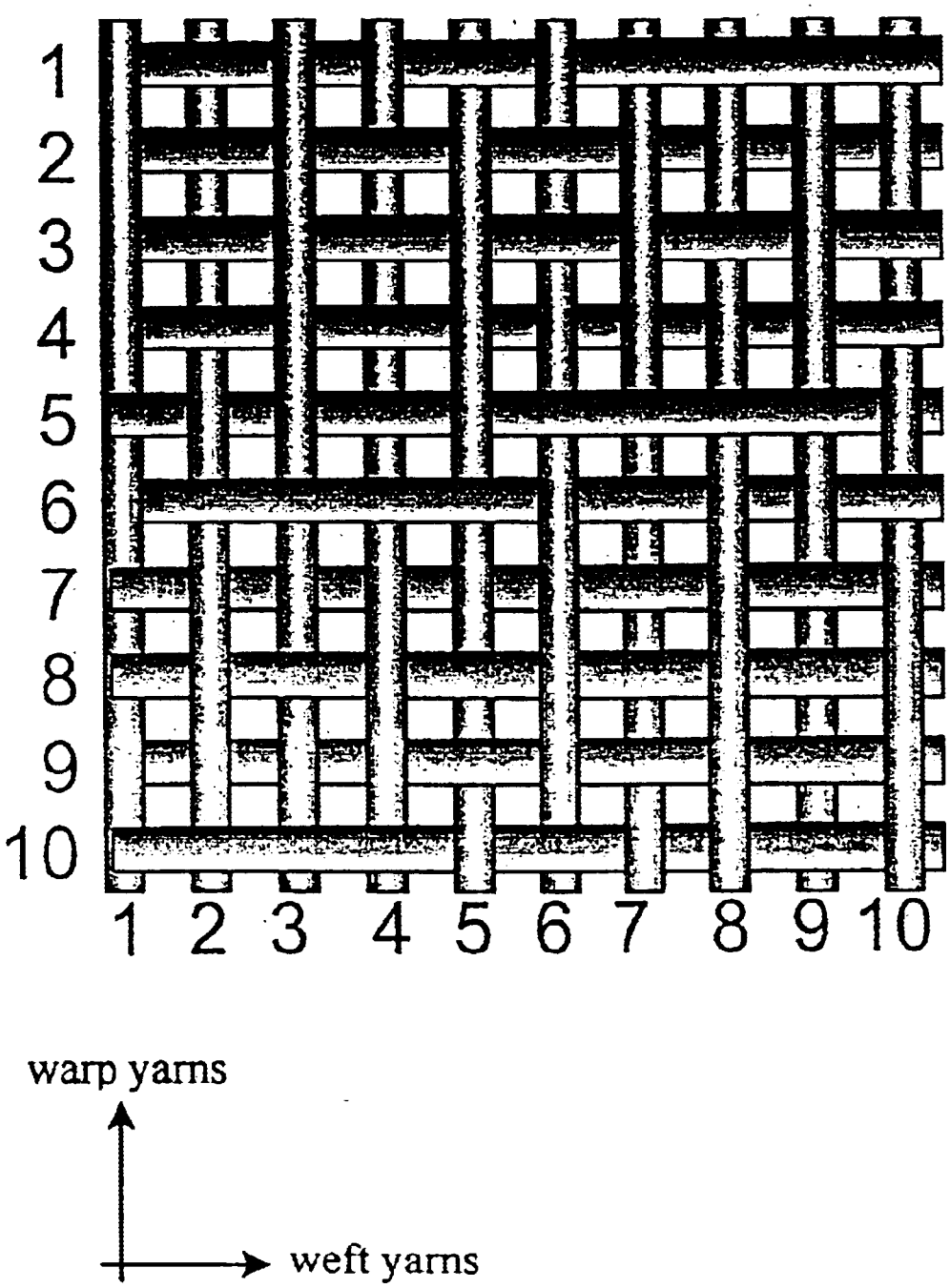

The example of an embodiment in accordance with FIG. 34 requires for a complete pattern which can be repeated ten weft yarns and ten warp yarns. Three types of weft yarns are present. The weft yarns 1, 5, 6 and 10 form the first type, weft yarns 2, 4, 7 and 9 form a second type and the weft yarns 3 and 8 form the third type.

Weft yarn 1 is above warp yarns 2; 5; 7 to 10, and below warp yarns 1; 3 to 4; 6.

Weft yarn 2 is above warp yarns 2; 4; 6, and below warp yarns 1; 3; 5; 7 to 10.

Weft yarn 3 is above warp yarns 2; 4; 6; 8; 10, and below warp yarns 1; 3; 5; 7; 9.

Weft yarn 4 is above warp yarns 2; 4; 10, and below warp yarns 1; 3; 5 to 9.

Weft yarn 5 is above warp yarns 1; 4; 6 to 9, and below warp yarns 2 to 3; 5; 10.

Weft yarn 6 is above warp yarns 2 to 5; 7; 10, and below warp yarns 1; 6; 8 to 9.

Weft yarn 7 is above warp yarns 1; 7; 9, and below warp yarns 2 to 6; 8; 10.

Weft yarn 8 is above warp yarns 1; 3; 5; 7; 9, and below warp yarns 2; 4; 6; 8; 10.

Weft yarn 9 is above warp yarns 5; 7; 9, and below warp yarns 1 to 4; 6; 8; 10.

Weft yarn 10 is above warp yarns 1 to 4; 6; 9, and below warp yarns 5; 7 to 8; 10.

Figure 35:
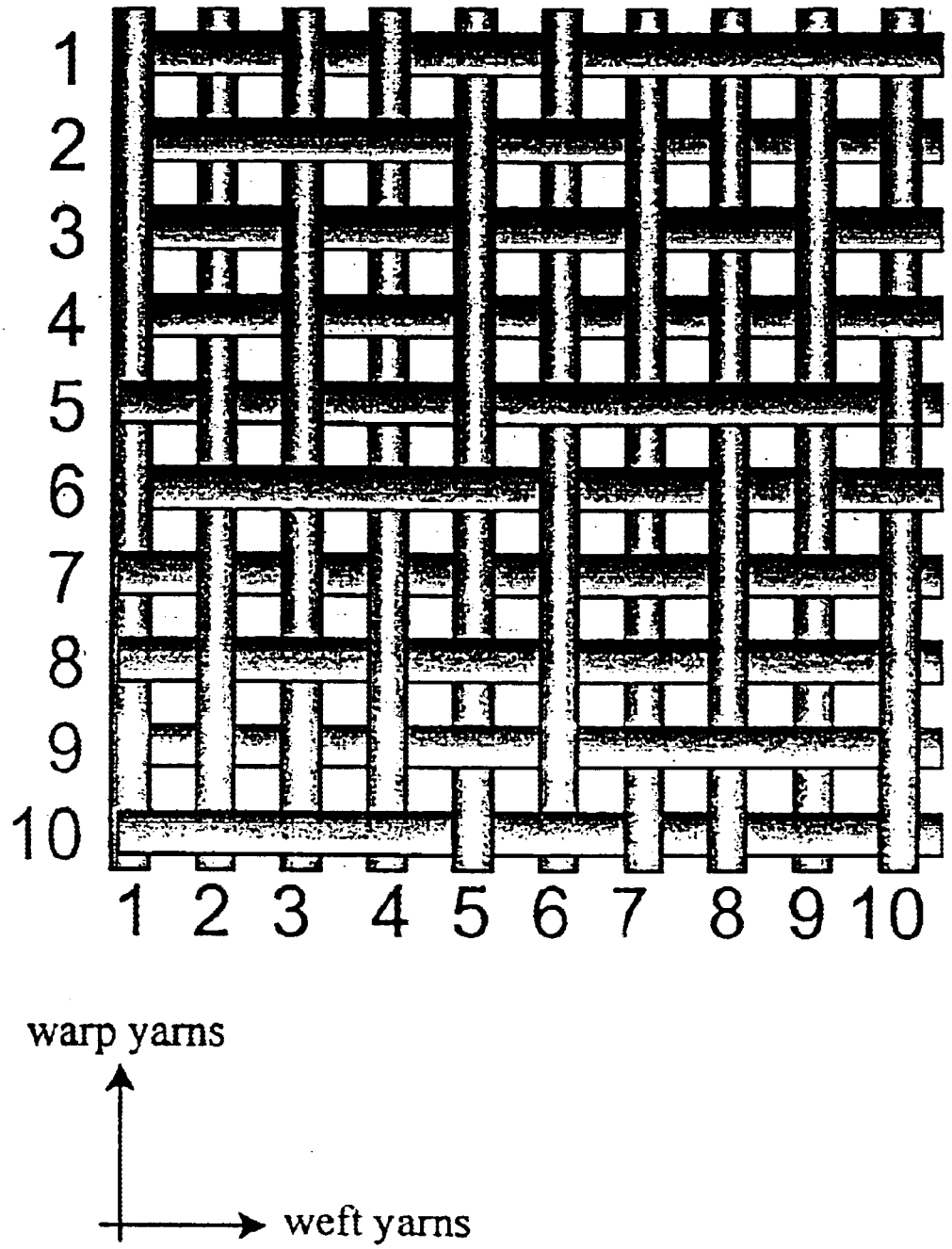

The example of an embodiment in accordance with FIG. 35 requires for a complete pattern which can be repeated ten weft yarns and ten warp yarns. Six types of weft yarns are present. The weft yarns 1, 5, 6 and 10 form the first type, weft yarns 4 and 7 form a second type, the weft yarns 3 and 8 form a third type, weft yarn 2 forms a fourth type, weft yarn 9 forms a fifth type and weft yarn 7 forms a sixth type.

Weft yarn 1 is above warp yarns 2; 5; 7 to 10, and below warp yarns 1; 3 to 4; 6.

Weft yarn 2 is above warp yarns 2 to 4; 6, and below warp yarns 1; 5; 7 to 10.

Weft yarn 3 is above warp yarns 2; 4; 6; 8; 10, and below warp yarns 1; 3; 5; 7; 9.

Weft yarn 4 is above warp yarns 2; 4; 10, and below warp yarns 1; 3; 5 to 9.

Weft yarn 5 is above warp yarns 1; 4; 6 to 9, and below warp yarns 2 to 3; 5; 10.

Weft yarn 6 is above warp yarns 2 to 5; 7; 10, and below warp yarns 1; 6; 8 to 9.

Weft yarn 7 is above warp yarns 1; 7; 9, and below warp yarns 2 to 6; 8; 10.

Weft yarn 8 is above warp yarns 1; 3; 5; 7; 9, and below warp yarns 2; 4; 6; 8; 10.

Weft yarn 9 is above warp yarns 5; 7 to 9, and below warp yarns 1 to 4; 6; 10.

Weft yarn 10 is above warp yarns 1 to 4; 6; 9, and below warp yarns 5; 7 to 8; 10.

Figure 36:
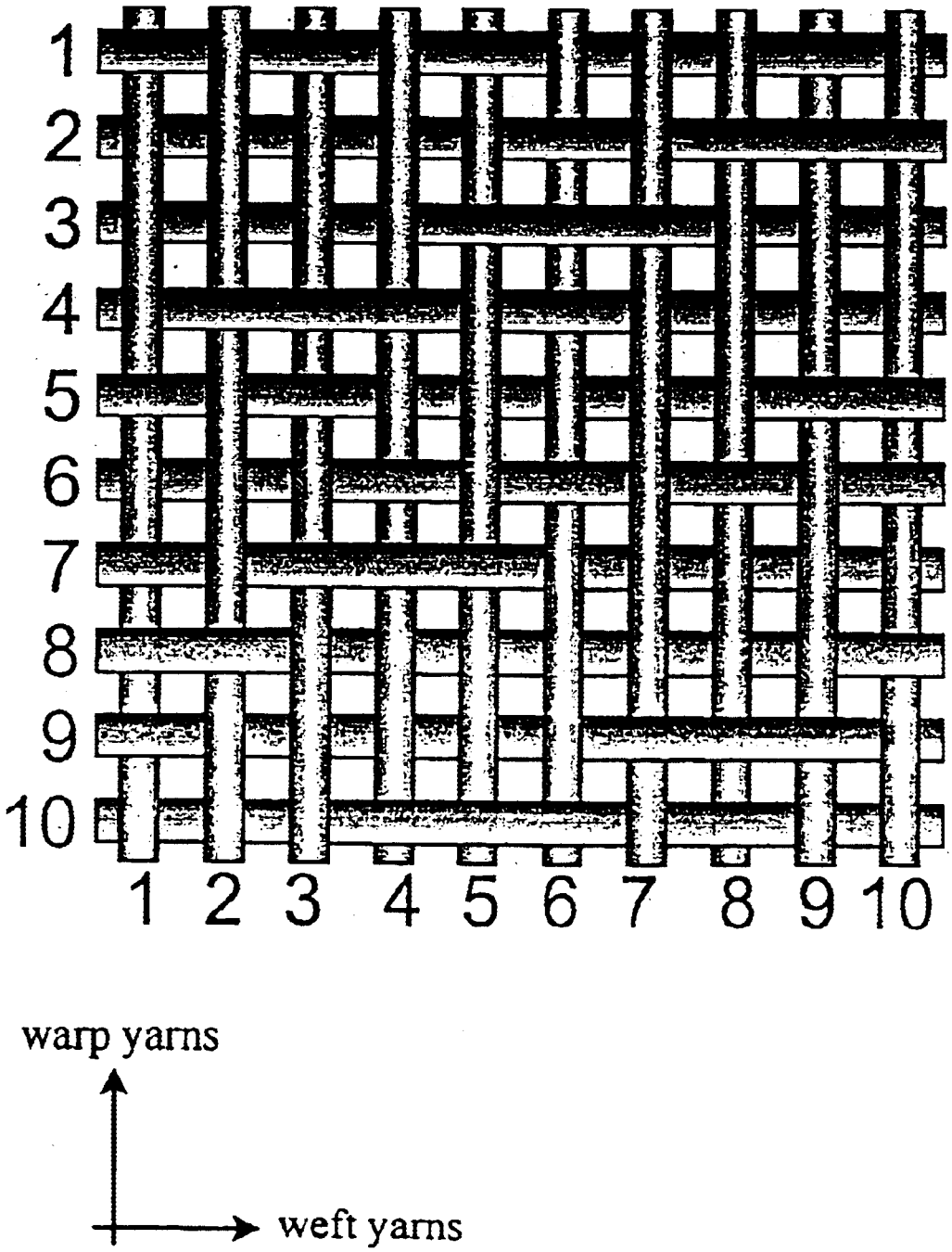

The example of an embodiment in accordance with FIG. 36 requires for a complete pattern which can be repeated ten weft yarns and ten warp yarns. Four types of weft yarns are present. The weft yarns 1 and 6 form the first type, weft yarns 2 and 7 form a second type, the weft yarns 3 and 8 form a third type and weft yarns 4, 5, 9 and 10 form the fourth type.

Weft yarn 1 is above warp yarns 1; 3; 5; 9, and below warp yarns 2; 4; 6 to 8; 10.

Weft yarn 2 is above warp yarns 6; 8 to 10, and below warp yarns 1 to 5; 7.

Weft yarn 3 is above warp yarns 5 to 7, and below warp yarns 1 to 4; 8 to 10.

Weft yarn 4 is above warp yarns 2 to 4; 6, and below warp yarns 1; 5; 7 to 10.

Weft yarn 5 is above warp yarns 1; 3; 9 to 10, and below warp yarns 2; 4 to 8.

Weft yarn 6 is above warp yarns 4; 6; 8; 10, and below warp yarns 1 to 3; 5; 7; 9.

Weft yarn 7 is above warp yarns 1; 3 to 5, and below warp yarns 2; 6 to 10.

Weft yarn 8 is above warp yarns 1; 2; 10, and below warp yarns 3 to 9.

Weft yarn 9 is above warp yarns 1; 7 to 9, and below warp yarns 2 to 6; 10.

Weft yarn 10 is above warp yarns 4 to 6; 8, and below warp yarns 1 to 3; 7; 9 to 10.

Figure 37:
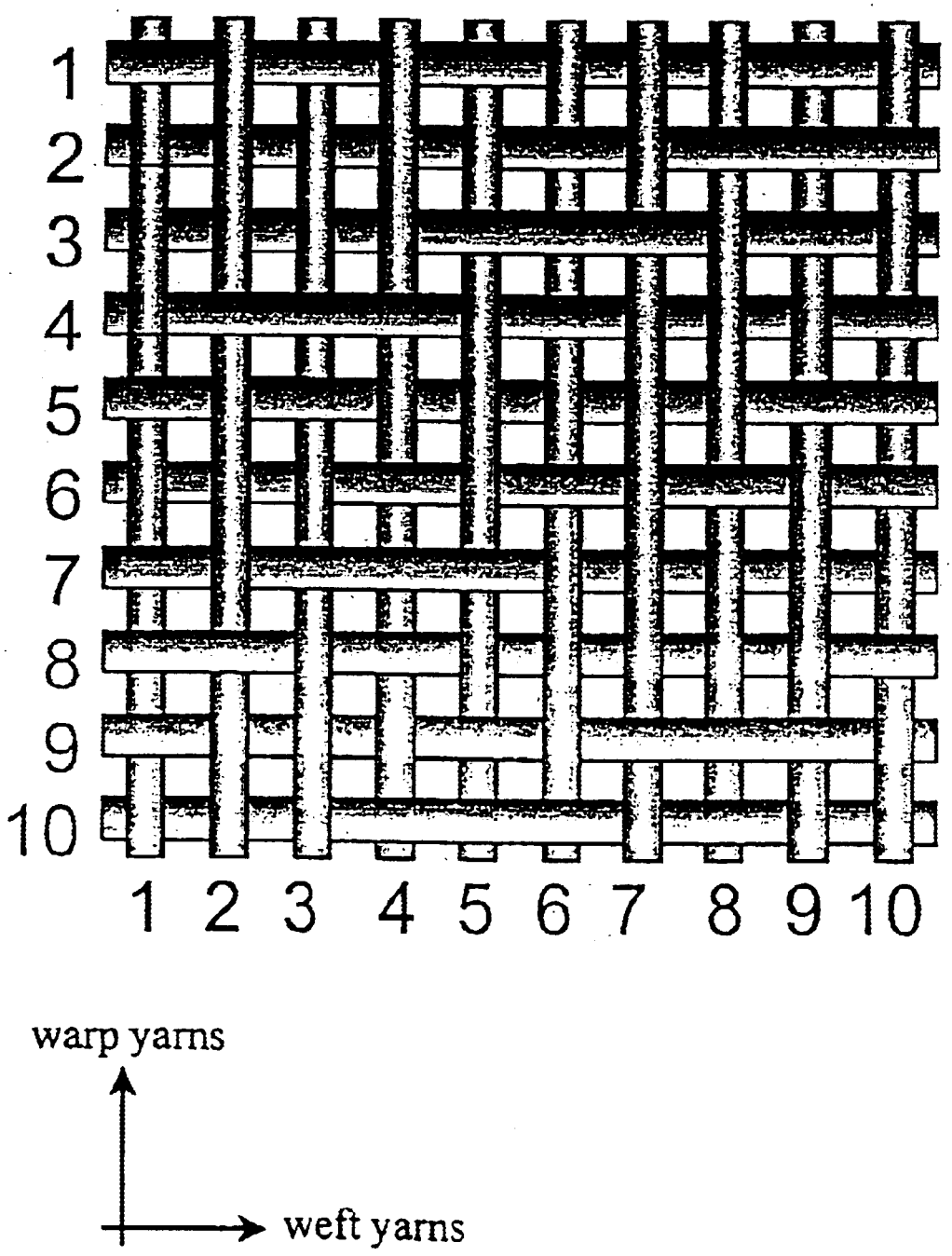

The example of an embodiment in accordance with FIG. 37 requires for a complete pattern which can be repeated ten weft yarns and ten warp yarns. Four types of weft yarns are present. The weft yarns 1 and 6 form the first type, weft yarns 2 and 7 form a second type, the weft yarns 3, 5, 8 and 10 form a third type and weft yarns 4 and 9 form the fourth type.

Weft yarn 1 is above warp yarns 1; 3; 5; 9, and below warp yarns 2; 4; 6 to 8; 10.

Weft yarn 2 is above warp yarns 6; 8 to 10, and below warp yarns 1 to 5; 7.

Weft yarn 3 is above warp yarns 5 to 7; 9, and below warp yarns 1 to 4; 8; 10.

Weft yarn 4 is above warp yarns 2 to 4; 6; 10, and below warp yarns 1; 5; 7 to 9.

Weft yarn 5 is above warp yarns 1; 3; 9 to 10, and below warp yarns 2; 4 to 8.

Weft yarn 6 is above warp yarns 4; 6; 8; 10, and below warp yarns 1 to 3; 5; 7; 9.

Weft yarn 7 is above warp yarns 1; 3 to 5, and below warp yarns 2; 6 to 10.

Weft yarn 8 is above warp yarns 1 to 2; 4; 10, and below warp yarns 3; 5 to 9.

Weft yarn 9 is above warp yarns 1; 5; 7 to 9, and below warp yarns 2 to 4; 6; 10.

Weft yarn 10 is above warp yarns 4 to 6; 8, and below warp yarns 1 to 3; 7; 9 to 10.

Figure 38:
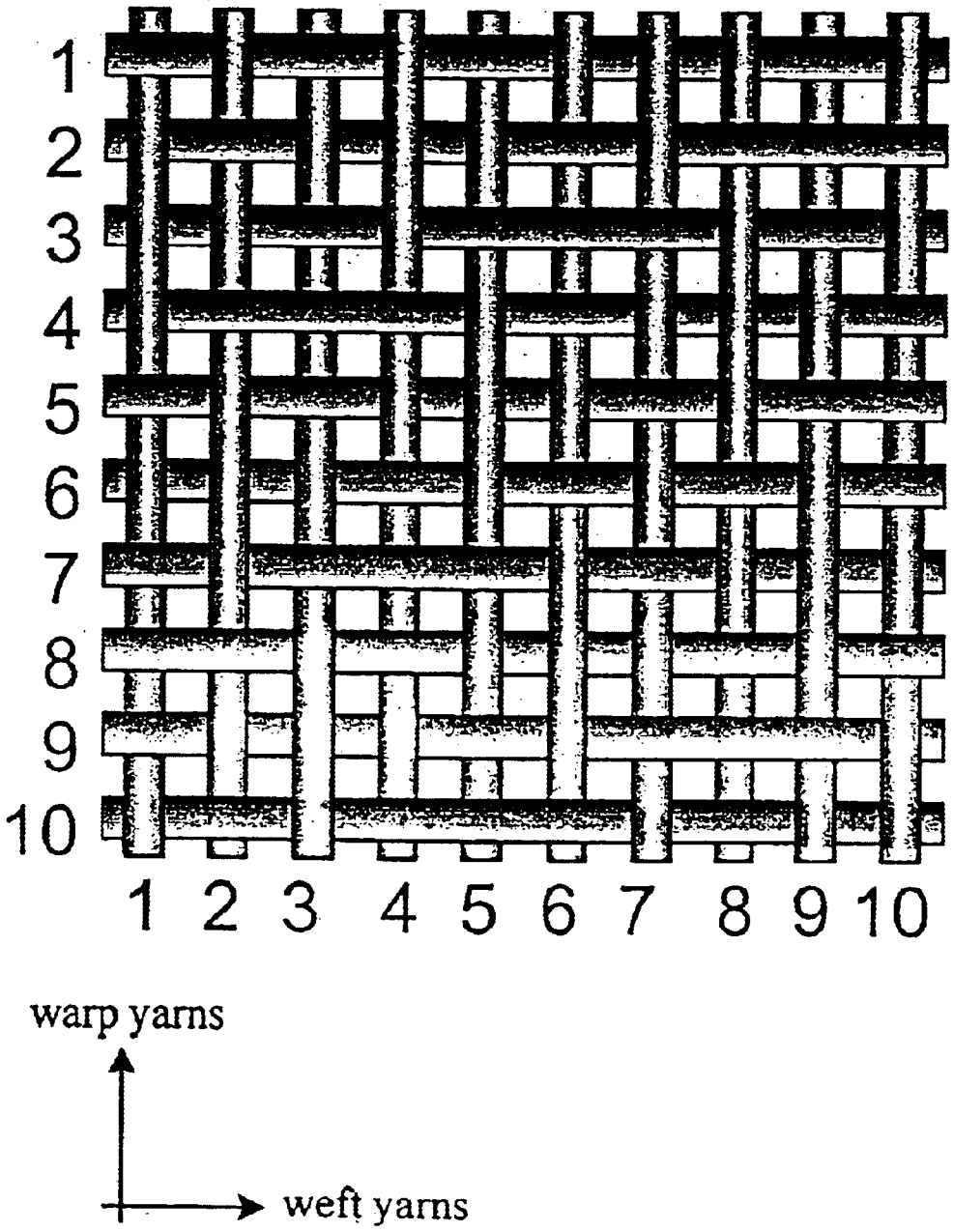

The example of an embodiment in accordance with FIG. 38 requires for a complete pattern which can be repeated ten weft yarns and ten warp yarns. Two types of weft yarns are present. The weft yarns 1 and 6 form the first type and the weft yarns 2, 3, 4, 5, 7, 8, 9 and 10 form the second type.

Weft yarn 1 is above warp yarns 1; 3; 5; 9, and below warp yarns 2; 4; 6 to 8; 10.

Weft yarn 2 is above warp yarns 2; 6; 8 to 10, and below warp yarns 1; 3 to 5; 7.

Weft yarn 3 is above warp yarns 3; 5 to 7; 9, and below warp yarns 1 to 2; 4; 8; 10.

Weft yarn 4 is above warp yarns 2 to 4; 6; 10, and below warp yarns 1; 5; 7 to 9.

Weft yarn 5 is above warp yarns 1; 3; 7; 9 to 10, and below warp yarns 2; 4 to 6; 8.

Weft yarn 6 is above warp yarns 4; 6; 8; 10, and below warp yarns 1 to 3; 5; 7; 9.

Weft yarn 7 is above warp yarns 1; 3 to 5; 7, and below warp yarns 2; 6; 8 to 10.

Weft yarn 8 is above warp yarns 1 to 2; 4; 8; 10, and below warp yarns 3; 5 to 7; 9.

Weft yarn 9 is above warp yarns 1; 5; 7 to 9, and below warp yarns 2 to 4; 6; 10.

Weft yarn 10 is above warp yarns 2; 4 to 6; 8, and below warp yarns 1; 3; 7; 9 to 10.

Figure 39:
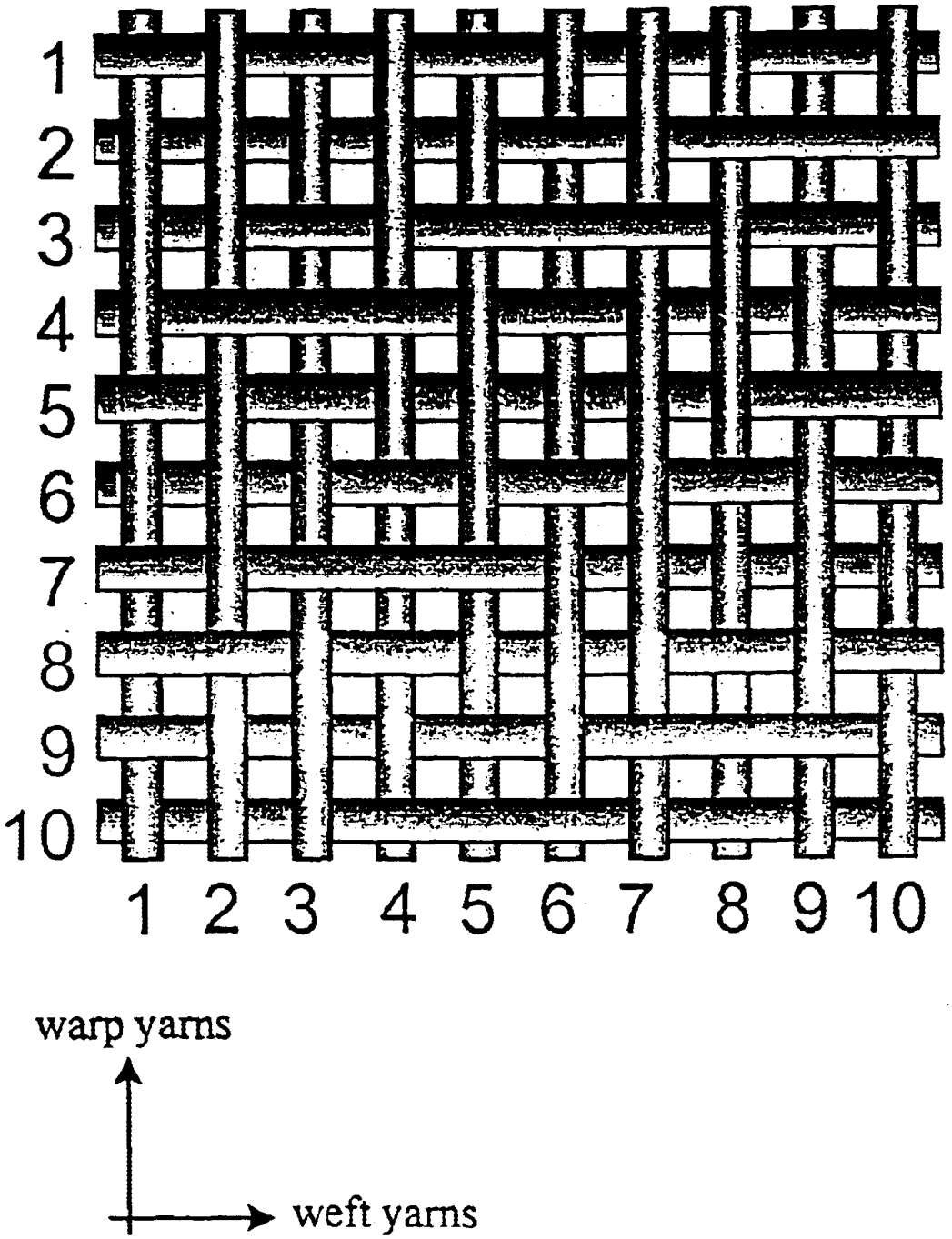

The example of an embodiment in accordance with FIG. 39 requires for a complete pattern which can be repeated ten weft yarns and ten warp yarns. Four types of weft yarns are present. The weft yarns 1 and 6 form the first type, weft yarns 2 and 7 form a second type, the weft yarns 3, 4, 8 and 9 form a third type and weft yarns 5 and 10 form the fourth type.

Weft yarn 1 is above warp yarns 1; 3; 5; 9, and below warp yarns 2; 4; 6 to 8; 10.

Weft yarn 2 is above warp yarns 6; 8 to 10, and below warp yarns 1 to 5; 7.

Weft yarn 3 is above warp yarns 3; 5 to 7; 9, and below warp yarns 1 to 2; 4; 8; 10.

Weft yarn 4 is above warp yarns 2 to 4; 6; 10, and below warp yarns 1; 5; 7 to 9.

Weft yarn 5 is above warp yarns 1; 3; 9 to 10, and below warp yarns 2; 4 to 8.

Weft yarn 6 is above warp yarns 4; 6; 8; 10, and below warp yarns 1 to 3; 5; 7; 9.

Weft yarn 7 is above warp yarns 1; 3 to 5, and below warp yarns 2; 6 to 10.

Weft yarn 8 is above warp yarns 1 to 2; 4; 8; 10, and below warp yarns 3; 5 to 7; 9.

Weft yarn 9 is above warp yarns 1; 5; 7 to 9, and below warp yarns 2 to 4; 6; 10.

Weft yarn 10 is above warp yarns 4 to 6; 8, and below warp yarns 1 to 3; 7; 9 to 10.

Figure 40:
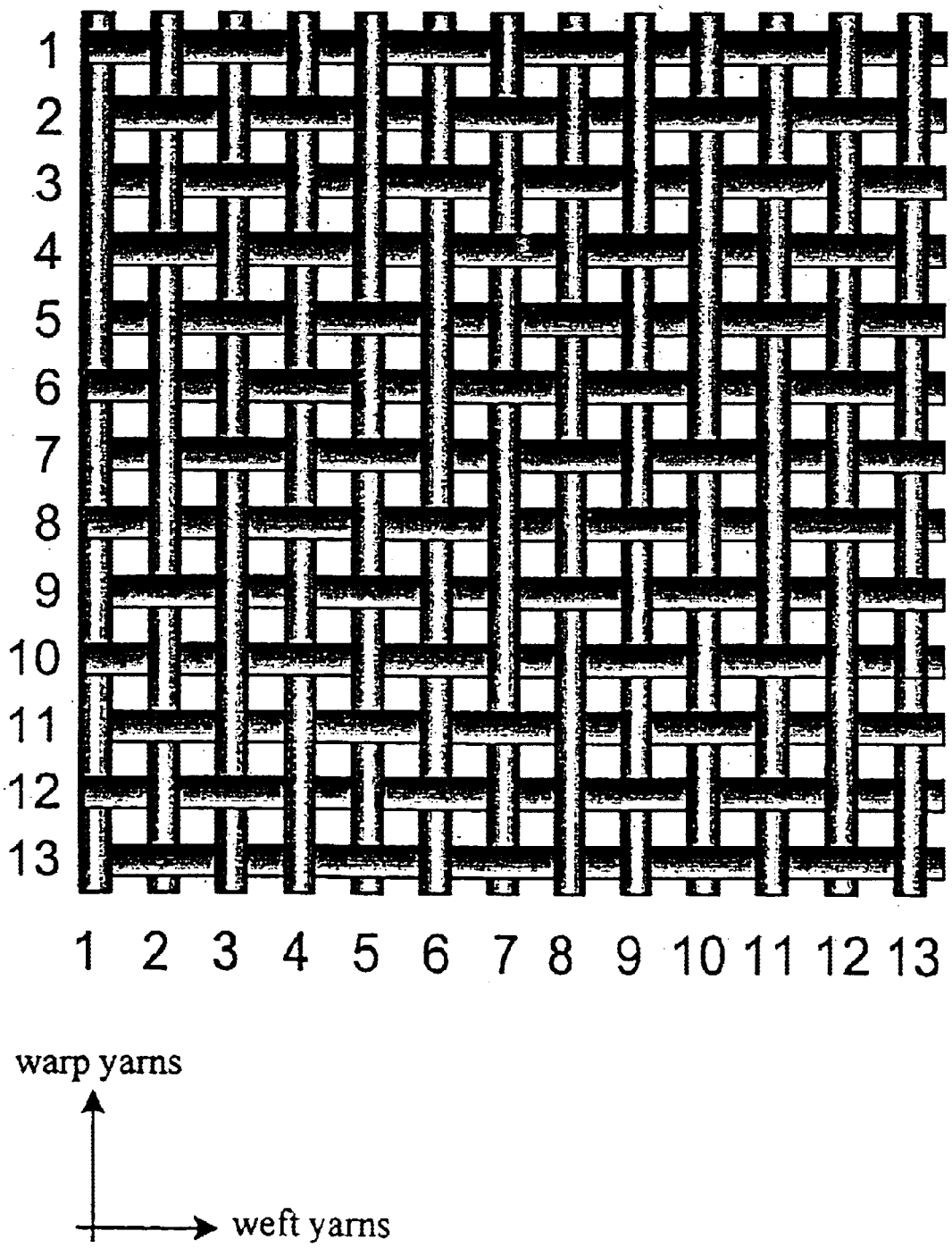

The example of an embodiment in accordance with FIG. 40 requires for a complete pattern which can be repeated thirteen weft yarns and thirteen warp yarns. There is one type of weft yarn present.

Weft yarn 1 is above warp yarns 1; 3; 6; 8; 11, and below warp yarns 2; 4 to 5; 7; 9 to 10, 12 to 13.

Weft yarn 2 is above warp yarns 2; 4; 7; 10; 12, and below warp yarns 1; 3; 5 to 6; 8 to 9; 11; 13.

Weft yarn 3 is above warp yarns 3; 6; 8; 11; 13, and below warp yarns 1 to 2; 4 to 5; 7; 9 to 10; 12.

Weft yarn 4 is above warp yarns 2; 4; 7; 9; 12, and below warp yarns 1; 3; 5 to 6; 8; 10 to 11, 13.

Weft yarn 5 is above warp yarns 3; 5; 8; 11; 13, and below warp yarns 1 to 2; 4; 6 to 7; 9 to 10; 12.

Weft yarn 6 is above warp yarns 1; 4; 7; 9; 12, and below warp yarns 2 to 3; 5 to 6; 8; 10 to 11; 13.

Weft yarn 7 is above warp yarns 3; 5; 8; 10; 13, and below warp yarns 1 to 2; 4; 6 to 7; 9; 11 to 12.

Weft yarn 8 is above warp yarns 1; 4; 6; 9; 12, and below warp yarns 2 to 3; 5; 7 to 8; 10 to 11; 13.

Weft yarn 9 is above warp yarns 2; 5; 8; 10; 13, and below warp yarns 1; 3 to 4; 6 to 7; 9; 11 to 12.

Weft yarn 10 is above warp yarns 1; 4; 6; 9; 11, and below warp yarns 2 to 3; 5; 7 to 8; 10; 12 to 13.

Weft yarn 11 is above warp yarns 2; 5; 7; 10; 13, and below warp yarns 1; 3; 6; 8 to 9; 11 to 12.

Weft yarn 12 is above warp yarns 1; 3; 6; 9; 11, and below warp yarns 2; 4 to 5; 7 to 8; 10; 12 to 13.

Weft yarn 13 is above warp yarns 2; 5; 7; 10; 12, and below warp yarns 1; 3 to 4; 6; 8 to 9; 11; 13.

Figure 41:
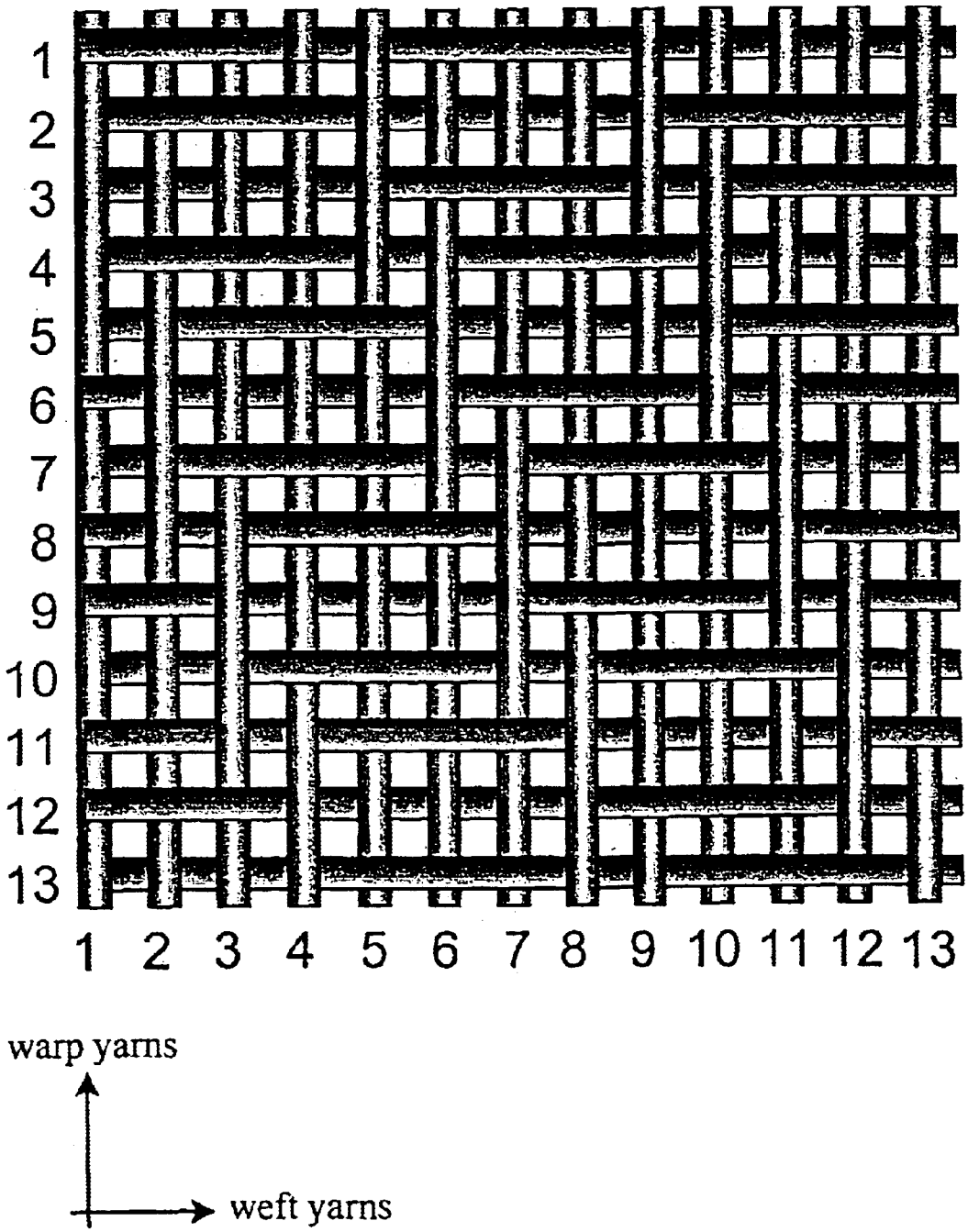

The example of an embodiment in accordance with FIG. 41 requires for a complete pattern which can be repeated thirteen weft yarns and thirteen warp yarns. There is one type of weft yarn present.

Weft yarn 1 is above warp yarns 1 to 3; 6 to 8, and below warp yarns 4 to 5; 9 to 13.

Weft yarn 2 is above warp yarns 2 to 4; 10 to 12, and below warp yarns 1; 5 to 9; 13.

Weft yarn 3 is above warp yarns 6 to 8; 11 to 13, and below warp yarns 1 to 5; 9 to 10.

Weft yarn 4 is above warp yarns 2 to 4; 7 to 9, and below warp yarns 1; 5 to 6; 10 to 13.

Weft yarn 5 is above warp yarns 3 to 5; 11 to 13, and below warp yarns 1 to 2; 6 to 10.

Weft yarn 6 is above warp yarns 1; 7 to 9; 12 to 13, and below warp yarns 2 to 6; 10 to 11.

Weft yarn 7 is above warp yarns 3 to 5; 8 to 10, and below warp yarns 1 to 2; 6 to 7; 11 to 13.

Weft yarn 8 is above warp yarns 1; 4 to 6; 12 to 13, and below warp yarns 2 to 3; 7 to 11.

Weft yarn 9 is above warp yarns 1 to 2; 8 to 10; 13, and below warp yarns 3 to 7; 11 to 12.

Weft yarn 10 is above warp yarns 4 to 6; 9 to 11, and below warp yarns 1 to 3; 7 to 8; 12 to 13.

Weft yarn 11 is above warp yarns 1 to 2; 5 to 7; 13, and below warp yarns 3 to 4; 8 to 12.

Weft yarn 12 is above warp yarns 1 to 3; 9 to 11, and below warp yarns 4 to 8; 12 to 13.

Weft yarn 13 is above warp yarns 5 to 7; 10 to 12, and below warp yarns 1 to 4; 8 to 9; 13.

Figure 42:
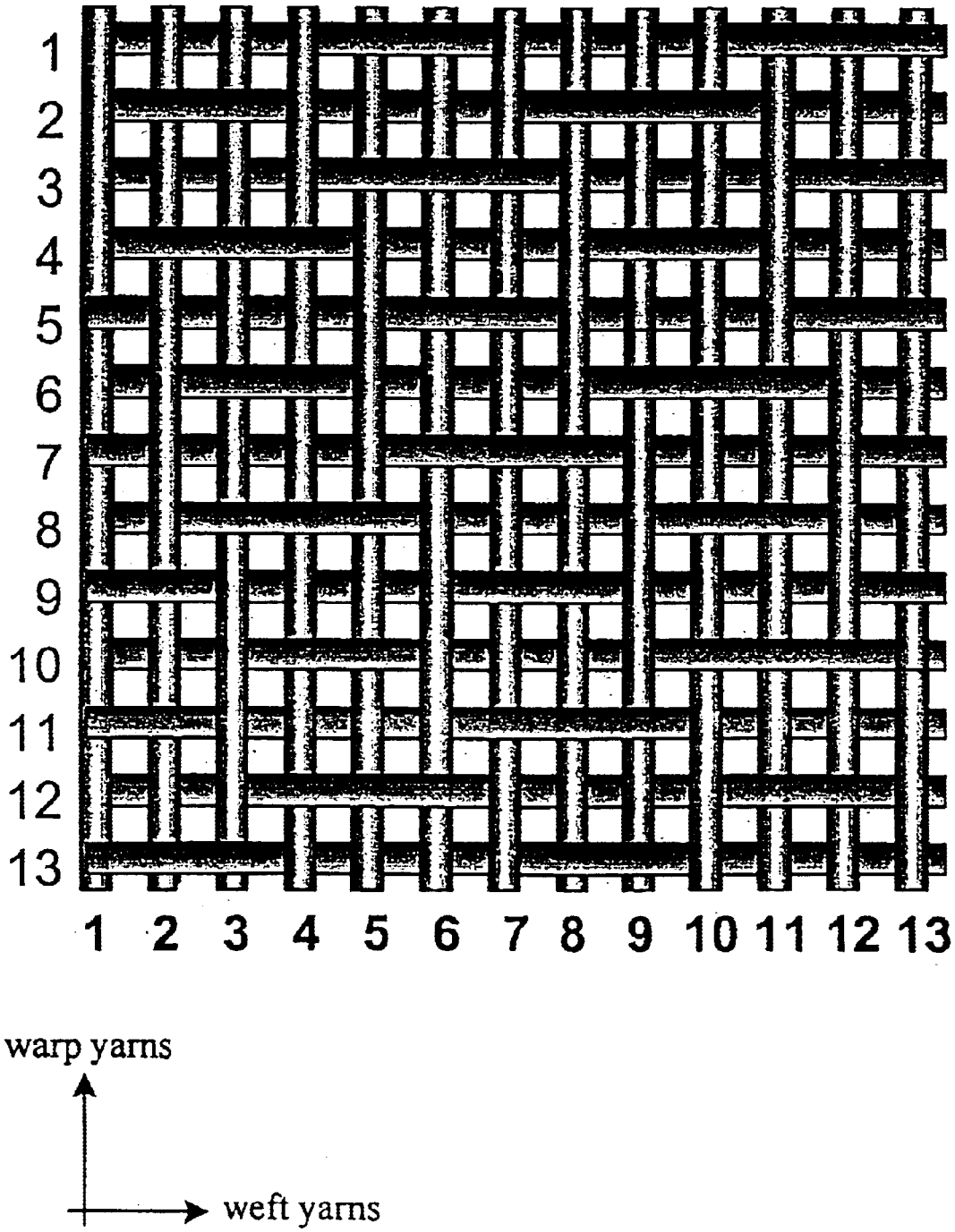

The example of an embodiment in accordance with FIG. 42 requires for a complete pattern which can be repeated thirteen weft yarns and thirteen warp yarns. There is one type of weft yarn present.

Weft yarn 1 is above warp yarns 5 to 6; 11 to 13, and below warp yarns 1 to 4; 7 to 10.

Weft yarn 2 is above warp yarns 2 to 3; 8 to 10, and below warp yarns 1; 4 to 7; 11 to 13.

Weft yarn 3 is above warp yarns 5 to 7; 12 to 13, and below warp yarns 1 to 4; 8 to 11.

Weft yarn 4 is above warp yarns 2 to 4; 9 to 10, and below warp yarns 1; 5 to 8; 11 to 13.

Weft yarn 5 is above warp yarns 1; 6 to 7; 12 to 13, and below warp yarns 2 to 5; 8 to Weft yarn 6 is above warp yarns 3 to 4; 9 to 11, and below warp yarns 1 to 2; 5 to 8; 12 to 13.

Weft yarn 7 is above warp yarns 1; 6 to 8; 13, and below warp yarns 2 to 5; 9 to 12.

Weft yarn 8 is above warp yarns 3 to 5; 10 to 11, and below warp yarns 1 to 2; 6 to 9; 12 to 13.

Weft yarn 9 is above warp yarns 1 to 2; 7 to 8; 13, and below warp yarns 3 to 6; 9 to 12.

Weft yarn 10 is above warp yarns 4 to 5; 10 to 12, and below warp yarns 1 to 3; 6 to 9; 13.

Weft yarn 11 is above warp yarns 1 to 2; 7 to 9, and below warp yarns 3 to 6; 10 to 13.

Weft yarn 12 is above warp yarns 4 to 6; 11 to 12, and below warp yarns 1 to 3; 7 to 10; 13.

Weft yarn 13 is above warp yarns 1 to 3; 8 to 9, and below warp yarns 4 to 7; 10 to 13.

Figure 43:
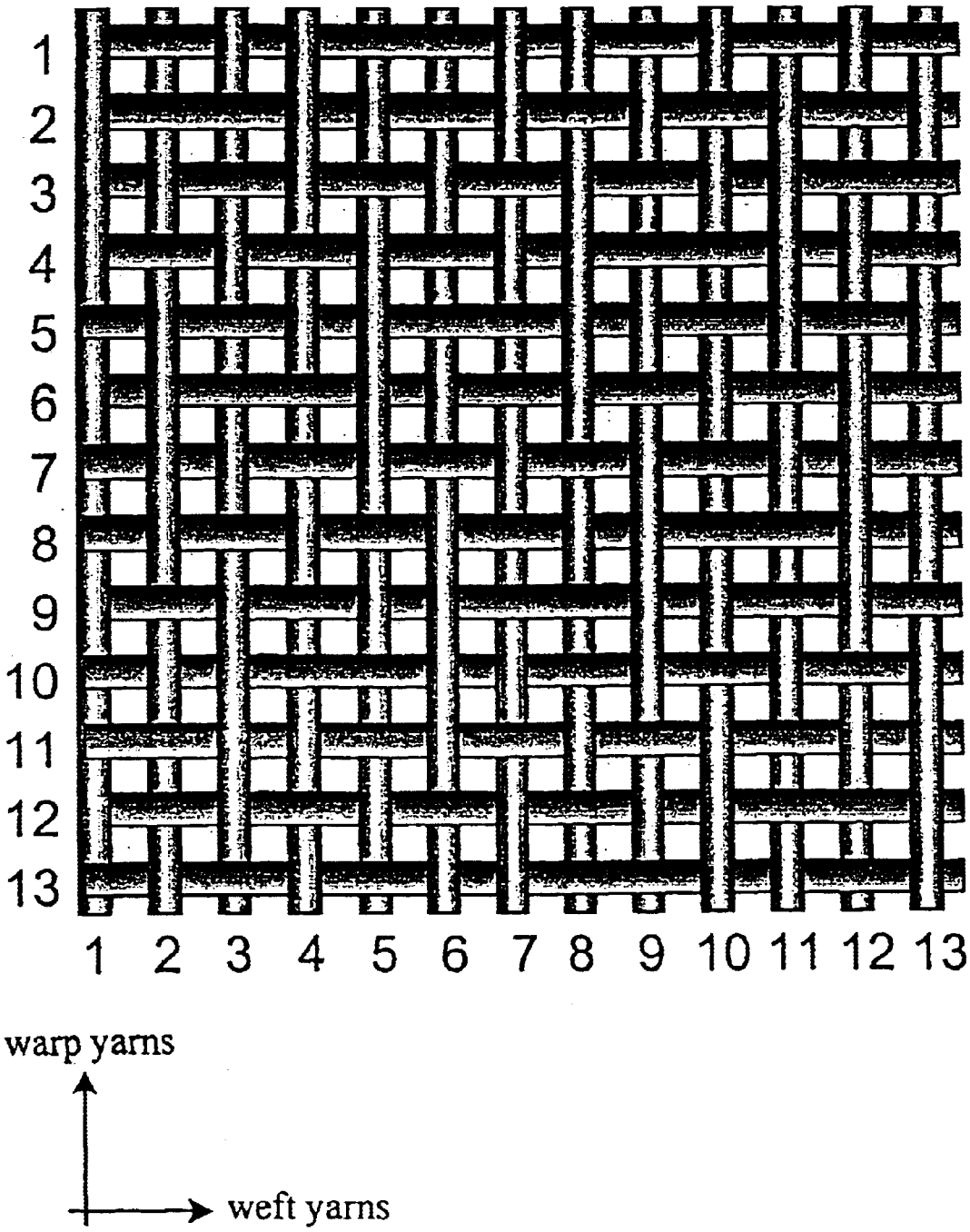

The example of an embodiment in accordance with FIG. 43 requires for a complete pattern which can be repeated thirteen weft yarns and thirteen warp yarns. There is one type of weft yarn present.

Weft yarn 1 is above warp yarns 2; 5 to 6; 9; 11; 13, and below warp yarns 1; 3 to 4; 7 to 8; 10, 12.

Weft yarn 2 is above warp yarns 2 to 3; 6; 8; 10; 12, and below warp yarns 1; 4 to 5; 7; 9; 11; 13.

Weft yarn 3 is above warp yarns 3; 5; 7; 9; 12 to 13, and below warp yarns 1 to 2; 4; 6; 8; 10 to 11.

Weft yarn 4 is above warp yarns 2; 4; 6; 9 to 10; 13, and below warp yarns 1; 3; 5; 7 to 8; 11 to 12.

Weft yarn 5 is above warp yarns 1; 3; 6 to 7; 10; 12, and below warp yarns 2; 4 to 5; 8 to 9; 11; 13.

Weft yarn 6 is above warp yarns 3 to 4; 7; 9; 11; 13, and below warp yarns 1 to 2; 5 to 6; 8; 10; 12.

Weft yarn 7 is above warp yarns 1; 4; 6; 8; 10; 13, and below warp yarns 2 to 3; 5; 7; 9; 11 to 12.

Weft yarn 8 is above warp yarns 1; 3; 5; 7; 10 to 11, and below warp yarns 2; 4; 6; 8 to 9; 12 to 13.

Weft yarn 9 is above warp yarns 2; 4; 7 to 8; 11; 13, and below warp yarns 1; 3; 5 to 6; 9 to 10; 12.

Weft yarn 10 is above warp yarns 1; 4 to 5; 8; 10; 12, and below warp yarns 2 to 3; 6 to 7; 9; 11; 13.

Weft yarn 11 is above warp yarns 1 to 2; 5; 7; 9; 11, and below warp yarns 3 to 4; 6; 8; 10; 12 to 13.

Weft yarn 12 is above warp yarns 2; 4; 6; 8; 11 to 12, and below warp yarns 1; 3; 5; 7; 9 to 10; 13.

Weft yarn 13 is above warp yarns 1; 3; 5; 8 to 9; 12, and below warp yarns 2; 4; 6 to 7; 10 to 11; 13.

Figure 44:
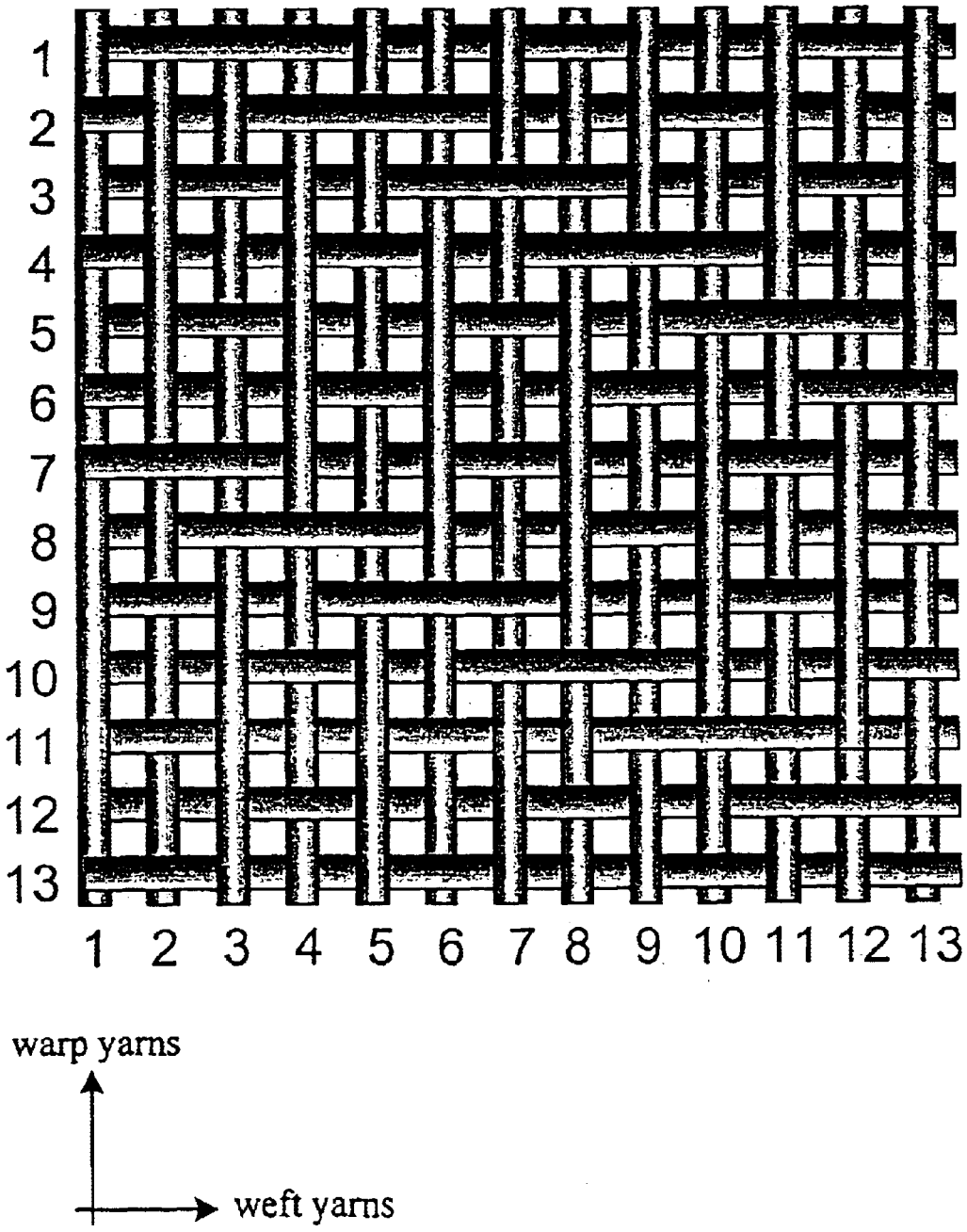

The example of an embodiment in accordance with FIG. 44 requires for a complete pattern which can be repeated thirteen weft yarns and thirteen warp yarns. There is one type of weft yarn present.

Weft yarn 1 is above warp yarns 2 to 4; 8; 12, and below warp yarns 1; 5 to 7; 9 to 11; 13.

Weft yarn 2 is above warp yarns 1; 4 to 6; 10, and below warp yarns 2 to 3; 7 to 9; 11 to 13.

Weft yarn 3 is above warp yarns 3; 6 to 8; 12, and below warp yarns 1 to 2; 4 to 5; 9 to 11; 13.

Weft yarn 4 is above warp yarns 1; 5; 8 to 10, and below warp yarns 2 to 4; 6 to 7; 11 to 13.

Weft yarn 5 is above warp yarns 3; 7; 10 to 12, and below warp yarns 1 to 2; 4 to 6; 8 to 9; 13.

Weft yarn 6 is above warp yarns 1; 5; 9; 12 to 13, and below warp yarns 2 to 4; 6 to 8; 10 to 11.

Weft yarn 7 is above warp yarns 1 to 3; 7; 11, and below warp yarns 4 to 6; 8 to 10; 12 to 13.

Weft yarn 8 is above warp yarns 3 to 5; 9; 13, and below warp yarns 1 to 2; 6 to 8; 10 to 12.

Weft yarn 9 is above warp yarns 2; 5 to 7; 11, and below warp yarns 1; 3 to 4; 8 to 10; 12 to 13.

Weft yarn 10 is above warp yarns 4; 7 to 9; 13, and below warp yarns 1 to 3; 5 to 6; 10 to 12.

Weft yarn 11 is above warp yarns 2; 6; 9 to 11, and below warp yarns 1; 3 to 5; 7 to 8; 12 to 13.

Weft yarn 12 is above warp yarns 4; 8; 11 to 13, and below warp yarns 1 to 3; 5 to 7; 9 to 10.

Weft yarn 13 is above warp yarns 1 to 2; 6; 10; 13, and below warp yarns 3 to 5; 7 to 9; 11 to 12.

Figure 45:
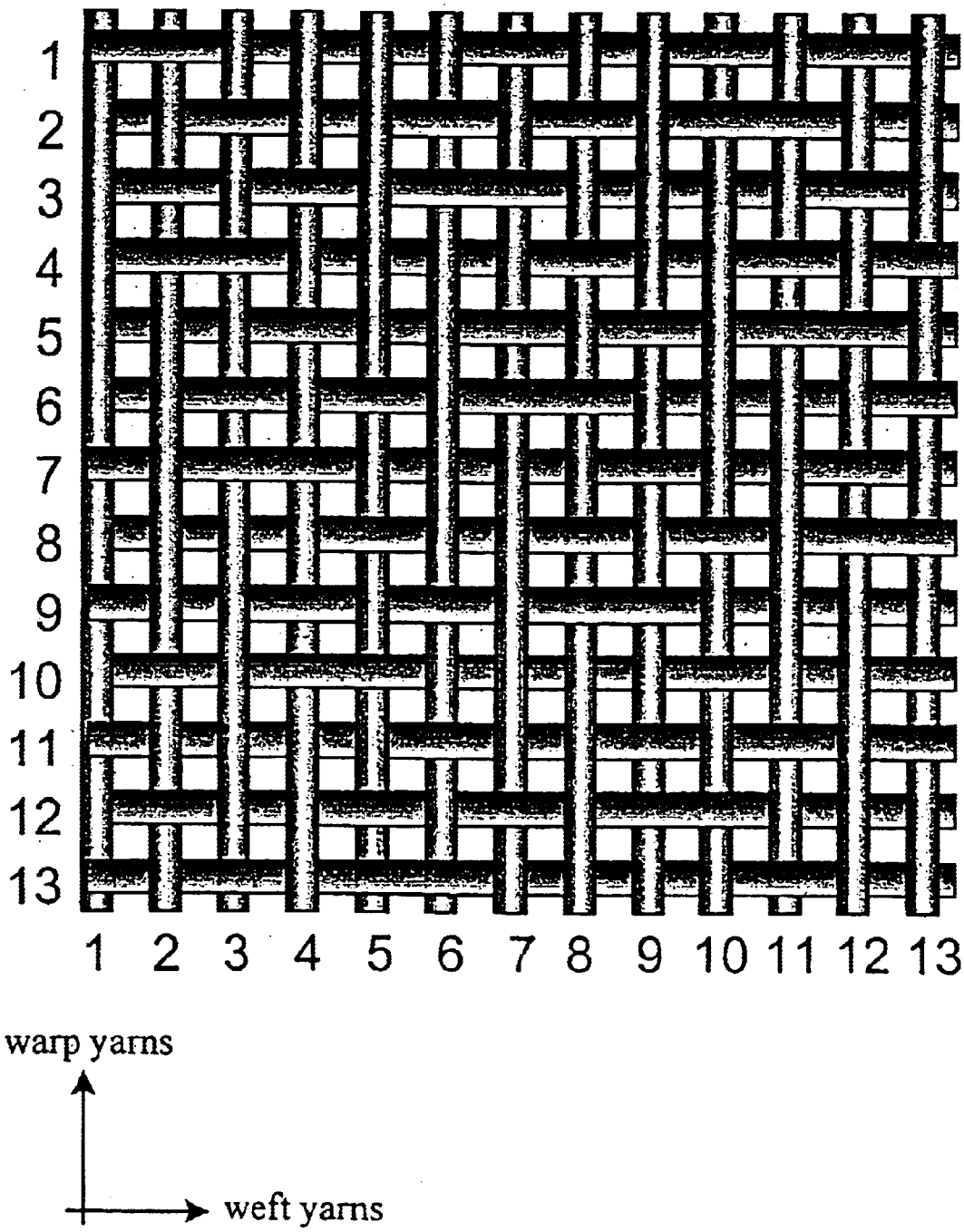

The example of an embodiment in accordance with FIG. 45 requires for a complete pattern which can be repeated thirteen weft yarns and thirteen warp yarns. There is one type of weft yarn present.

Weft yarn 1 is above warp yarns 1 to 2; 7; 10; 12, and below warp yarns 3 to 6; 8 to 9; 11; 13.

Weft yarn 2 is above warp yarns 3; 6; 8; 10 to 11, and below warp yarns 1 to 2; 4 to 5; 7; 9; 12 to 13.

Weft yarn 3 is above warp yarns 2; 4; 6 to 7; 12, and below warp yarns 1; 3; 5; 8 to 11; 13.

Weft yarn 4 is above warp yarns 2 to 3; 8; 11; 13, and below warp yarns 1; 4 to 7; 9 to 10; 12.

Weft yarn 5 is above warp yarns 4; 7; 9; 11 to 12, and below warp yarns 1 to 3; 5 to 6; 8; 10; 13.

Weft yarn 6 is above warp yarns 3; 5; 7 to 8; 13, and below warp yarns 1 to 2; 4; 6; 9 to 12.

Weft yarn 7 is above warp yarns 1; 3 to 4; 9; 12, and below warp yarns 2; 5 to 8; 10 to 11; 13.

Weft yarn 8 is above warp yarns 5; 8; 10; 12 to 13, and below warp yarns 1 to 4; 6 to 7; 9; 11.

Weft yarn 9 is above warp yarns 1; 4; 6; 8 to 9, and below warp yarns 2 to 3; 5; 7; 10 to 13.

Weft yarn 10 is above warp yarns 2; 4 to 5; 10; 13, and below warp yarns 1; 3; 6 to 9; 11 to 12.

Weft yarn 11 is above warp yarns 1; 6; 9; 11; 13, and below warp yarns 2 to 5; 7 to 8; 10; 12.

Weft yarn 12 is above warp yarns 2; 5; 7; 9 to 10, and below warp yarns 1; 3 to 4; 6; 8; 11 to 13.

Weft yarn 13 is above warp yarns 1; 3; 5 to 6; 11, and below warp yarns 2; 4; 7 to 10; 12 to 13.

Figure 46:
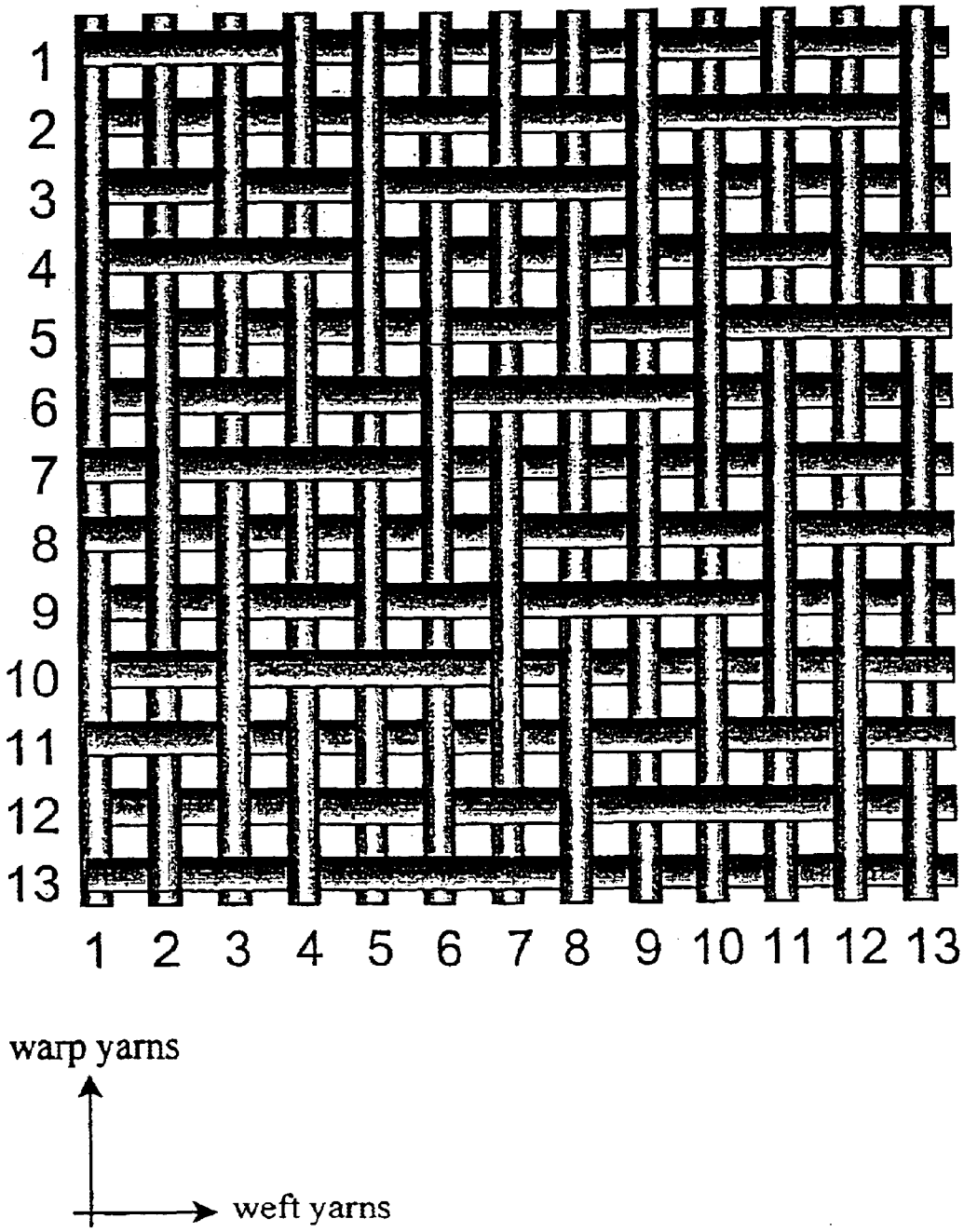

The example of an embodiment in accordance with FIG. 46 requires for a complete pattern which can be repeated thirteen weft yarns and thirteen warp yarns. There is one type of weft yarn present.

Weft yarn 1 is above warp yarns 1 to 3; 10; 12, and below warp yarns 4 to 9; 11; 13.

Weft yarn 2 is above warp yarns 6; 8; 10 to 12, and below warp yarns 1 to 5; 7; 9; 13.

Weft yarn 3 is above warp yarns 2; 4; 6 to 8, and below warp yarns 1; 3; 5; 9 to 13.

Weft yarn 4 is above warp yarns 2 to 4; 11; 13, and below warp yarns 1; 5 to 10; 12.

Weft yarn 5 is above warp yarns 7; 9; 11 to 13, and below warp yarns 1 to 6; 8; 10.

Weft yarn 6 is above warp yarns 3; 5; 7 to 9, and below warp yarns 1 to 2; 4; 6; 10 to 13.

Weft yarn 7 is above warp yarns 1; 3 to 5; 12, and below warp yarns 2; 6 to 11; 13.

Weft yarn 8 is above warp yarns 1; 8; 10; 12 to 13, and below warp yarns 2 to 7; 9; 11.

Weft yarn 9 is above warp yarns 4; 6; 8 to 10, and below warp yarns 1 to 3; 5; 7; 11 to 13.

Weft yarn 10 is above warp yarns 2; 4 to 6; 13, and below warp yarns 1; 3; 7 to 12.

Weft yarn 11 is above warp yarns 1 to 2; 9; 11; 13, and below warp yarns 3 to 8; 10; 12.

Weft yarn 12 is above warp yarns 5; 7; 9 to 11, and below warp yarns 1 to 4; 6; 8; 12 to 13.

Weft yarn 13 is above warp yarns 1; 3; 5 to 7, and below warp yarns 2; 4; 8 to 13.

Figure 47:
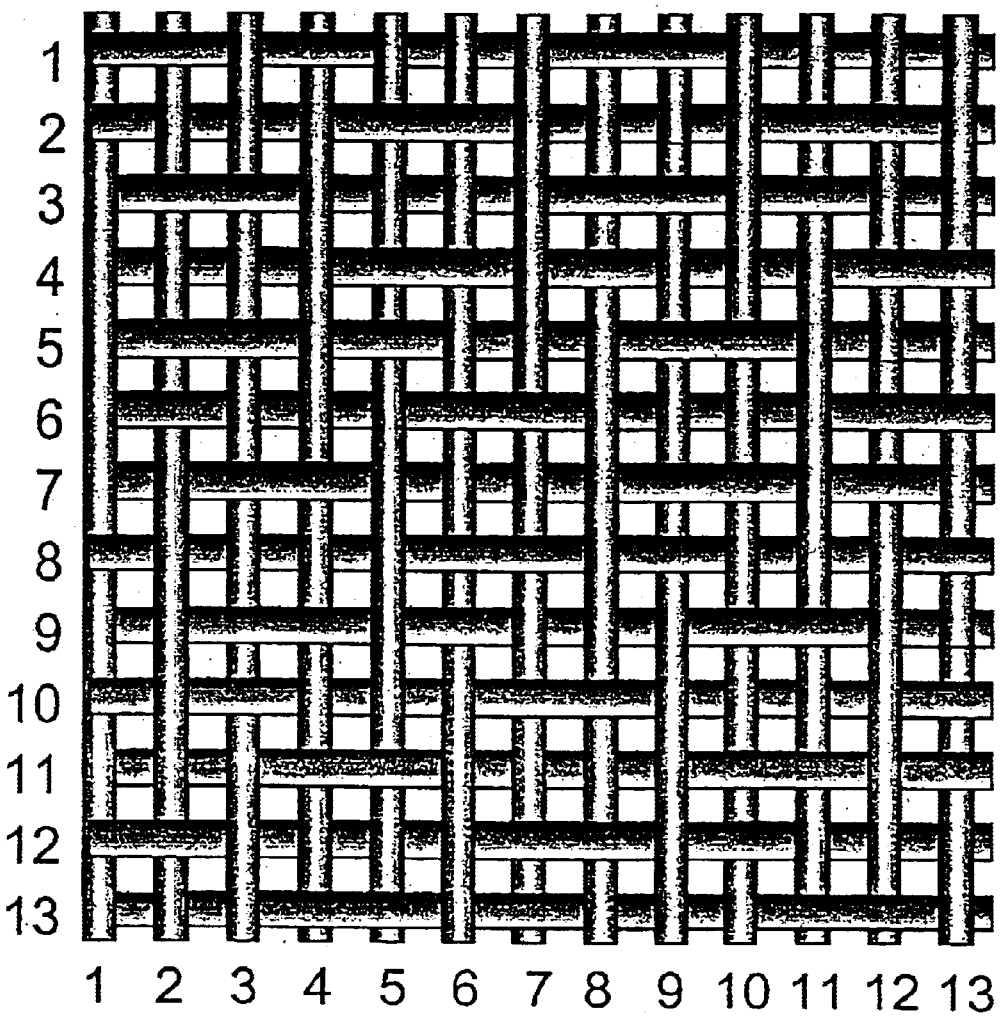
Figure 47:
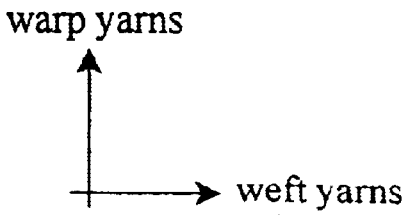

The example of an embodiment in accordance with FIG. 47 requires for a complete pattern which can be repeated thirteen weft yarns and thirteen warp yarns. There is one type of weft yarn present.

Weft yarn 1 is above warp yarns 1 to 2; 4; 8 to 9, and below warp yarns 3; 5 to 7; 10 to 13.

Weft yarn 2 is above warp yarns 1; 5 to 6; 11 to 12, and below warp yarns 2 to 4; 7 to 10; 13.

Weft yarn 3 is above warp yarns 2 to 3; 8 to 9; 11, and below warp yarns 1; 4 to 7; 10; 12 to 13.

Weft yarn 4 is above warp yarns 5 to 6; 8; 12 to 13, and below warp yarns 1 to 4; 7; 9 to 11.

Weft yarn 5 is above warp yarns 2 to 3; 5; 9 to 10, and below warp yarns 1; 4; 6 to 8; 11 to 13.

Weft yarn 6 is above warp yarns 2; 6 to 7; 12 to 13, and below warp yarns 1; 3 to 5; 8 to 11.

Weft yarn 7 is above warp yarns 3 to 4; 9 to 10; 12, and below warp yarns 1 to 2; 5 to 8; 11; 13.

Weft yarn 8 is above warp yarns 1; 6 to 7; 9; 13, and below warp yarns 2 to 5; 8; 10 to 12.

Weft yarn 9 is above warp yarns 3 to 4; 6; 10 to 11, and below warp yarns 1 to 2; 5; 7 to 9; 12 to 13.

Weft yarn 10 is above warp yarns 1; 3; 7 to 8; 13, and below warp yarns 2; 4 to 6; 9 to 12.

Weft yarn 11 is above warp yarns 4 to 5; 10 to 11; 13, and below warp yarns 1 to 3; 6 to 9; 12.

Weft yarn 12 is above warp yarns 1 to 2; 7 to 8; 10, and below warp yarns 3 to 6; 9; 11 to 13.

Weft yarn 13 is above warp yarns 4 to 5; 7; 11 to 12, and below warp yarns 1 to 3; 6; 8 to 10; 13.

Figure 48:
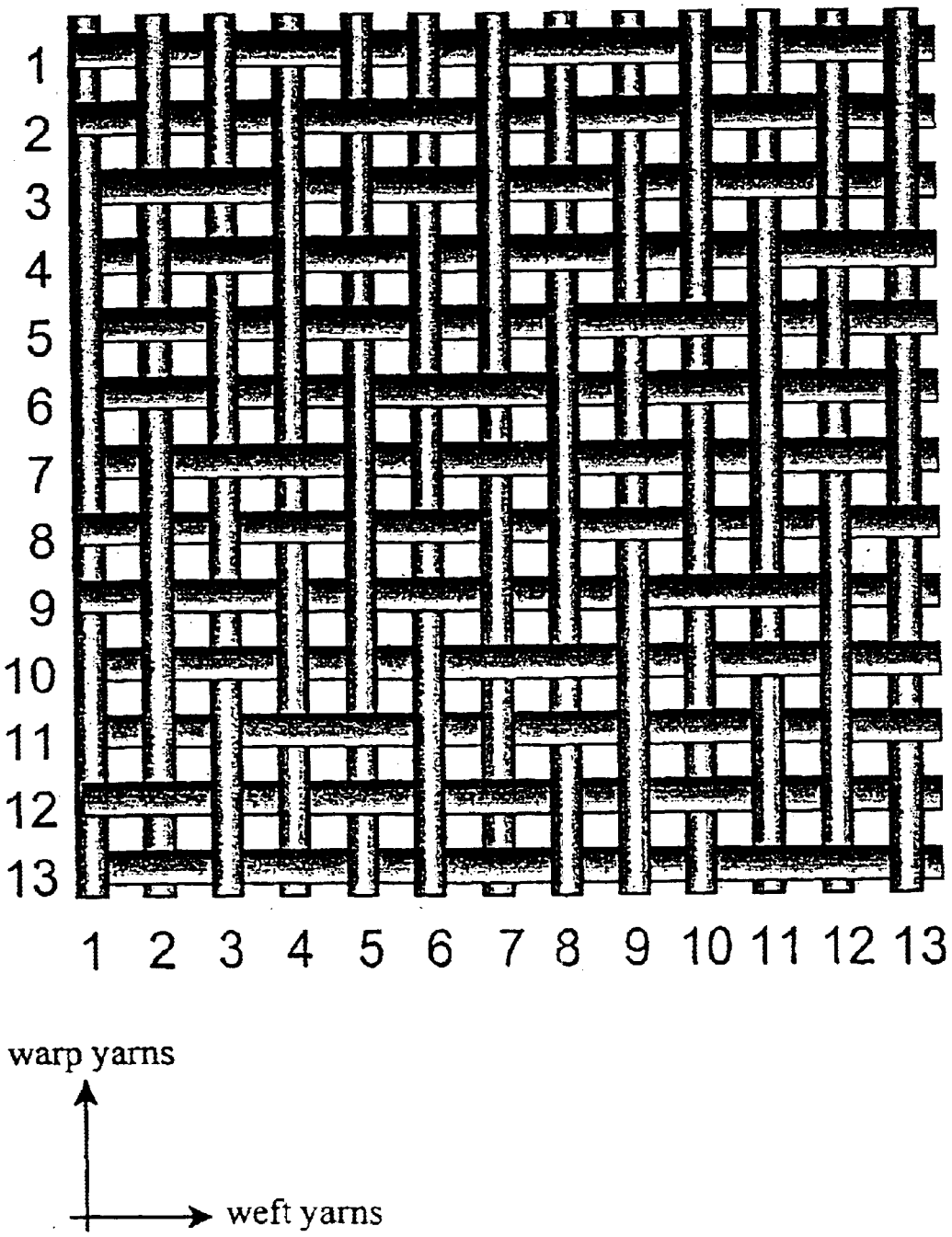

The example of an embodiment in accordance with FIG. 48 requires for a complete pattern which can be repeated thirteen weft yarns and thirteen warp yarns. There is one type of weft yarn present.

Weft yarn 1 is above warp yarns 1; 4; 8 to 9; 12, and below warp yarns 2 to 3; 5 to 7; 10 to 11; 13.

Weft yarn 2 is above warp yarns 1; 5 to 6; 9; 11, and below warp yarns 2 to 4; 7 to 8; 10; 12 to 13.

Weft yarn 3 is above warp yarns 2 to 3; 6; 8; 11, and below warp yarns 1; 4 to 5; 7; 9 to 10; 12 to 13.

Weft yarn 4 is above warp yarns 3; 5; 8; 12 to 13, and below warp yarns 1 to 2; 4; 6 to 7;9 to 11.

Weft yarn 5 is above warp yarns 2; 5; 9 to 10; 13, and below warp yarns 1; 3 to 4; 6 to 8; 11 to 12.

Weft yarn 6 is above warp yarns 2; 6 to 7; 10; 12, and below warp yarns 1; 3 to 5; 8 to 9; 11; 13.

Weft yarn 7 is above warp yarns 3 to 4; 7; 9; 12, and below warp yarns 1 to 2; 5 to 6; 8; 10 to 11; 13.

Weft yarn 8 is above warp yarns 1; 4; 6; 9; 13, and below warp yarns 2 to 3; 5; 7 to 8; 10 to 12.

Weft yarn 9 is above warp yarns 1; 3; 6; 10 to 11, and below warp yarns 2; 4 to 5; 7 to 9; 12 to 13.

Weft yarn 10 is above warp yarns 3; 7 to 8; 11; 13, and below warp yarns 1 to 2; 4 to 6; 9 to 10; 12.

Weft yarn 11 is above warp yarns 4 to 5; 8; 10; 13, and below warp yarns 1 to 3; 6 to 7; 9; 11 to 12.

Weft yarn 12 is above warp yarns 1 to 2; 5; 7; 10, and below warp yarns 3 to 4; 6; 8 to 9; 11 to 13.

Weft yarn 13 is above warp yarns 2; 4; 7; 11 to 12, and below warp yarns 1; 3; 5 to 6; 8 to 10; 13.

FIGS. 49 and 50 show respectively a paper product in accordance with the invention from the side of the Yankee cylinder and from the opposite side. FIG. 50 is adduced for the description. This view shows alternate different forms and sizes of non-compressed zones. Smaller non-compressed zones have been given the reference numeral 22 and the alternating larger non-compressed zones have been given reference numeral 23. These non-compressed zones 22 and 23 are surrounded by compressed zones, which can also be described as lines similar to pickets. They have the reference numeral 24 for a smaller non-compressed zone 22. In the same manner, these reference numerals are also present for the other non-compressed zones. In this special case, the smaller non-compressed zones 22 are designed without creping folds. The larger non-compressed zones in this case have two creping folds 25, in which these creping folds are present at a pre-determined distance 26. In accordance with the drawing in FIG. 50, two parallel compressed zones, between which there is a non-compressed zone, overlap each other by up to 20%. The distance in the machine direction (MD) and/or cross machine direction (CD) from one compressed zone to the other compressed zone is different in length. This is due to the fact that different types of non-compressed zones alternate with each other. In FIG. 50 this is marked by the signs $\mathbf{1}_1$ and $\mathbf{1}_2$. The paper is also creped in the compressed zones, i.e. where the paper is pressed during the drying against the Yankee cylinder.

If the surface of the fabric is ground, not all warp yarns and weft yarns are ground, due to the high three-dimensionness of the fabric. Some yarns are located so considerably below the ground surface that only by extensively grinding the lower positioned yarns could also be ground.

The tissue paper product described above is producible with a paper making machine fabric according to FIG. 51 as described.

The embodiment according to FIG. 51 requires for a complete pattern which can be repeated eight weft yarns and eight warp yarns. Three types of weft yarns are present. The weft yarns 1 and 5 form a first type, the weft yarns 2, 3, 6 and 7 form a second type and the weft yarns 4 and 8 form a third type.

Weft yarn 1 is above warp yarns 1–4; 7 and below warp yarns 5; 6; 8.

Weft yarn 2 is above warp yarns 4; 6; 8 and below warp yarns 1–3; 5; 7.

Weft yarn 3 is above warp yarns 1; 3; 7 and below warp yarns 2; 4–6; 8.

Weft yarn 4 is above warp yarns 3–6; 8 and below warp yarns 1; 2; 7.

Weft yarn 5 is above warp yarns 3; 5–8 and below warp yarns 1; 2; 4.

Weft yarn 6 is above warp yarns 2; 4; 8 and below warp yarns 1; 3; 5–7.

Weft yarn 7 is above warp yarns 3; 5; 7 and below warp yarns 1; 2; 4; 6; 8.

Weft yarn 8 is above warp yarns 1; 2; 4; 7; 8 and below warp yarns 3; 5; 6.

What is claimed is:

1. A paper making machine fabric comprising:

a woven fabric having a weave pattern which is regularly repeated over the surface, weft yarns, warp yarns, and recesses or pockets which open upwardly to a paper supporting side of the fabric, wherein in zones spaced over a surface of the fabric, one of the warp yarns overlays at least three of the weft yarns in direct sequence, said one warp yarn having adjacent warp yarn disposed on each side of said one warp yarn, a first of said at least three weft yarns extends under said one warp yarn and under the adjacent warp yarns on both sides of said one warp yarn, a second and third of said three weft yarns overlays the adjacent warp yarns at at least three points; and one of the weft yarns overlays at least three of the warp yarns in direct sequence, said one weft yarn having an adjacent weft yarn disposed on each side of said weft yarn, a first of said at least three warp yarns extends under said one weft yarn and under the adjacent weft yarns on both sides of said one weft yarn, and a second and third of said at least three warp yarns overlays said adjacent weft yarns at at least three points;

wherein said overlays are on the paper supporting side of the fabric.

2. A paper making machine fabric as in claim 1, wherein in a zone of the at least three overlays in direct sequence outer crossing points are formed as raised crossing points.

3. A paper making machine fabric as in claim 1, wherein raised outer crossing points are formed on a yarn having at least three overlays in direct sequence at an intersection point where said yarn extends under another yarn in direct sequence with the three overlays.

4. A paper making machine fabric as in claim 1, wherein the yarns are weaved differently in groups.

5. A paper making machine fabric as in claim 1, wherein the weft yarns and the warp yarns which form the three overlays in direct sequence are in part ground in planar form from the paper supporting side.

6. A paper making machine fabric comprising:

a woven fabric having a regularly repeated weave pattern, weft yarns, warp yarns, and recesses or pockets which open upwardly to a paper supporting side of the fabric, wherein in the weave pattern, one of the warp yarns overlays at least three of the weft yarns in direct sequence, said one warp yarn having an adjacent warp yarn disposed on each side of said one warp yarn, a first of said at least three weft yarns extends under said one warp yarn and under the adjacent warp yarns on both sides of said one warp yarn, a second of said three weft yarns overlays at least one of said adjacent warp yarns, and a third of said three weft yarns overlays both of said adjacent warp yarns; and one of the weft yarns overlays at least three of the warp yarns in direct sequence, said one weft yarn having an adjacent weft yarn disposed on each side of said weft yarn, a first of said at least three warp yarns extends under said one weft yarn and under the adjacent weft yarns on both sides of said one weft yarn, a second of said at least three warp yarns overlays at least one of said adjacent weft yarns, and a third of said at least three warp yarns overlaps both of said adjacent weft yarns;

wherein said overlays are on the paper supporting side of the fabric.

7. A paper making machine fabric comprising a woven fabric having a weave pattern repeating over the surface, wherein a pattern square for the repeating pattern contains eight warp yarns and eight weft yarns, and wherein weft yarn 1 is above warp yarns 1; 3; 5 to 7 and below warp yarns 2; 4; 8;

weft yarn 2 is above warp yarns 1 to 2; 4; 6; 8 and below warp yarns 3; 5; 7;

weft yarn 3 is above warp yarns 1; 5; 7 and below warp yarns 2 to 4; 6; 8;

weft yarn 4 is above warp yarns 2; 4; 6 and below warp yarns 3; 5; 7 to 8; 1;

weft yarn 5 is above warp yarns 1 to 3; 5; 7 and below warp yarns 4; 6; 8;

weft yarn 6 is above warp yarns 2; 4 to 6; 8 and below warp yarns 1; 3; 7;

weft yarn 7 is above warp yarns 1; 3; 5 and below warp yarns 2; 4; 6 to 8;

weft yarn 8 is above warp yarns 2; 6; 8 and below warp yarns 1; 3 to 5; 7.

* * * * *

UNITED STATES PATENT AND TRADEMARK OFFICE

CERTIFICATE OF CORRECTION

PATENT NO. : 6,649,026 B2
DATED : November 18, 2003
INVENTOR(S) : Hans Jürgen Lamb It is certified that error appears in the above-identified patent and that said Letters Patent is hereby corrected as shown below:

Title page,
Item [54], Title, "PAPER MAKING MACHINE FABRIC" should be -- PAPER MAKING MACHINE FABRIC AS WELL AS TISSUE PAPER PRODUCED THEREBY --.

Signed and Sealed this

Eighteenth Day of May, 2004

JON W. DUDAS
*Acting Director of the United States Patent and Trademark Office*